US012059090B2

(12) United States Patent
Mullet et al.

(10) Patent No.: US 12,059,090 B2
(45) Date of Patent: Aug. 13, 2024

(54) BIRDCAGE PINCH PLEAT AND RIPPLEFOLD DRAPERY ATTACHMENT SYSTEM

(71) Applicant: Current Products Corp., Pensacola, FL (US)

(72) Inventors: Willis J. Mullet, Gulf Breeze, FL (US); Scott Hand, Pace, FL (US); Phillip Dugger, Pensacola, FL (US)

(73) Assignee: Current Products Company, LLC, Pensacola, FL (US)

( * ) Notice: Subject to any disclaimer, the term of this patent is extended or adjusted under 35 U.S.C. 154(b) by 408 days.

(21) Appl. No.: 17/298,152

(22) PCT Filed: Sep. 10, 2020

(86) PCT No.: PCT/US2020/050180
§ 371 (c)(1),
(2) Date: May 28, 2021

(87) PCT Pub. No.: WO2021/050714
PCT Pub. Date: Mar. 18, 2021

(65) Prior Publication Data

US 2022/0125231 A1 Apr. 28, 2022

Related U.S. Application Data

(60) Provisional application No. 62/899,930, filed on Sep. 13, 2019.

(51) Int. Cl.
*A47H 13/02* (2006.01)
*A47H 13/06* (2006.01)
*A47H 13/16* (2006.01)

(52) U.S. Cl.
CPC ..... *A47H 13/16* (2013.01); *A47H 13/02* (2013.01); *A47H 13/06* (2013.01)

(58) Field of Classification Search
CPC ..... A47H 13/02; A47H 13/04; A47H 13/06; A47H 13/14; A47H 13/16; A47H 15/02; A47H 15/04
See application file for complete search history.

(56) References Cited

U.S. PATENT DOCUMENTS 745,354 A * 12/1903 Jennings ..... A47H 13/04 24/361
765,014 A * 7/1904 Kintz ..... A47H 13/04 24/361

(Continued)

FOREIGN PATENT DOCUMENTS

DE 6937686 U 1/1970

OTHER PUBLICATIONS

Extended European Search Report—Pinch Pleat and Ripplefold Drapery Attachment System—Application No. EP 20863071—Jul. 12, 2023.

*Primary Examiner* — Johnnie A. Shablack
(74) *Attorney, Agent, or Firm* — BrownWinick Law Firm; Christopher A. Proskey

(57) ABSTRACT

A system is presented that can be used to install pinch pleat drapery as well as ripplefold drapery onto a drapery rod as well as a drapery track. The system includes the use of a plurality of attachment members that have a center channel, a left channel and a right channel that are configured to receive a drapery pin therein. When a pinch pleat drapery is installed, drapery pins are placed in the center channels of the attachment members. When a ripplefold drapery is installed, drapery pins are installed in the attachment members in a pattern wherein adjacent drapery pins point in opposite directions thereby forming a pattern of drapery pins that point left, right, left, right and so on. In this way, a single system may be used that installs both pinch pleat drapery as (Continued)

well as ripplefold drapery onto a drapery rod as well as a drapery track.

26 Claims, 72 Drawing Sheets

(56) References Cited

U.S. PATENT DOCUMENTS 1,863,638 A * 6/1932 Richter ..... A47H 13/04 24/698.3
2,181,813 A * 11/1939 Kaufman ..... A47H 13/14 160/348
2,522,358 A * 9/1950 Franson ..... A47H 13/14 160/348
2,646,116 A * 7/1953 Freeman ..... A47H 13/14 D8/394
2,765,844 A * 10/1956 Kuddes ..... A47H 13/14 160/348
2,793,691 A * 5/1957 Shayman ..... A47H 13/04 160/348
3,132,686 A * 5/1964 Judovits ..... A47H 13/16 112/427
3,184,204 A * 5/1965 Dachinger ..... A47G 25/1478 248/323
3,191,665 A * 6/1965 Rosenbaum ..... A47H 13/14 160/348
3,223,148 A * 12/1965 Potye ..... A47H 13/14 160/348
3,335,786 A * 8/1967 Weisberg ..... A47H 13/14 160/348
3,378,879 A * 4/1968 Stall ..... A47H 13/14 16/93 D
3,399,712 A * 9/1968 Weisberg ..... A47H 13/16 24/345
3,861,001 A 1/1975 Pape
4,170,053 A * 10/1979 Rosenzweig ..... A47H 13/14 160/348
4,277,865 A * 7/1981 Takazawa ..... A47H 13/04 24/345
4,546,809 A * 10/1985 Hadfield ..... A47H 15/04 160/126
4,642,843 A * 2/1987 Hershfield ..... A47H 1/142 16/95 D
5,109,912 A 5/1992 Gary
10,398,248 B1 * 9/2019 Burch, Jr. ..... A47H 13/04
2021/0321811 A1 * 10/2021 Mullet ..... A47H 13/04

* cited by examiner

BIRDCAGE PINCH PLEAT AND RIPPLEFOLD DRAPERY ATTACHMENT SYSTEM

CROSS REFERENCE TO RELATED APPLICATIONS

This application is a 371 of International Application No. PCT/US20/50180 which was filed Sep. 10, 2021, which also claims priority to U.S. Provisional Application No. 62/889,930 filed Sep. 13, 2019, the entirety of which is hereby fully incorporated by reference herein.

FIELD OF THE DISCLOSURE

This disclosure relates to window coverings. More specifically and without limitation, this disclosure relates to pinch pleat and ripplefold drapery window coverings.

OVERVIEW OF THE DISCLOSURE

Architectural coverings, such as curtains, shades, draperies and the like are old and well known in the art and are frequently used to provide privacy as well as to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is commonly referred to as a drapery. Common components of draperies include a support rod or track connected to brackets positioned above or adjacent to a window or door. There are two common forms of drapery material that are of particular importance to this disclosure pinch pleat drapery material and ripplefold drapery material.

Pinch pleat drapery material is commonly recognized as having a plurality of equally spaced pleats of material at the upper end of the panel of drapery material. These pleats define the shape and look of the panel of drapery material as it hangs down from the supporting rod or track.

Ripplefold drapery material is commonly recognized as being formed of a panel of drapery material that has curves formed in the material from the manner in which the panel of drapery material is connected to the supporting rod or track. These curves in the panel of drapery material that are imparted by the manner in which the panel of drapery material is connected to the supporting rod or track define the shape and look of the panel of drapery material as it hangs down from the supporting rod or track.

Each of pinch pleat drapery material and ripplefold drapery material have their own advantages and disadvantages. Each of pinch pleat drapery material and ripplefold drapery material are particularly well suited for various applications and installations. Each of pinch pleat drapery material and ripplefold drapery material provide unique aesthetic appeals that fit into various decors.

While each of pinch pleat drapery material and ripplefold drapery material have their own unique advantages and appeals, one substantial disadvantage is that each of pinch pleat drapery material and ripplefold drapery material have their requirements and peculiarities for effective installation and use. As such, there is no one system or method available for attaching both a pinch pleat drapery and a ripplefold drapery to a supporting rod or track that works effectively for both a pinch pleat drapery and a ripplefold drapery. In addition, there is no one system or method available for attaching both a pinch pleat drapery and a ripplefold drapery to a supporting rod or track that provides aesthetically pleasing results for both a pinch pleat drapery and a ripplefold drapery.

Thus, it is a primary object of the disclosure to provide a pinch pleat and ripplefold drapery attachment system that improves upon the state of the art.

Another object of the disclosure is to provide a pinch pleat and ripplefold drapery attachment system that effectively attaches pinch pleat drapery material to a supporting track.

Yet another object of the disclosure is to provide a pinch pleat and ripplefold drapery attachment system that effectively attaches ripplefold drapery material to a supporting track.

Another object of the disclosure is to provide a pinch pleat and ripplefold drapery attachment system that effectively attaches pinch pleat drapery material to a supporting rod.

Yet another object of the disclosure is to provide a pinch pleat and ripplefold drapery attachment system that effectively attaches ripplefold drapery material to a supporting rod.

Another object of the disclosure is to provide a pinch pleat and ripplefold drapery attachment system that provides aesthetically pleasing results when using pinch pleat drapery material.

Yet another object of the disclosure is to provide a pinch pleat and ripplefold drapery attachment system that provides aesthetically pleasing results when using ripplefold drapery material.

Another object of the disclosure is to provide a pinch pleat and ripplefold drapery attachment system that does not require sewing snap tape to the top of the drapery for use.

Yet another object of the disclosure is to provide a pinch pleat and ripplefold drapery attachment system that is easy to use.

Another object of the disclosure is to provide a pinch pleat and ripplefold drapery attachment system that is simple in design.

Yet another object of the disclosure is to provide a pinch pleat and ripplefold drapery attachment system that allows for infinite adjustment of the installation of a ripplefold drapery.

Another object of the disclosure is to provide a pinch pleat and ripplefold drapery attachment system that allows for installation of equal-spaced ripples in a ripplefold drapery.

Yet another object of the disclosure is to provide a pinch pleat and ripplefold drapery attachment system that allows for installation of varying-spaced ripples in a ripplefold drapery.

Another object of the disclosure is to provide a pinch pleat and ripplefold drapery attachment system that is relatively inexpensive or affordable.

Yet another object of the disclosure is to provide a pinch pleat and ripplefold drapery attachment system that facilitates smooth operation.

Another object of the disclosure is to provide a pinch pleat and ripplefold drapery attachment system that has a minimum number of parts.

Yet another object of the disclosure is to provide a pinch pleat and ripplefold drapery attachment system that can be manually operated as well as operated by motorization.

Another object of the disclosure is to provide a pinch pleat and ripplefold drapery attachment system that facilitates robust operation.

Yet another object of the disclosure is to provide a pinch pleat and ripplefold drapery attachment system that makes it easier to use draperies.

Another object of the disclosure is to provide a pinch pleat and ripplefold drapery attachment system that makes it easier to install draperies.

Yet another object of the disclosure is to provide a pinch pleat and ripplefold drapery attachment system that makes it less expensive to install draperies.

Another object of the disclosure is to provide a pinch pleat and ripplefold drapery attachment system that provides a user with greater installation options.

Yet another object of the disclosure is to provide a pinch pleat and ripplefold drapery attachment system that controls the positioning of the drapery material within close tolerances.

Another object of the disclosure is to provide a pinch pleat and ripplefold drapery attachment system that allows for the adjustment of the fullness of a drapery.

Yet another object of the disclosure is to provide a pinch pleat and ripplefold drapery attachment system that allows for custom installations, such as more-full in the front, or varying ripple spacing along the length of the drapery material.

Another object of the disclosure is to provide a pinch pleat and ripplefold drapery attachment system that allows for the creation of the ripplefold look using a flat panel of drapery material.

Yet another object of the disclosure is to provide a pinch pleat and ripplefold drapery attachment system that allows for the creation of the ripplefold look using a flat panel of drapery material hung from a drapery rod.

These and other objects, features, or advantages of the present disclosure will become apparent from the specification, claims and drawings.

SUMMARY OF THE DISCLOSURE

A system is presented that can be used to install pinch pleat drapery as well as ripplefold drapery onto a drapery rod as well as a drapery track. The system includes the use of a plurality of attachment members that have a center channel, a left channel and a right channel that are configured to receive a drapery pin therein. When a pinch pleat drapery is installed, drapery pins are placed in the center channels of the attachment members. When a ripplefold drapery is installed, drapery pins are installed in the attachment members in a pattern wherein adjacent drapery pins point in opposite directions thereby forming a pattern of drapery pins that point left, right, left, right and so on. In this way, a single system may be used that installs both pinch pleat drapery as well as ripplefold drapery onto a drapery rod as well as a drapery track.

DETAILED DESCRIPTION OF THE DISCLOSURE

Figure 1:
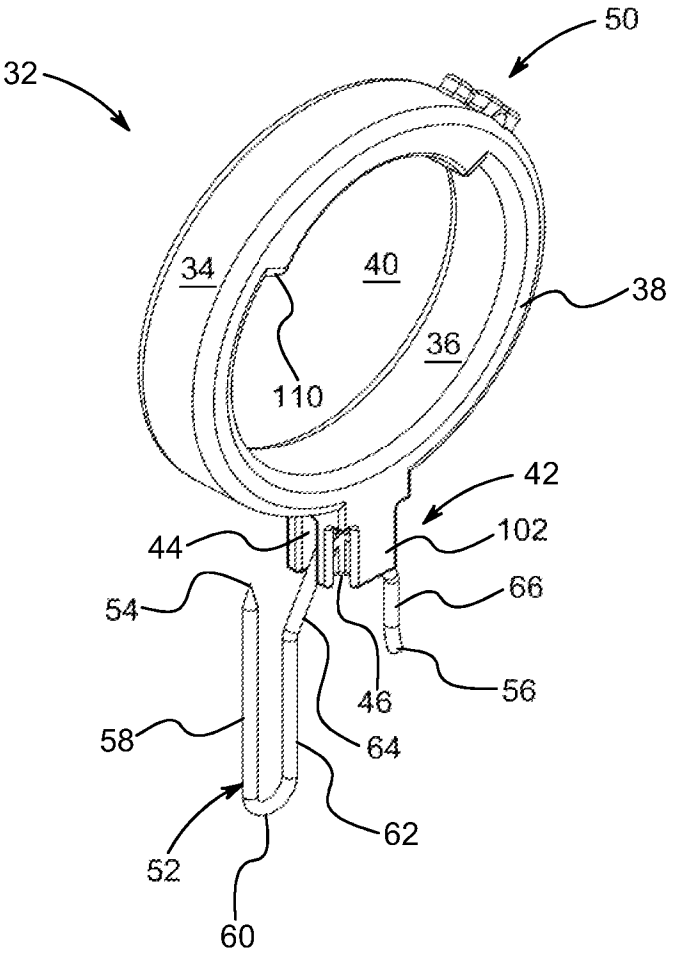
FIG. 1 shows an upper front side perspective view of a ring and drapery pin for a pinch pleat and ripplefold drapery system, in accordance with one or more embodiments; the view showing the drapery pin in a center channel of an attachment member of the ring.
Figure 2:
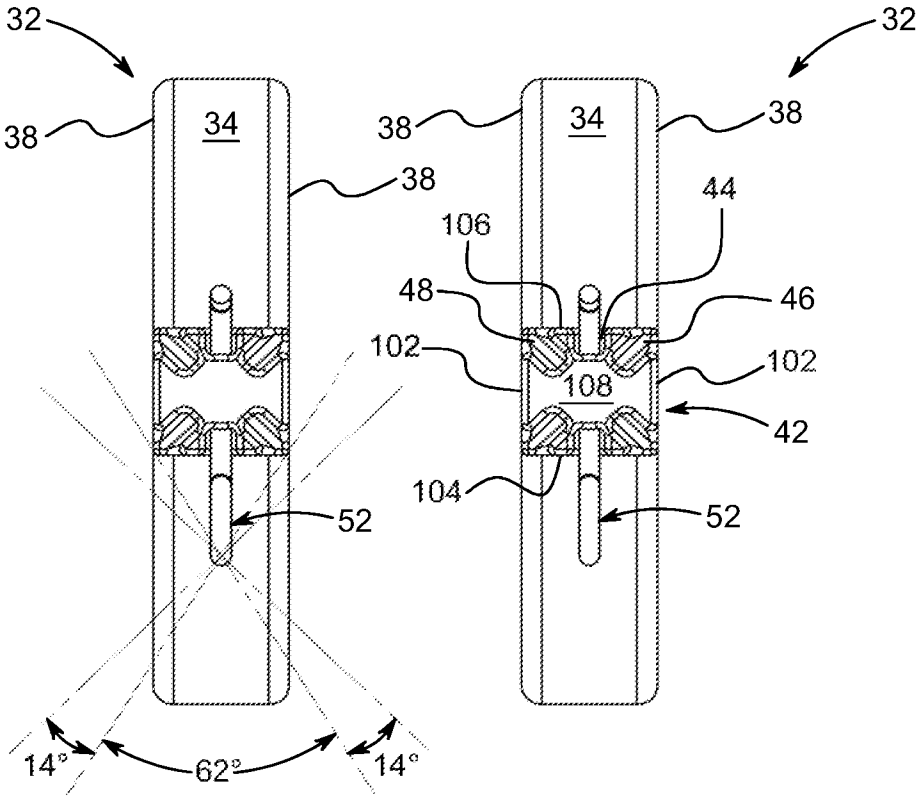
FIG. 2 shows a bottom view of a pair of rings and drapery pins for a pinch pleat and ripplefold drapery system, in accordance with one or more embodiments; the view showing the drapery pins in a center channel of an attachment member of the ring.
Figure 3:
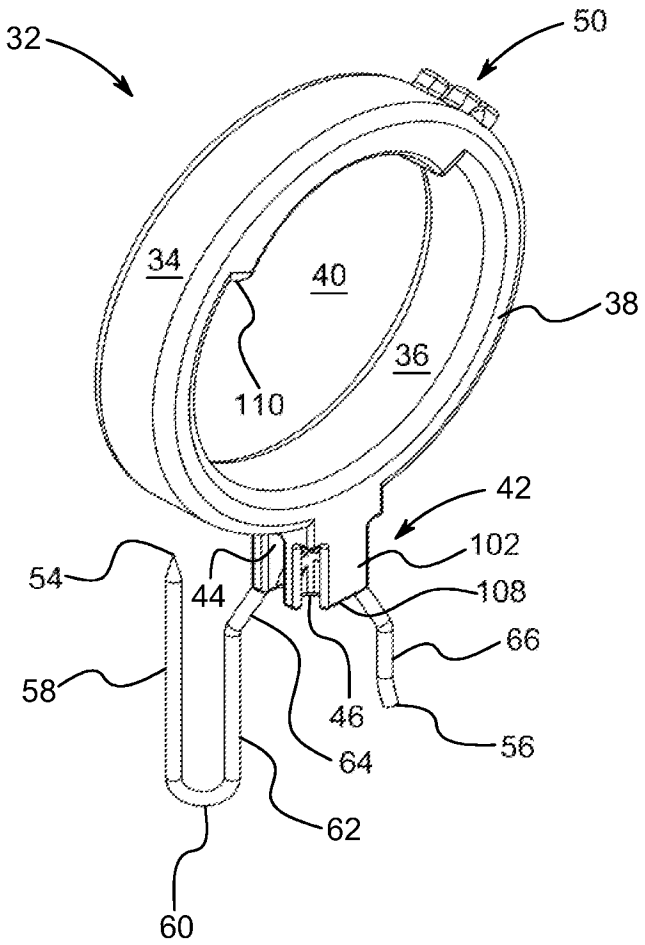
FIG. 3 shows an upper front side perspective view of a ring and drapery pin for a pinch pleat and ripplefold drapery system, in accordance with one or more embodiments; the view showing the drapery pin in a right channel of an attachment member of the ring.
Figure 4:
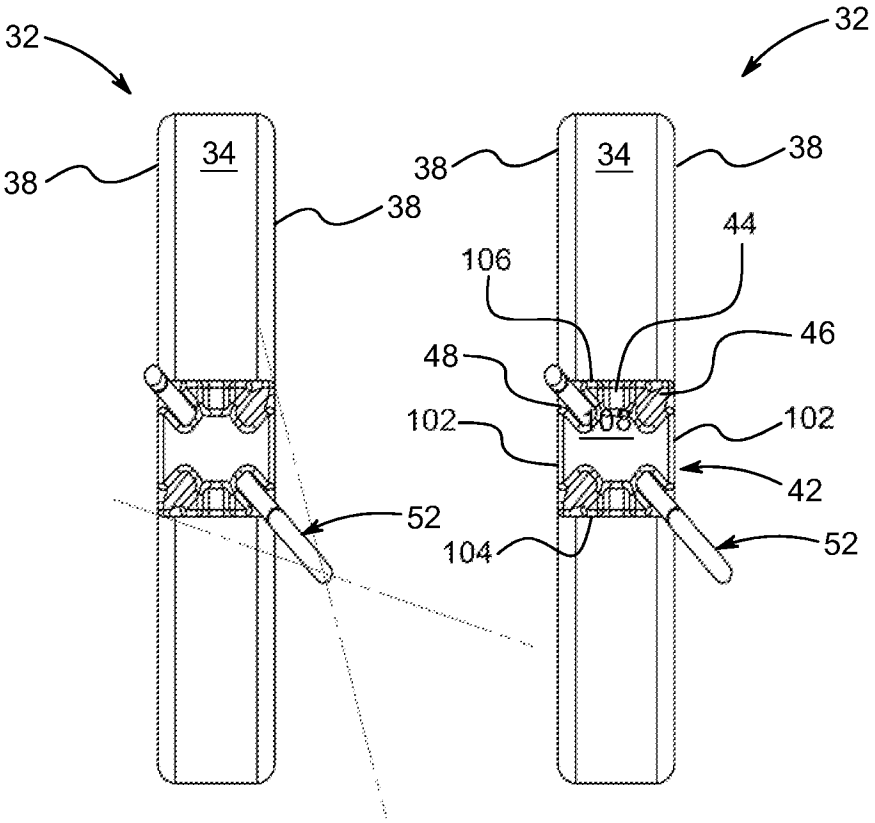
FIG. 4 shows a bottom view of a pair of rings and drapery pins for a pinch pleat and ripplefold drapery system, in accordance with one or more embodiments; the view showing the drapery pins in a right channel of an attachment member of the ring.
Figure 5:
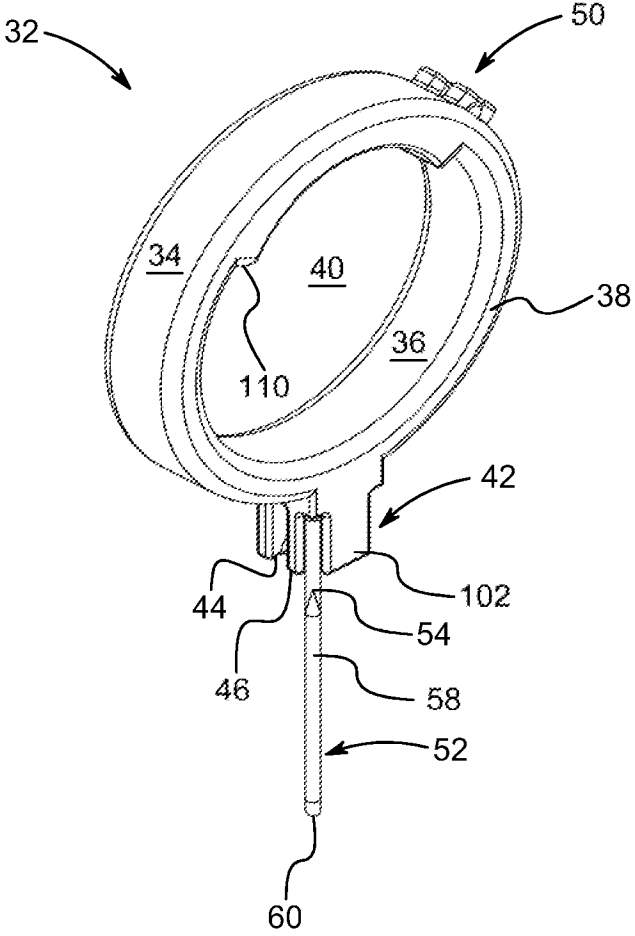
FIG. 5 shows an upper front side perspective view of a ring and drapery pin for a pinch pleat and ripplefold drapery system, in accordance with one or more embodiments; the view showing the drapery pin in a left channel of an attachment member of the ring.
Figure 6:
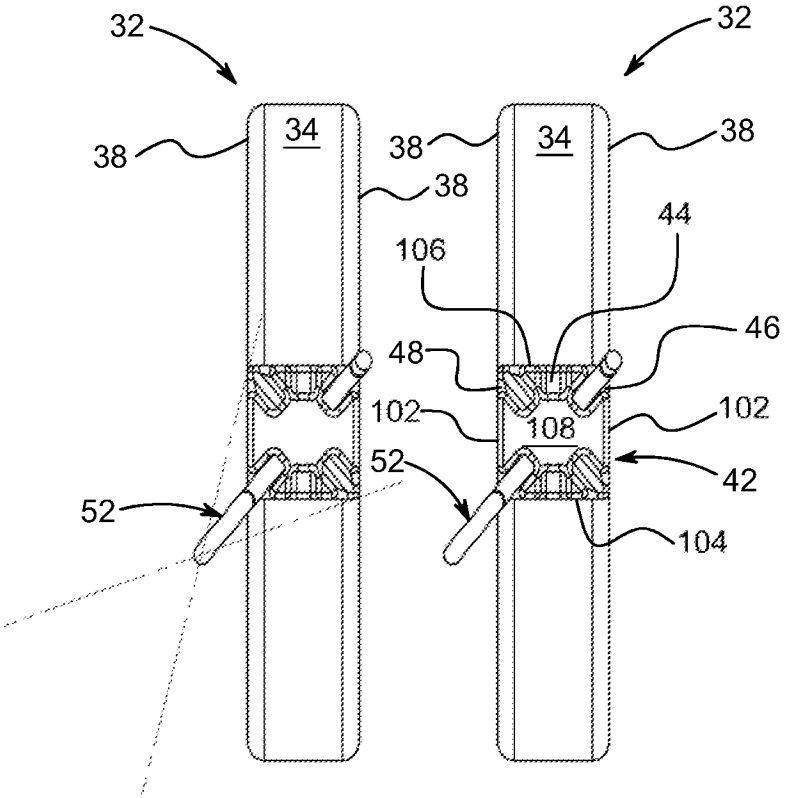
FIG. 6 shows a bottom view of a pair of rings and drapery pins v, in accordance with one or more embodiments; the view showing the drapery pins in a left channel of an attachment member of the ring.
Figure 7:
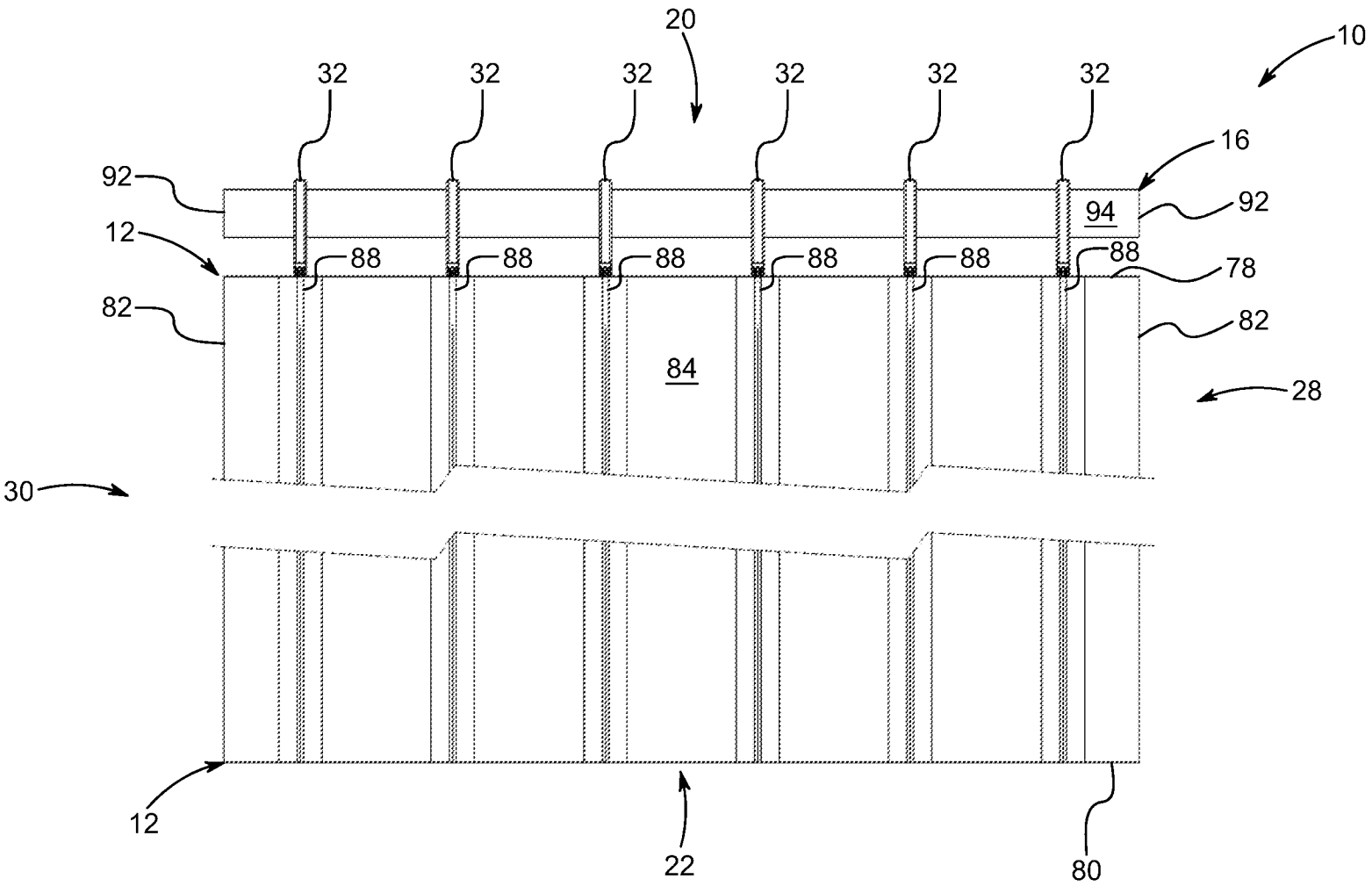
FIG. 7 shows a front view of a pinch pleat and ripplefold drapery system, in accordance with one or more embodiments; the view showing pinch pleat drapery and rings installed on a drapery rod.
Figure 8:
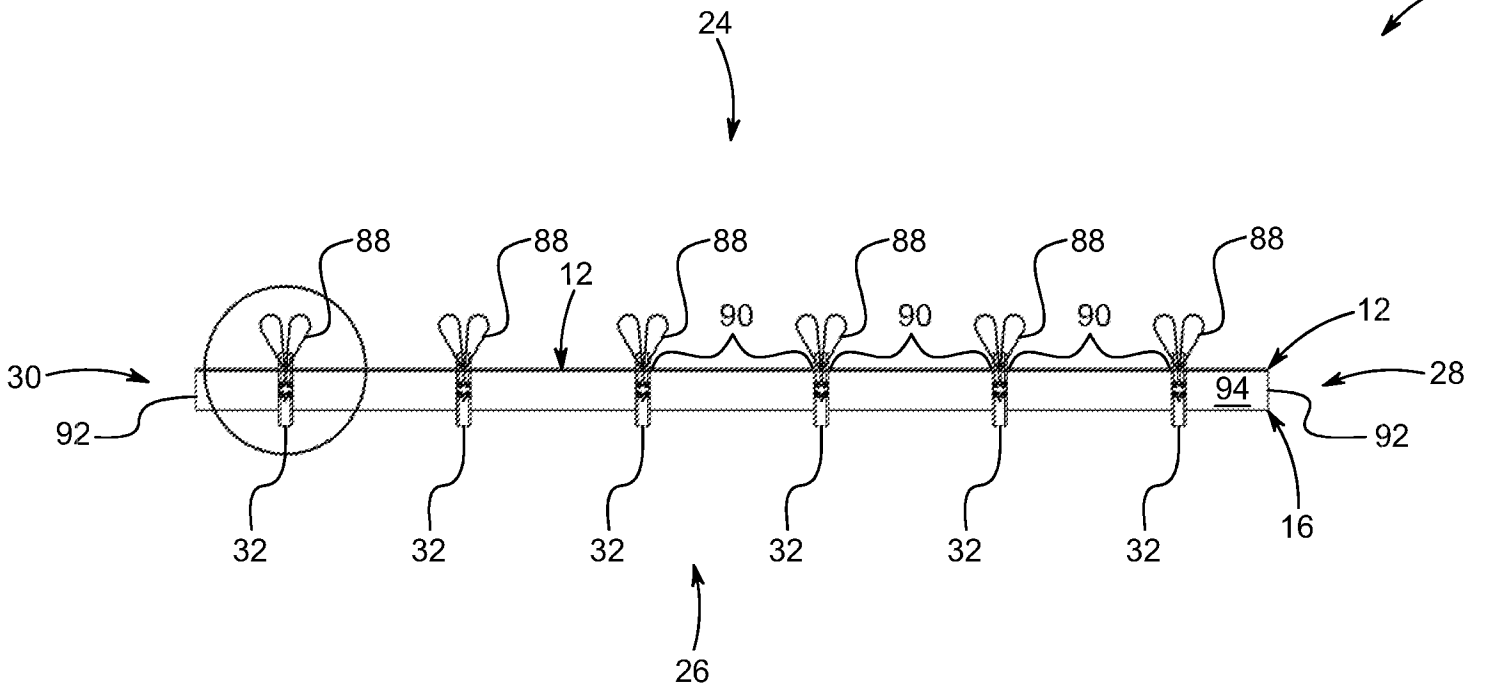
FIG. 8 shows a top view of a pinch pleat and ripplefold drapery system, in accordance with one or more embodiments; the view showing pinch pleat drapery and rings installed on a drapery rod.
Figure 9:
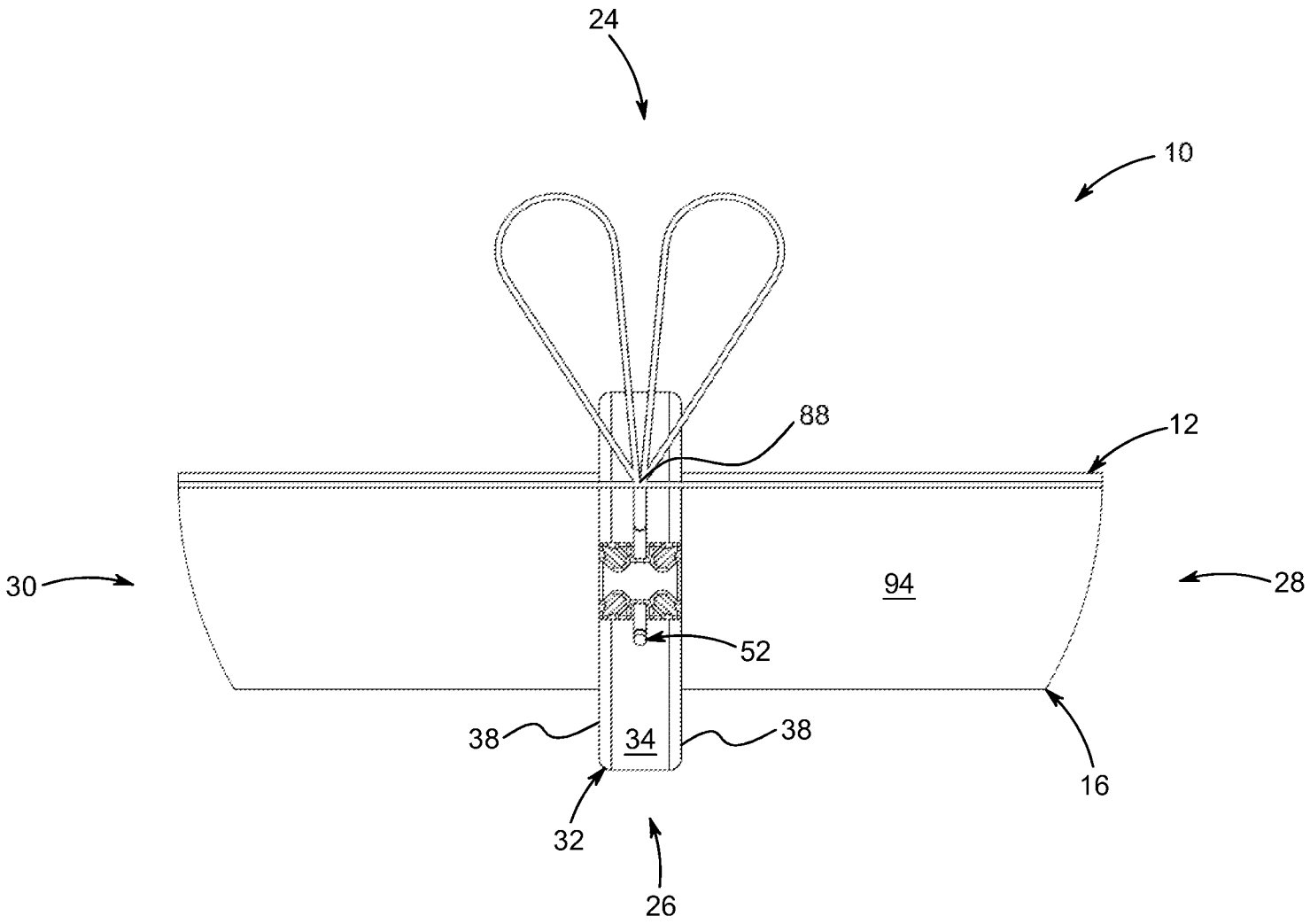
FIG. 9 shows a close up bottom view of a pinch pleat and ripplefold drapery system, in accordance with one or more embodiments; the view showing pinch pleat drapery and rings installed on a drapery rod.
Figure 10:
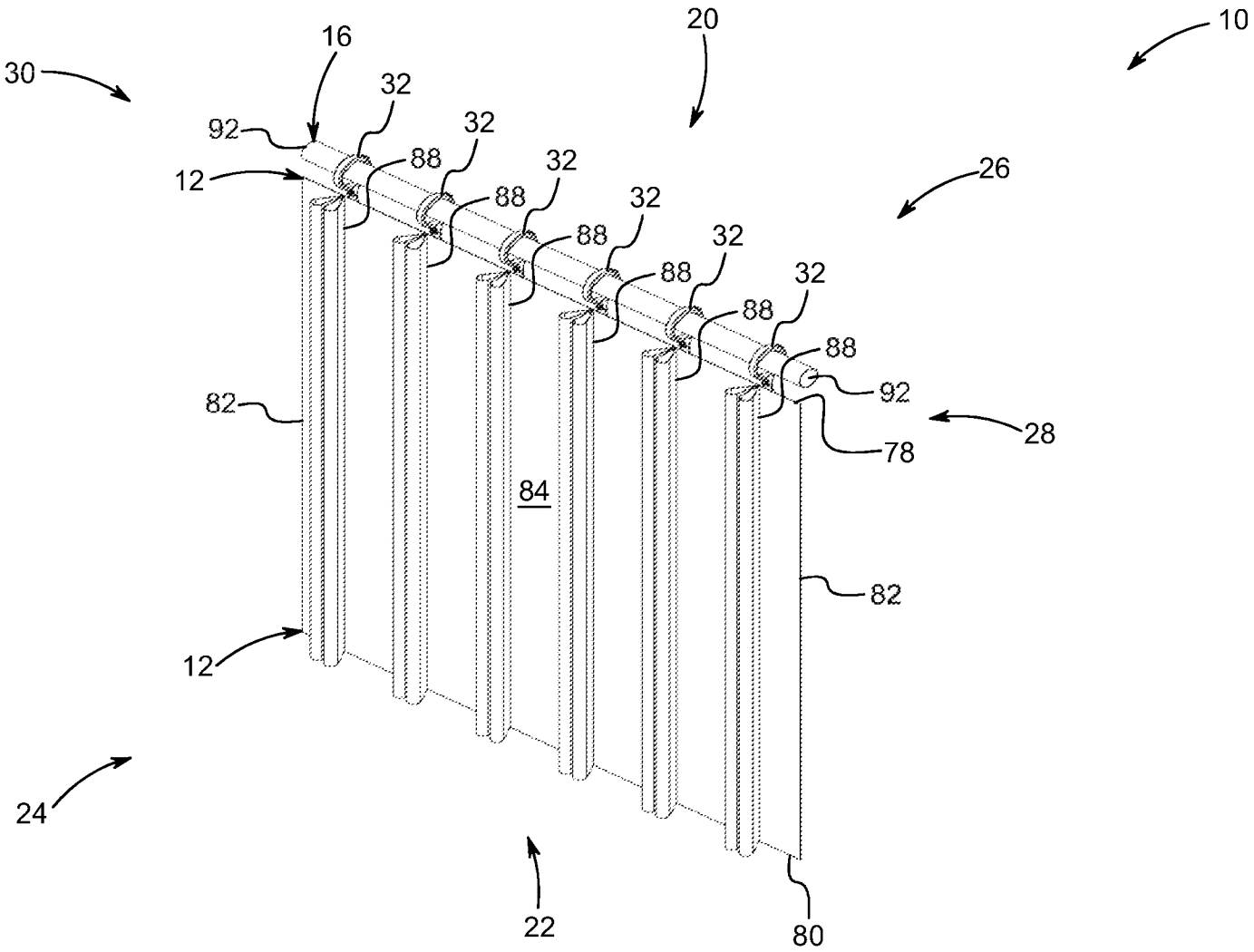
FIG. 10 shows a front right perspective view of a pinch pleat and ripplefold drapery system, in accordance with one or more embodiments; the view showing pinch pleat drapery and rings installed on a drapery rod.
Figure 11:
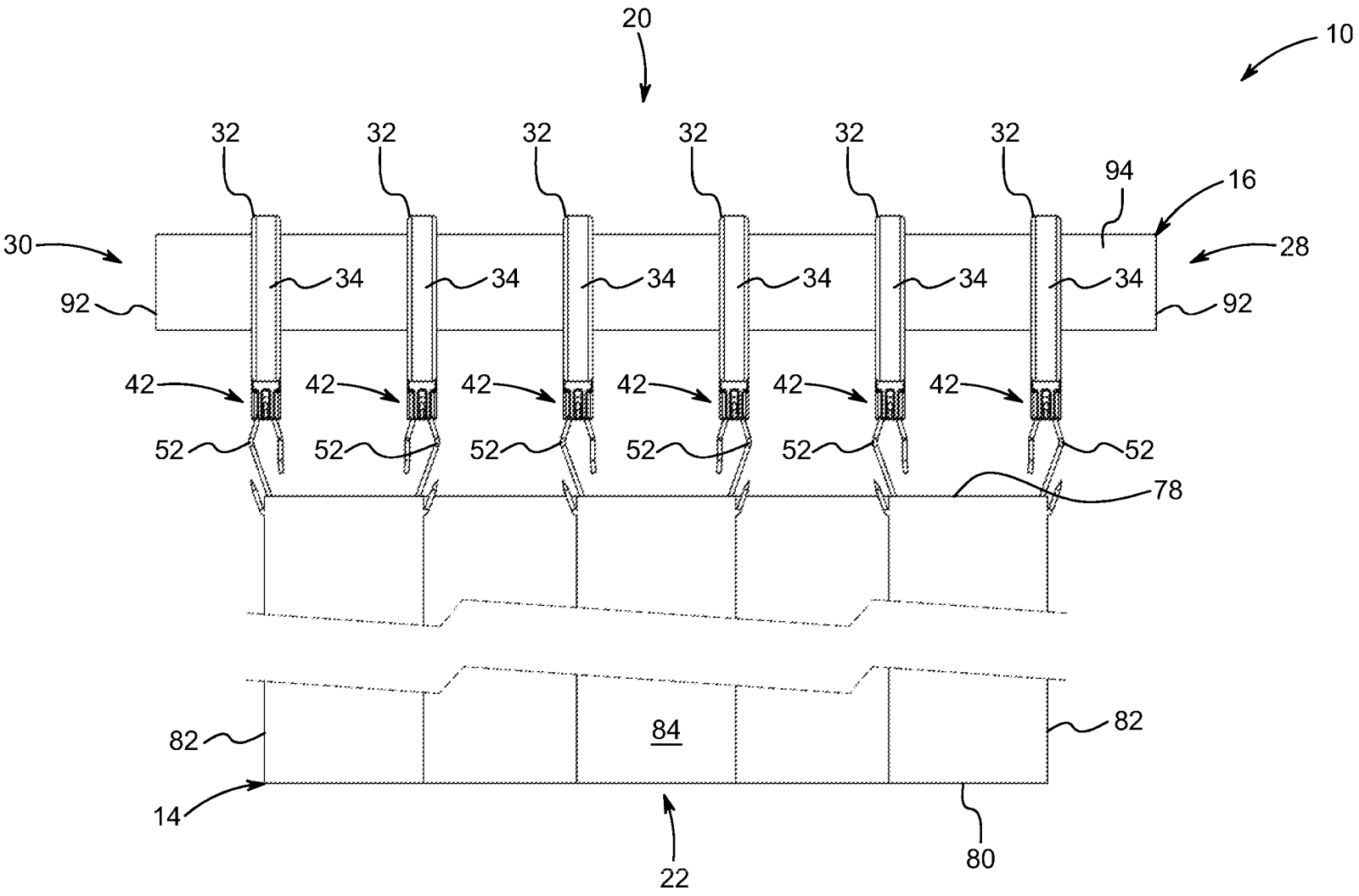
FIG. 11 shows a close up front view of a pinch pleat and ripplefold drapery system, in accordance with one or more embodiments; the view showing rings on drapery rod alternating between having drapery pins in the left channel and drapery pins in the right channel.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "either A or B". As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of drapery. However, the embodiments are not so limited. It is appreciated that the embodiments may be adapted for use in other applications which may be improved by the disclosed structures, arrangements and/or methods. The system is merely shown and described as being used in in the context of drapery for ease of description and as one of countless examples.

System:

With reference to the figures, a pinch pleat and ripplefold drapery system 10 (or simply system 10) is presented. System 10 is formed of any suitable size, shape and design and is configured to facilitate the attachment of and opening and closing of drapery shade material that may be either a pinch pleat drapery 12 or a ripplefold drapery 14 to a drapery rod 16 or a drapery track 18 while providing an appealing aesthetic appearance as well as smooth, quiet and effective operation.

In the arrangement shown, as one example, the pinch pleat and ripplefold drapery system 10 has a top side 20, a bottom side 22, a front side 24, a back side 26, a left side 28 and a right side 30. In the arrangement shown, as one example, the pinch pleat and ripplefold drapery system 10 includes the following components, among others: rings 32 having an exterior surface 34, interior surface 36, sides 38, hollow interior 40, an attachment member 42 having center channel 44, a left channel 46 and a right channel 48, and a connection member 50; a drapery pin 52 having a forward end 54, a rearward end 56, a first vertical section 58, a lower corner 60, a second vertical section 62, an upper corner 64, and a third vertical section 66; a lead 68 having a plurality of features 70; and a carrier 74 having wheels 76, among other components, pieces and features.

Pinch Pleat Drapery 12 and Ripplefold Drapery 14:

In one arrangement, pinch pleat and ripplefold drapery system 10 is configured to be used in association with a pinch pleat drapery 12 as well as with a ripplefold drapery 14. Pinch pleat drapery 12 and ripplefold drapery 14 have many similarities. However pinch pleat drapery 12 and ripplefold drapery 14 have many substantial differences. These differences affect the manner in which the drapery is installed. These differences require different accommodations during installation. Presently there are no commercially available drapery rods or tracks that allow for simple, easy and aesthetically pleasing installation of both a pinch pleat drapery 12 as well as a ripplefold drapery 14.

Pinch Pleat Drapery 12: Pinch pleat drapery 12 is a form or configuration of a drapery panel. In the arrangement shown, as one example, pinch pleat drapery 12 is formed of a panel of drapery fabric that extends vertically between an upper end 78 and a lower end 80, and extends horizontally between opposing sides 82, and includes a front surface 84 and a rear surface 86.

In the arrangement shown, as one example, this panel of drapery fabric begins as a generally flat and planar piece of fabric or material. This fabric is then gathered and pinched together at its upper end 78 in a plurality of pleats 88 that are generally equally spaced across the side 82 to side 82 length of pinch pleat drapery 12. These pleats 88 provide pinch pleat drapery 12 with a controlled aesthetic appearance of fullness and consistency when the pinch pleat drapery 12 is fully opened as well as when pinch pleat drapery 12 is fully closed.

Another benefit of pinch pleat drapery 12 is that the side 82 to side 82 length of pinch pleat drapery 12 is limited or self-limiting by the configuration of the pinch pleat drapery 12. That is, when the pinch pleat drapery 12 is fully opened, the material of the pinch pleat drapery 12 is generally fully extended with flat panels 90 positioned between adjacent pleats 88. Or, said another way, when pinch pleat drapery 12 is fully opened, panels 90 are flat and fully extended with billowing pleats 88 positioned between each panel 90.

In this fully opened or fully extended position, pinch pleat drapery 12 has a desired fullness due to the material gathered by pleats 88. When pleats 88 are only gathered or stitched adjacent the upper end 78 of pinch pleat drapery 12, the material tends fan-out or extend outward as it extends downward. The self-limiting nature of pinch pleat drapery 12 eliminates the need for a length-limiting component, such as a lead 68, as is often used with ripplefold drapery 14.

Due to the configuration of pinch pleat drapery 12, a drapery pin 52 may be installed at each pleat 88. Due to the configuration of pinch pleat drapery 12, it is desirable to have pinch pleat drapery 12 extend in a generally flat manner when it is fully opened with adjacent panels 90 essentially connecting in end-to-end alignment with pleats 88 positioned between adjacent panels 90. To facilitate this configuration, whether a drapery rod 16 or a drapery track 18 is used, drapery pins 52 are installed in a generally perpendicular alignment to the side 82 to side 82 length of pinch pleat drapery 12, as is further described herein.

Ripplefold Drapery 14: Ripplefold drapery 14 is a form or configuration of a drapery panel. In the arrangement shown, as one example, ripplefold drapery 14 is formed of a panel of drapery fabric that extends vertically between an upper end 78 and a lower end 80, and extends horizontally between opposing sides 82, and includes a front surface 84 and a rear surface 86.

In the arrangement shown, as one example, this panel of drapery fabric begins as a generally flat and planar piece of fabric or material. This fabric is then installed on drapery rod 16 or drapery track 18 in a manner that causes the material of ripplefold drapery 14 to form a series of ripples or curves that provide the desired fullness and aesthetic appearance. That is, ripplefold drapery 14 forms a continuous S-shaped curved shape, or, said another way, a sinusoidal curved member formed by a plurality of ripples connected in end-to-end fashion when viewed from above or below.

Ripplefold drapery 14 is different from pinch pleat drapery 12 in that ripplefold drapery 14 is not self-limiting. Or, said another way, ripplefold drapery 14 is not-fully extended when it is fully opened. Instead, the fullness, and the desired aesthetic appearance of ripplefold drapery 14 is formed by limiting the distance between connection points to drapery rod 16 or drapery track 18, such as through the use of a lead 68. The greater the amount of extra material between adjacent connection points, the greater the fullness of the ripples. The opposite is true as well. The lesser the amount of extra material between adjacent connection points, the lesser the fullness of the ripples.

Due to the configuration of ripplefold drapery 14, drapery pins 52 are installed at spaced intervals along the side 82 to side 82 length of ripplefold drapery 14. Due to the configuration of ripplefold drapery 14, or more specifically the fact that ripplefold drapery 14 does not have any features in it (like pleats 88) the manner in which drapery pins 52 connects to the material of ripplefold drapery 14 affects the shape the material of ripplefold drapery 14 takes. It is desirable to have ripplefold drapery 14 extend in a curved or sinusoidal manner along its side 82 to side 82 length when it is fully opened. To facilitate this configuration, whether a drapery rod 16 or a drapery track 18 is used, drapery pins 52 are installed in a pattern where adjacent drapery pins 52 point in opposite directions, as is further described herein, so as to help induce the desired shape or curvature of the material of ripplefold drapery 14.

Drapery Rod 16:

With reference to FIGS. 1-14 a first embodiment is presented. With reference to FIGS. 1-14, in one arrangement, pinch pleat and ripplefold drapery system 10 is configured to be used in association with a drapery rod 16. Drapery rod 16 is formed of any suitable size, shape and design and is configured to support the upper end 78 of pinch pleat drapery 12 and/or ripplefold drapery 14 while allowing the drapery 12, 14 to be moved between an opened position and a closed position.

Drapery rod 16 may be a manual drapery rod 16, in that opening and closing of the drapery 12, 14 is manually performed by a person either moving or pulling the material of drapery 12, 14 or an attached opening or closing mechanism such as a wand or pull cord, beaded cord or chain or the like. Additionally or alternatively, drapery rod 16 may be a motorized drapery rod 16, in that opening and closing of the drapery 12, 14 is performed by operation of a motor, such as that presented in U.S. Pat. No. 9,095,908 entitled ROTATABLE DRIVE ELEMENT FOR MOVING A WINDOW COVERING, published as U.S. Pat. Pub. No. 2014/0076503; U.S. Pat. No. 9,999,313 entitled ROTATABLE DRIVE ELEMENT FOR MOVING A WINDOW COVERING, published as U.S. Pat. Pub. No. 2016/0143470; U.S. Pat. No. 10,285,527 entitled MOTORIZED DRAPERY APPARATUS WITH BATTERIES POSITIONED IN THE BRACKETS, published as 2017/0000280, and all related patents and applications, all of which are commonly owned by Applicant, all of which are hereby fully incorporated by reference herein, as well as other configurations of motorized drapery rods 16 made by other manufacturers such as, by way of example, the motorized "Cordoba" and "Granada" drapery rods offered by Forest Drapery Hardware, of 2500 Donn Drive, Cartersville GA 30120, among countless others, which are all incorporated by reference.

In the arrangement shown, as one example, drapery rod 16 is a generally elongated member that extends a length between opposing ends 92 and has a generally cylindrical exterior surface 94. However, any other size, shape and design is hereby contemplated such as square, rectangular, oval, or any other shape, as well as decorative shapes therein such as rope-shaped, ridged, grooved, or any other shape or configuration.

In one arrangement, drapery rod 16 is connected to brackets positioned at or near the outward ends 92 of drapery rod 16, and/or at the approximate middle of drapery rod 16, that connect drapery rod 16 to the structure that supports drapery rod 16 such as the wall of a building or house.

In the arrangement shown, as one example, a plurality of rings 32 are positioned around drapery rod 16.

Rings 32:

In one or more arrangements, pinch pleat and ripplefold drapery system 10 is configured to be used in association with a drapery rod 16 having a plurality of rings 32 positioned around drapery rod 16. Rings 32 are formed of any suitable size, shape and design and is configured to be positioned around drapery rod 16 as well as facilitating a connection to the upper end 78 of pinch pleat drapery 12 and/or ripplefold drapery 14 while allowing the drapery 12, 14 to be moved between an opened position and a closed position.

In the arrangement shown, as one example, rings 32 have an exterior surface 34, an interior surface 36 and sides 38. In the arrangement shown, as one example, exterior surface 34 of rings 32 is generally cylindrical in shape with a generally flat and smooth convex curved surface, however any other size, shape and configuration is hereby contemplated for use.

In the arrangement shown, as one example, interior surface 36 of rings 32 is generally cylindrical in shape with a generally flat and smooth concave curved surface, however any other size, shape and configuration is hereby contemplated for use. In the arrangement shown, as one example, the inner diameter of the curved interior surface 36 of rings 32 is larger than the outer diameter of the exterior surface 94 of drapery rod 16 so as to allow rings 32 to easily slide over the exterior surface 94 of drapery rod 16 without binding and with minimal contact and friction. However, any other shape or configuration is hereby contemplated for use.

In one or more arrangements, interior surface 36 is formed of a non-metallic material so as to provide quiet operation as rings 32 move along the length of drapery rod 16. This is particularly important when drapery rod 16 is formed of a metallic material as metal-on-metal contact can be particularly loud and undesirable. In one or more arrangements, this non-metallic material is partially compressible and shock-absorbing, or more compressible or more shock-absorbing than the metallic material that forms drapery rod 16, which has the effect of reducing noise and vibration and providing smoother operation. In one or arrangements, this non-metallic material has a low coefficient of friction so as to allow smooth operation and smooth sliding along the length of drapery rod 16 with minimal or limited resistance and friction. In one or more arrangements, this non-metallic material is self-lubricating so as to maintain a low coefficient of friction so as to allow smooth operation and smooth sliding along the length of drapery rod 16 with minimal or limited resistance and friction.

In the arrangement shown, as one example, sides 38 of rings 32 are generally flat and connect at their outward end to exterior surface 34 and connect at their inward end to interior surface 36. In the arrangement shown, as one example, opposing sides 38 extend in approximate parallel spaced relation to one another. In this way, the generally flat sides 38, coupled with the generally cylindrically shaped exterior surface 34 with a generally parallel spaced interior surface 36, forms a narrow generally cylindrically shaped member that forms ring 32. In the arrangement show, as one example, the outward ends and interior ends of sides 38 connect to the outward edges of exterior surface 34 and outward edges of interior surface 36 in curved or chamfered corners so as to provide a smooth transition there between. However, any other size, shape and configuration is hereby contemplated for use. In the arrangement shown, as one example, the combination of exterior surface 34, interior surface 36 and sides 38 of rings 32 form a hollow interior 40.

In the arrangement shown, as one example, rings 32 have a hollow interior 40 that is configured to receive drapery rod 16 therein. In the arrangement shown, when viewed from a side of rings 32, hollow interior 40 is generally cylindrically shaped and defined by the interior surface 36. In the arrangement shown, as one example, the hollow interior 40 is oversized as compared to the exterior size and shape of drapery rod 16 so as to allow rings 32 to easily slide over the exterior surface 94 of drapery rod 16 without binding and with minimal contact and friction. However, any other shape or configuration is hereby contemplated for use.

In the arrangement shown, as one example, rings 32 include a connection member 50.

Connection Member 50 & Lead 68:

In one or more arrangements, rings 32 include a connection member 50 that is configured to connect to and hold onto lead 68.

Connection Member 50: Connection member 50 is formed of any suitable size, shape and design and is configured facilitate the connection of adjacent rings 32 by way of a lead 68 so as to set the maximum spacing between adjacent rings 32 so as to set the fullness of pinch pleat drapery 12 and/or a ripplefold drapery 14 connected to rings 32. However, as mentioned herein, when a pinch pleat drapery 12 is used, setting the maximum spacing between adjacent rings 32 using a lead 68 may not be necessary as the pinch pleat drapery 12 is self-limiting with panels 90 and pleats 88, however in some applications it may still be desirable to set the maximum spacing between rings 32 using connection members 50 and a lead 68.

In the arrangement shown, as one example, connection member 50 is formed of a snap-fit feature that is sized and shaped to frictionally receive and hold-on to lead 68, which in the arrangement shown is a string or cord with a plurality of spaced features 70. In the arrangement shown features 70, as one example, are spherical beads that are positioned along the length of lead 68. In the arrangement shown, as one example, connection member 50 is formed of a pair of arms 96 that extend in approximate parallel spaced relation to one another. In the arrangement shown, as one example, the length of arms 96 extend in generally parallel spaced relation to the sides 38 of ring 32. In the arrangement shown, as one example, the space between adjacent arms 96 is sized and shaped to receive a feature 70 therein with frictional and locking engagement. In the arrangement shown, as one example, to further facilitate this frictional and locking engagement, recess 98 that is generally spherical shaped, is partially present in the exterior surface 34 of ring 32 and/or in the interior-facing sides of arms 96. This recess 98 is configured to receive and hold a portion of feature 70 therein, and/or to provide clearance for feature 70 while it is held by arms 96.

In the arrangement shown, as one example, recess 98 may also be present in the exterior surface 34 of ring 32 just outside of the exterior facing surface of arms 96. In the arrangement shown, as one example, this recess 98 also extends upward into the exterior facing surface of arms 96.

In one arrangement, the combination of arms 96 and recess 98 allow for the forceful insertion of a feature 70 therein, as well as the forceful removal of feature 70 from between arms 96. In this configuration, feature 70 is retained between arms 96 and within recess 98 when no removal force is applied, such as during normal operation.

Feature 70 may be frictionally held by the interior facing surfaces of arms 96 between opposing arms 96. In this arrangement, feature 70 is pinched between opposing arms 96 of connection member 50.

Additionally or alternatively, features 70 may be frictionally held by the exterior facing surfaces of arms 96 by stretching lead 68 between opposing outwardly facing surfaces of opposing arms 96. In this arrangement, two features are held under tension by opposing outwardly facing surfaces of opposing arms 96.

Additionally or alternatively, a feature 70 may be frictionally held by the interior facing surfaces of opposing arms 96 between opposing arms 96 as well as the exterior-positioned features 70 being frictionally held by the exterior facing surfaces of arms 96 by stretching lead 68. This configuration pinches the centrally positioned feature 70, while holding a feature 70 on either side of the centrally positioned feature 70 under tension. This configuration utilizing both pinching as well as stretching may provide greater strength of hold. Any other manner, method or means or configuration of connecting to a feature 70 or features 70 is hereby contemplated for use.

In the arrangement shown, as one example, a slot 100 is positioned in the approximate middle of arms 96. Slot 100 is sized and shaped to allow for the string or cord of lead 68 to pass there through when arms 96 receive and hold one or more features 70.

One of the benefits of using a lead 68 having features 70 attached thereto is that the features 70 may be positioned at known spaced intervals so as to facilitate simple, easy and accurate spacing between adjacent rings 32 without conventional measuring. This is accomplished by counting an equal number of features 70 between adjacent rings 32. Additionally or alternatively, this measuring may be accomplished by marking or color-coding features 70 for predetermined intervals or spacing.

It is hereby contemplated that connection member 50 may be formed of any other suitable, size, shape, design, or configuration and that facilitates the attachment of a lead 68 of any kind, whether beaded or not.

In the arrangement shown, as one example, connection member 50 is positioned in the upper rearward quadrant of the ring 32 so as to minimize the ability for a user to see the lead 68 or connection member 50. In the arrangement shown, as one example, the connection member 50 is positioned at approximately the 10:30 position on the exterior surface 34 of ring 32, at the upper rearward side of ring 32.

Placing connection member 50 at the upper rearward side of rings 32 has the effect of hiding lead 68 and connection member 50 as most drapery systems 10 are installed high on a wall above a window and as such most of the time these drapery systems 10 are viewed from the forward lower side. From this forward lower perspective the connection member 50 is hidden behind the ring 32 and the drapery rod 16 has a tendency to hide the lead 68, even when the lead 68 sags between adjacent rings 32 when the rings 32 are slid adjacent one another when drapery 12, 14 is in an open position. However, any other position is hereby contemplated for use.

In the arrangement shown, as one example, rings 32 include an attachment member 42.

Attachment Member 42:

In one arrangement, rings 32 include an attachment member 42. Attachment member 42 is formed of any suitable size, shape and design and is configured facilitate the connection of a drapery pin 52 to ring 32 in multiple selectable defined angular orientations so as to facilitate the attachment of both a pinch pleat drapery 12 to ring 32 as well as a ripplefold drapery 14 to ring 32.

In the arrangement shown, as one example, attachment member 42 is a generally square or rectangular protrusion that extends outward from the exterior surface 34 of ring 32 at the lower or bottom side of ring 32. In the arrangement shown, as one example, the sides 102 of attachment member 42 extend in generally flat and flush and planar manner with the sides 38 of ring 32. As such, the opposing sides 102 of attachment member 42 extend in approximate parallel planar spaced relation to one another. In this way, attachment member 42 is approximately the same width as rings 32. In this way, with the planar alignment of the sides 102 of attachment member 42 with the sides 38 of ring 32, attachment member 42 is aligned with the ring 32 it is attached to.

In the arrangement shown, as one example, attachment member 42 is formed as a single continuous member with all or a portion of ring 32, such as through a molding, injection molding, machining, casting, printing, or other forming process. In an alternative arrangement, attachment member 42 is formed as a separate component that is assembled with other components to form ring 32 through a secondary assembly step such as gluing, adhering, welding, snap-fitting, screwing, bolting, fastening or the like or any combination of these processes.

In the arrangement shown, as one example, the forward side 104 and rearward side 106 of attachment member 42 define generally planar surfaces that extend in approximate parallel planar spaced relation to one another. In the arrangement shown, as one example, forward side 104 and rearward side 106 of attachment member 42 extend in approximate perpendicular planar alignment to the sides 102 of attachment member 42.

In the arrangement shown, as one example, the lower side 108 of attachment member 42 defines a generally planar surface that extends in approximate perpendicular planar relation to the forward side 104, and rearward side 106 of attachment member 42. In the arrangement shown, as one example, the lower side 108 of attachment member 42 defines a generally planar surface that extends in approximate perpendicular planar relation to the opposing sides 102 of attachment member 42.

In this way, the combination and arrangement of the forward side 104, rearward side 106 adjacent sides 102 and lower side 108 of attachment member 42 form a generally square or rectangular member that connects at its upper end to the lower end of exterior surface 34 of ring 32 and extends downward a distance therefrom. However, any other size, shape and configuration is hereby contemplated for use as attachment member 42.

Channels 44, 46, 48: In the arrangement shown, as one example, attachment member 42 includes one or more channels that are configured to receive, hold and align a drapery pin 52 therein. In the arrangement shown, as one example, attachment member 42 includes a center channel 44, a left channel 46 and a right channel 48. However, any other number of channels is hereby contemplated for use such as one, two, three, four, five, six, seven, eight, nine, ten or more.

Center Channel 44: In the arrangement shown, as one example, attachment member 42 includes a center channel 44. Center channel 44 is an opening in attachment member 42 that is formed of any suitable size, shape and design and is configured to receive and align a drapery pin 52 with the forward-to-back center of ring 32. Or, said another way, center channel 44 is configured to receive a drapery pin 52 therein and align drapery pin 52 such that the drapery pin 52 is in approximate parallel spaced alignment with the opposing sides 38, 102 of ring 32 and is approximately centrally positioned between opposing sides 38, 102. In the arrangement shown, as one example, this center channel 44 is configured to receive a drapery pin 52 therein when a pinch pleat drapery 12 is to be installed onto ring 32.

In one arrangement, center channel 44 is configured to be used with a pinch pleat drapery 12. In this arrangement, center channel 44 is configured to align drapery pin 52 in approximate parallel spaced alignment with the opposing sides 38, 102 of ring 32 so that drapery pin 52 engages pinch pleat drapery 12 in a generally perpendicular manner to the flat plane formed by pinch pleat drapery 12. In one arrangement, center channel 44 holds drapery pin 52 in a rigid and precise alignment that is parallel with the forward-to-back center of ring 32.

However, in most cases, pinch pleat drapery 12 does not require precise alignment. Or, said another way, due to the configuration of pinch pleat drapery 12 with an iterative pattern of pleats 88 separated by panels 90, pinch pleat drapery 12 is self-limiting by panels 90 and pleats 88, and the fullness of pinch pleat drapery 12 is not necessarily affected by the manner in which drapery pin 52 engages the pinch pleat drapery 12. As such, in the arrangement shown, as one example, center channel 44 is slightly oversized and allows for the relative angular rotation of drapery pin 52 within center channel 44. In one or more arrangements, while drapery pin 52 is generally held within center channel 44 in a generally parallel alignment to the forward-to-back center of ring 32, center channel 44 may allow drapery pin to angularly rotate 62° (which is +31° or −31°). In one or more arrangements, while drapery pin 52 is generally held within center channel 44 in a generally parallel alignment to the forward-to-back center of ring 32, center channel 44 may allow drapery pin to angularly rotate 90° (which is +45° or −45°). Any other amount of angular freedom is hereby contemplated for use.

In one or more arrangements, holding drapery pin 52 in a generally parallel alignment with the forward-to-back center of ring 32 while allowing for relative angular rotation of drapery pin 52 facilitates smoother operation of system 10 as drapery pin 52 is allowed to shift or rotate as forces are applied on drapery pin 52 as pinch pleat drapery 12 is opened or closed. This angular rotation of drapery pin 52 does not substantially negatively affect the aesthetic appearance of pinch pleat drapery 12, as the pleats 88 in pinch pleat drapery 12 are pre-formed and substantially define the appearance of the pinch pleat drapery 12. Or, said another way, the benefits of allowing drapery pin 52 to angularly rotate, or to have angular freedom, within center channel 44 outweigh the negative effects on the aesthetic appearance of pinch pleat drapery 12 in an open or closed or intermediate position. However, this is not the case with ripplefold drapery 14.

In the arrangement shown, as one example, when a pinch pleat drapery 12 is installed on drapery rod 16 using a plurality of rings 32, a drapery pin 52 is placed in the center channel 44 of each attachment member 42 of each ring 32. Pinch pleat drapery 12 is then installed onto the drapery pin 52 of each ring 32 by inserting the forward end 54 of drapery pin 52 through the material of pinch pleat drapery 12 such that the forward-to-back length of drapery pin 52 extends through the plane of the material of pinch pleat drapery 12 in a generally perpendicular manner. In the arrangement shown, as one example, a drapery pin 52 is inserted through pinch pleat drapery 12 at the upper end 78 of the pinch pleat drapery 12 at the location of each pleat 88.

Left Channel 46 & Right Channel 48: In the arrangement shown, as one example, attachment member 42 includes a left channel 46 and a right channel 48. Like center channel 44, left channel 46 and right channel 48 are openings in attachment member 42 that are formed of any suitable size, shape and design and are configured to receive and align a drapery pin 52 therein. Unlike center channel 44, left channel 46 and right channel 48 are openings that extend at an approximate 45° angle with the forward-to-back center of ring 32. Or, said another way, left channel 46 and right channel 48 are configured to receive a drapery pin 52 therein and align drapery pin 52 such that the drapery pin 52 is in approximately positioned at a 45° angle with respect to the opposing sides 38, 102 of ring 32 and the centerline of ring 32. Similarly, left channel 46 and right channel 48 are configured to receive a drapery pin 52 therein and align drapery pin 52 such that the drapery pin 52 is approximately positioned at a 45° angle with respect to the opposing forward side 104 and rearward side 106 of attachment member 42. In the arrangement shown, as one example, left channel 46 and right channel 48 are configured to receive a drapery pin 52 therein when a ripplefold drapery 14 is to be installed onto ring 32. Notably, while a 45° angle is shown for left channel 46 and right channel 48, any other angular orientation is hereby contemplated for use for left channel 46 and right channel 48, anywhere between 0° (straight forward) to 180° (straight rearward), including 30°, 45°, 60°, 75°, 90°, 105°, 120°, 135°, 150°, 175°, and any other angle in-between these angles or any range of angles within or between these angles.

In one or more arrangements, left channel 46 and right channel 48 are configured to be used with a ripplefold drapery 14. In the arrangement shown, as one example, the attachment member 42 of each ring 32 is used to align a drapery pin 52 in an oppositely pointing angular relation to the immediately adjacent rings 32. That is, each ring 32 has an adjacent ring 32 on either side that has a drapery pin 52 pointing in an opposite direction. In this way, when a plurality of rings 32 are positioned around drapery rod 16 the rings 32 form a pattern where a drapery ring 32 having left-pointing drapery pin 52 positioned in left channel 46 of attachment member 42 is positioned next to a drapery ring 32 having right-pointing drapery pin 52 positioned in right channel 48 of attachment member 42 is positioned next to a drapery ring 32 having left-pointing drapery pin 52 positioned in left channel 46 of attachment member 42 is positioned next to a drapery ring 32 having right-pointing drapery pin 52 positioned in right channel 48 of attachment member 42, and so on.

In one or more arrangements, drapery rings 32 are configured to have symmetry between the left channel 46 and right channel 48. That is, whatever the angle of orientation of drapery pin 52 positioned in one of left channel 46 or right channel 48, the angle is similar if not identical, but opposite, for the other of left channel 46 or right channel 48. That is, as one example, when left channel 46 angles 45° to the left of the centerline of ring 32 right channel 48 angles 45° to the right of the centerline of ring 32. As another example, when left channel 46 angles 90° to the left of the centerline of ring 32 right channel 48 angles 90° to the right of the centerline of ring 32. Alternatively, different angular orientations for left channel 46 and right channel 48 are hereby contemplated for use such that left channel 46 and right channel 48 are not symmetric to the centerline of ring 32.

In one or more arrangements, left channel 46 and right channel 48 hold a drapery pin 52 therein in a rigid and precise alignment that leaves little room for angular variation. Said another way, drapery pin 52 is received within left channel 46 or right channel 48 with close and tight and precise tolerances so as to accurately angle drapery pin 52 in the desired direction. This is different than when a drapery pin 52 is placed in center channel 44. Left channel 46 and right channel 48 differ from center channel 44 in this way because center channel 44 is used to attach pinch pleat drapery 12, which does not require precise angular alignment for an aesthetically pleasing appearance due to the configuration of the pinch pleat drapery 12 which largely controls the aesthetic appearance of the pinch pleat drapery 12. Or, said another way, the aesthetic appearance of pinch pleat drapery 12 is largely dictated by the configuration of iterative pleats 88 and panels 90. In contrast, ripplefold drapery 14 is simply a flat panel of fabric that is largely devoid of features that facilitate the aesthetic appearance of the ripplefold drapery 14 when it hangs from the drapery rod 16. As such, the manner in which the drapery pins 52 of rings 32 engage the ripplefold drapery 14 have a substantial effect on the shape and form that ripplefold drapery 14 takes when it hangs from drapery rod 16. Therefore, the manner in which the drapery pins 52 of rings 32 engage the ripplefold drapery 14 substantially affect the aesthetic appearance of ripplefold drapery 14.

In the arrangement shown, as one example, when a ripplefold drapery 14 is installed on drapery rod 16 using a plurality of rings 32, a drapery pin 52 is placed in the left channel 46 or right channel 48 of each attachment member 42 of each ring 32. Care is taken to ensure that the when the drapery pin 52 of one ring 32 positioned in one of the left channel 46 and right channel 48 the drapery pin 52 of the next adjacent ring 32 is positioned in the other of the left channel 46 and right channel 48. Ripplefold drapery 14 is then installed onto the drapery pin 52 of each ring 32 by inserting the forward end 54 of drapery pin 52 through the material of ripplefold drapery 14 such that the forward-to-back length of drapery pin 52 extends through the plane of the material of ripplefold drapery 14 at the desired angle and position so as to provide the desired aesthetically pleasing appearance of ripplefold drapery 14.

Figure 12:
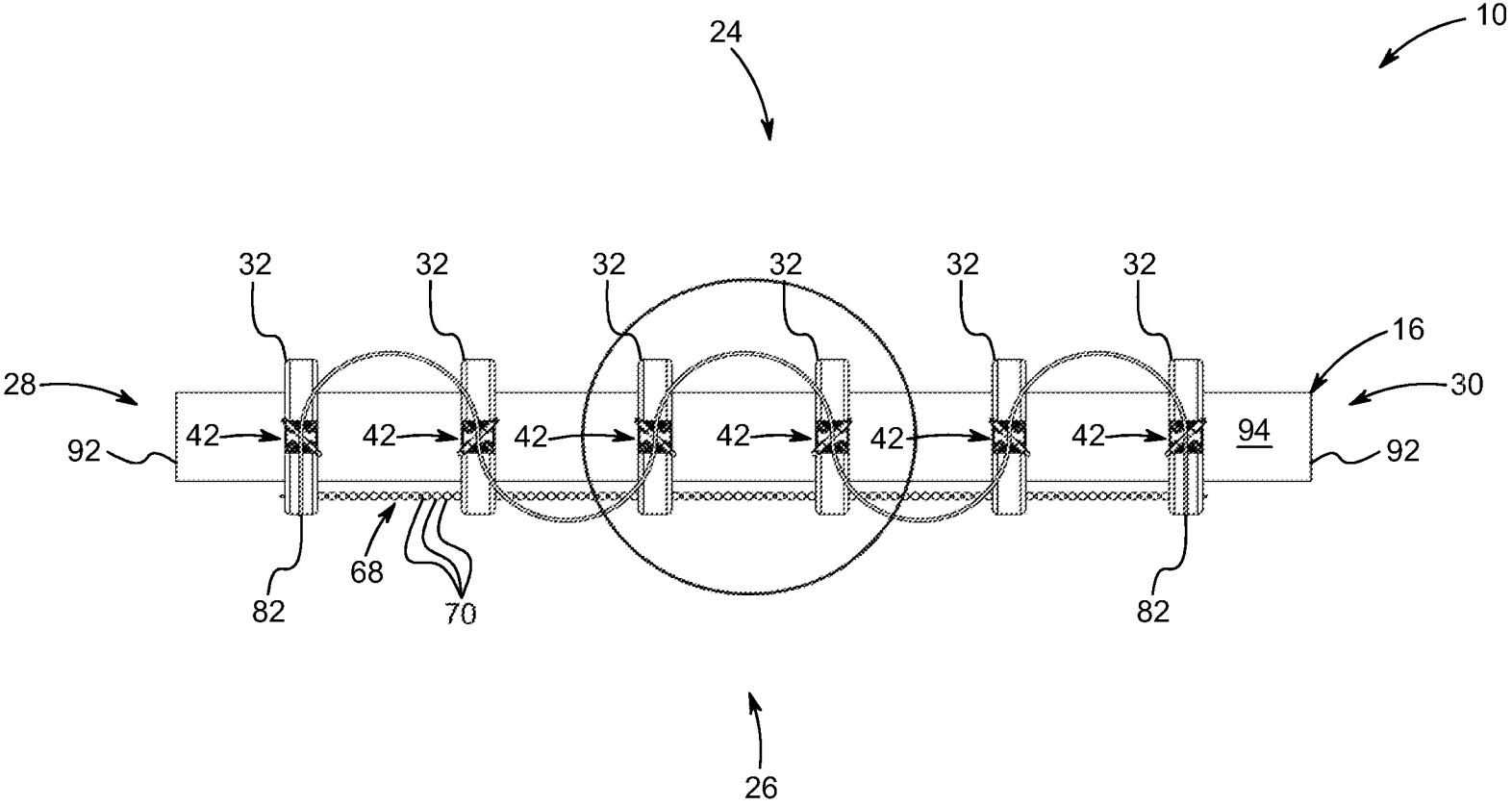
FIG. 12 shows a bottom view of a pinch pleat and ripplefold drapery system, in accordance with one or more embodiments; the view showing rings on drapery rod alternating between having drapery pins in the left channel and drapery pins in the right channel.
Figure 13:
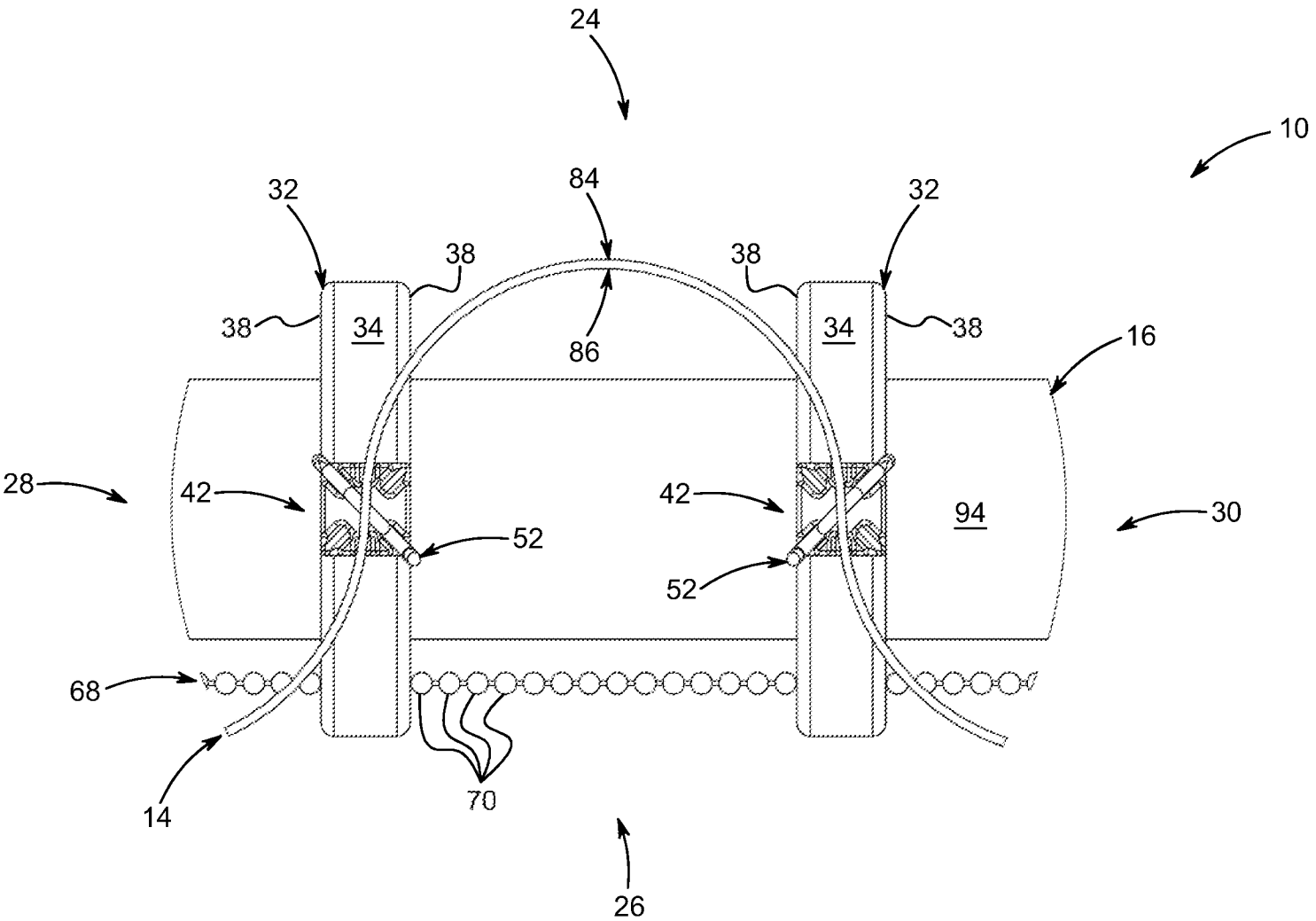
FIG. 13 shows a close up bottom view of a pinch pleat and ripplefold drapery system, in accordance with one or more embodiments; the view showing rings on drapery rod alternating between having drapery pins in the left channel and drapery pins in the right channel.
Figure 14:
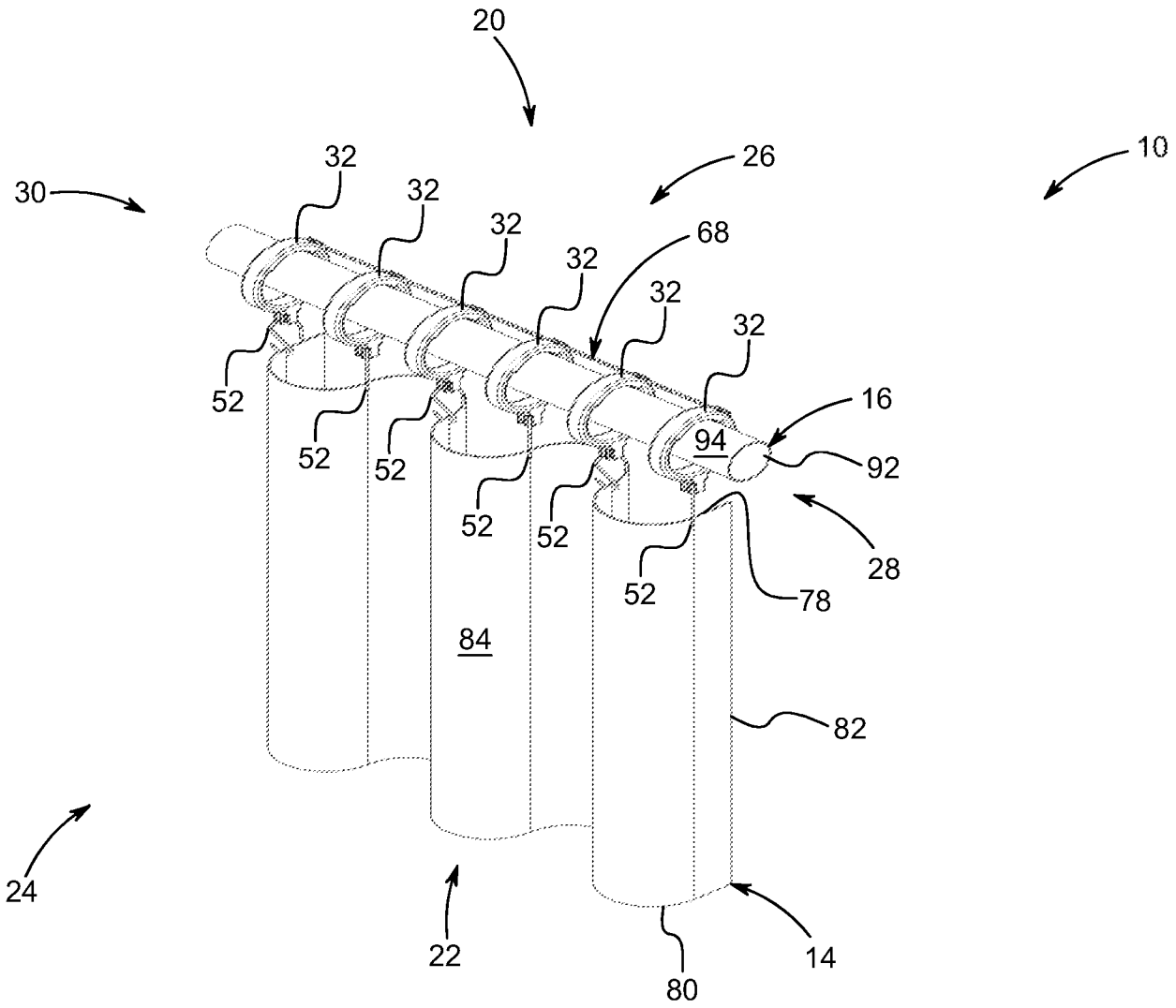
FIG. 14 shows a front left perspective view of a pinch pleat and ripplefold drapery system, in accordance with one or more embodiments; the view showing ripple fold drapery and rings installed on a drapery rod; view showing rings on drapery rod alternating between having drapery pins in the left channel and drapery pins in the right channel.
Figure 15:
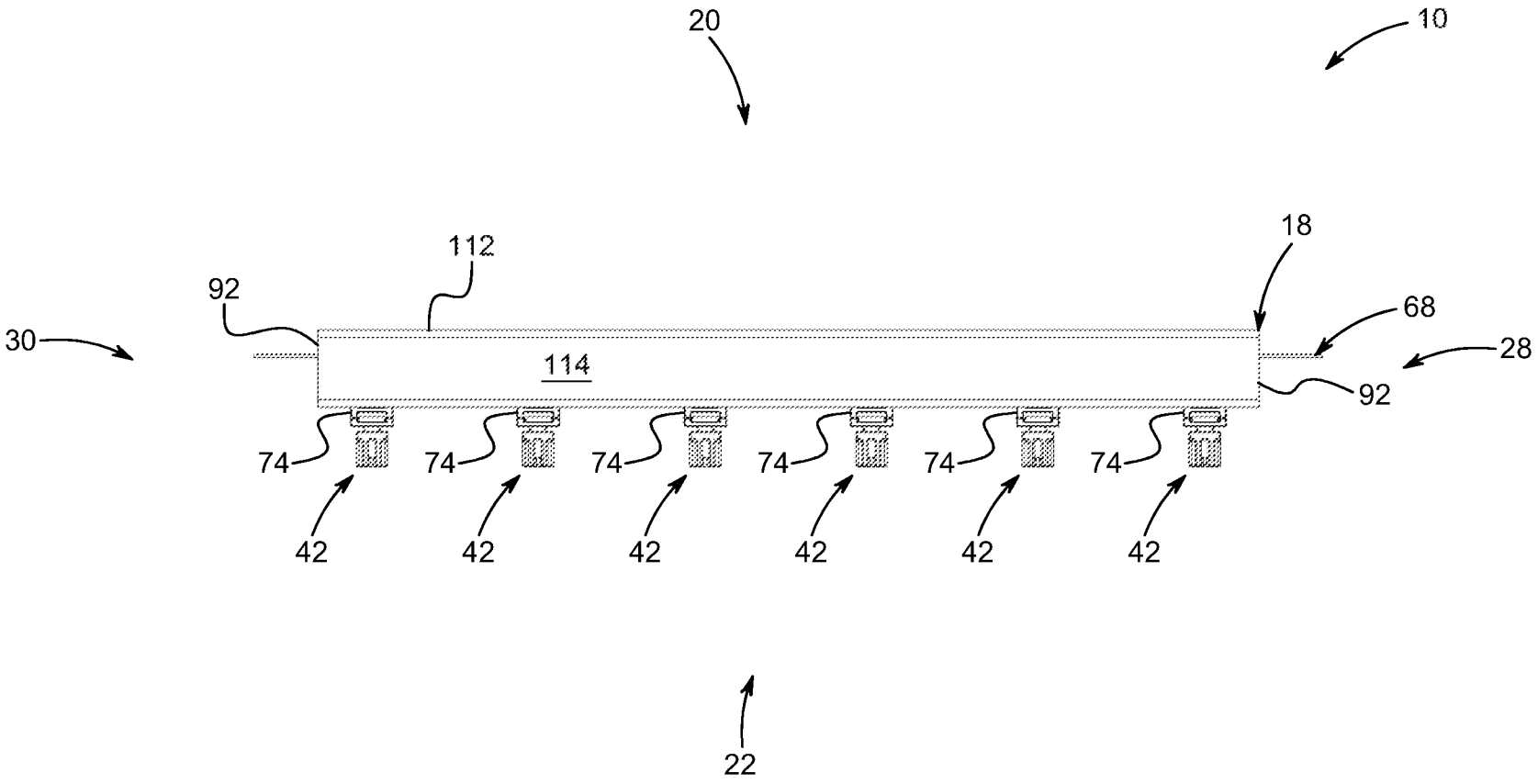
FIG. 15 shows a front view of a pinch pleat and ripplefold drapery system, in accordance with one or more embodiments; the view showing a drapery track, carriers and lead.

In the arrangement shown, as one example with reference to FIGS. 12 and 13, when left channel 46 and right channel 48 extend at approximately 45° to the centerline of ring 32, the drapery pin 52 extends through the material of ripplefold drapery 14 at an approximate 45° at the upper end 78 of ripplefold drapery 14 at the location of each pleat 88. In the arrangement shown, as one example, each drapery pin 52 intersects the material of ripplefold drapery 14 at a position wherein the material of ripplefold drapery 14 extends in an approximate perpendicular alignment to the length of drapery rod 16. In this way, the angle that the drapery pins 52 extend outward from attachment member 42 coupled with the angle that the drapery pins 52 intersect with the plane of ripplefold drapery 14 coupled with the spacing between where adjacent drapery pins 52 intersect with ripplefold drapery 14 dictate or impart the ripplefold drapery 14 hangs from drapery rod 16.

As such, when hanging a ripplefold drapery 14, the angular orientation and the spacing of insertion and the angle of insertion of drapery pins 52 creates the ripples of the ripplefold drapery 14 and creates the aesthetic appearance of ripplefold drapery 14. Or, said another way, the angular orientation and the spacing of insertion and the angle of insertion of drapery pins 52 induce tilt onto the ripplefold drapery 14 that produces the ripplefold shape.

One benefit of this arrangement of this arrangement wherein rings 32 have a left channel 46 and a right channel 48 that are used to hold a drapery pin 52 at an angle so as to hang a ripplefold drapery 14 is that this configuration allows for complete customization, modification and adjustment at any time. As such, the user can install and adjust and reinstall and readjust without cost, without delay, without additional parts or configurations, without sewing, without prior thought. The user can simply guess and check until they are pleased with the result.

In contrast, to hang a ripplefold drapery 14 in the conventional manner, a male snap tape with a predetermined spacing between ripples must be sewn into the upper end 78 of the ripplefold drapery 14. Then, a female member is used to connect to each connector of this male snap tape. Once the male snap tape is sewn into the ripplefold drapery 14 the spacing of the ripples is permanently set and cannot be adjusted as the location of the attachment points, which dictates the shape and fullness of the ripplefold drapery 14, is fixed. As such, if the aesthetic appearance of the ripplefold drapery 14 is less than desirable there is nothing that can be done to adjust or improve the aesthetic appearance of the ripplefold drapery 14 other than taking the ripplefold drapery 14 down, removing the male snap tape, getting a new male snap tape with different spacing, and sewing the new male snap tape into the upper end 78 of the ripplefold drapery 14 and rehanging the ripplefold drapery 14. At which point, if the aesthetic appearance of the ripplefold drapery 14 is still less than desirable, this process must be re-performed yet again. This costly, time consuming, expensive and frustrating process must be repeated until the desired aesthetic appearance is achieved.

In contrast, using the system 10 presented herein, all the user must do is move the location of drapery pins 52 relative to the ripplefold drapery 14 until they are happy with the aesthetic appearance of the ripplefold drapery 14. This is a substantial benefit, especially considering the finicky nature of ripplefold drapery 14 and the fact that many users desire to adjust the ripplefold drapery 14 after installation to fit their desires.

Another benefit of this arrangement is that users can adjust ripplefold drapery 14 in unique ways, such as: having the ripplefold 14 being fuller in the front of the drapery rod 16; having the ripplefold 14 being fuller in the rear of the drapery rod 16; having fullness of the ripples increase as they move from left to right along the length of the drapery rod 16; having fullness of the ripples decrease as they move from left to right along the length of the drapery rod 16; adjusting the position of the ripples to correspond with features or patterns in the material of the ripplefold drapery 14; or by adjusting the ripplefold drapery 14 in any other way.

Guide: In the arrangement shown, as one example, a guide 110 is placed on, in or in association with the interior surface 36 of ring 32 where ring 32 engages drapery rod 16. Guide 110 may be formed of any suitable size, shape and design and is configured to facilitate and maintain precise angular alignment of ring 32 with respect to drapery rod 16 while also allowing ring 32 to slide along the length of drapery rod 16 with minimal resistance. In the arrangement shown, as one example, the interior surface 36 of ring 32 has a larger diameter than the exterior diameter of drapery rod 16. This configuration allows for the easy sliding of rings 32 along the length of drapery rod 16 without binding or excessive friction. However, if the interior diameter of interior surface 36 is too large as compared to the exterior diameter of drapery rod 16 then ring 32 may unnecessarily move or tilt during use. As the ring 32 tilts, this tilting causes drapery pin 52 to similarly tilt and as such, even if left channel 46 and right channel 48 precisely hold and align drapery pin 52 this precise alignment can be cancelled or counter acted by the tilting of ring 32.

To prevent or reduce the tilting of ring 32, guide 110 is present at, in or in association with the interior surface 36 of ring 32 where ring 32 engages drapery rod 16. In the arrangement shown, as one example, guide 110 is a portion of interior surface 36 that has a smaller diameter that closely matches the exterior diameter of drapery rod 16. This close matching of guide 110 to drapery rod 16 imparts precise alignment of ring 32 to drapery rod 16. In the arrangement shown, as one example, guide 110 is only present at the upper portion of the interior surface 36 of ring 32, which is precisely the portion of interior surface 36 that engages drapery rod 16. However, any other configuration is hereby contemplated for use. As an alternative arrangement, guide 110 may include flexible arms that reach down from the upper portion of interior surface 36 that engage the exterior surface of drapery rod 16 and provide guidance thereto. As an alternative arrangement, guide 110 may include wings that extend outward from sides 38 of rings 32 that engage the exterior surface of drapery rod 16 and provide guidance thereto.

Drapery Pin 52:

In one or more arrangement, attachment member 42 of rings 32 are configured to receive and hold and align a drapery pin 52 in center channel 44, left channel 46 and right channel 48. Drapery pins 52 are formed of any suitable size, shape and design and are configured connect to attachment member 42 of rings 32 as well as to facilitate the connection of pinch pleat drapery 12 and ripplefold drapery 14 to rings 32.

In the arrangement shown, as one example, drapery pins 52 are formed of a generally cylindrical metallic member that extends a length between a forward end 54 and a rearward end 56. In the arrangement shown, as one example, forward end 54 is pointed or sharp in nature so as to facilitate the insertion into and through the material of pinch pleat drapery 12 and ripplefold drapery 14, whereas in contrast rearward end 56 is a flat and dull.

In the arrangement shown, as one example, drapery pins 52 include a first vertical section 58, lower corner 60, a second vertical section 62, an upper corner 64 and a third vertical section 66. In the arrangement shown, as one example, first vertical section 58 extends in a generally flat and straight and vertical manner from forward end 54, at its upper end, to the forward end of lower corner 60, at its lower end. In the arrangement shown, as one example, lower corner 60 extends in a generally curved manner from its forward end that connects to the lower end of first vertical section 58, to the lower end of the second vertical section 62 at its rearward end. In the arrangement shown, as one example, second vertical section 62 extends in a generally flat and straight and vertical manner from the rearward end of lower corner 60, at its lower end, to the forward end of upper corner 64, at its upper end. In the arrangement shown, as one example, upper corner 64 extends in a generally curved manner from its forward end that connects to the upper end of second vertical section 62, to the upper end of the third vertical section 66 at its rearward end. In the arrangement shown, as one example, third vertical section 66 extends in a generally flat and straight and vertical manner from the rearward end of upper corner 64, at its upper end, to the rearward end 56 at its lower end. In this way, drapery pins 52 form a generally S-shaped member that extends from the pointed forward end 54 to the non-pointed rearward end 56. However, any other size, shape and design or configuration is hereby contemplated for drapery pins 52.

In the arrangement shown, as one example, rearward end 56 is configured to be inserted into one of the center channel 44, left channel 46 or right channel 48. In doing so, the drapery pin 52 is configured to be held by the selected center channel 44, left channel 46 or right channel 48 by the engagement of the selected center channel 44, left channel 46 or right channel 48 with the upper corner 64. Or, said another way, drapery pin 52 is configured to hang from upper corner 64 when drapery pin 52 is placed within center channel 44, left channel 46 or right channel 48.

In the arrangement shown, as one example, forward end 54 is configured to be inserted into and through the material of pinch pleat drapery 12 and/or ripplefold drapery 14. In doing so, the material of pinch pleat drapery 12 and/or ripplefold drapery 14 is held by upwardly facing curve of the lower corner 60 the drapery pin 52. In this arrangement, the material of pinch pleat drapery 12 and/or ripplefold drapery 14 may be easily installed onto drapery pin 52 and removed from drapery pin 52 for adjustment and readjustment purposes.

Again, any other configuration of a drapery pin 52 is hereby contemplated for use. The configuration of drapery pin 52 presented is only one of countless examples of a drapery pin 52.

Lead 68:

In one arrangement, a lead 68 connects rings 32. Lead 68 is formed of any suitable size, shape and design and is configured to connect adjacent rings 32 so as to set the maximum spacing of adjacent rings 32 when drapery 12, 14 is in a fully closed position.

In the arrangement shown, as one example, lead 68 is formed of a string or cord or any other elongated flexible member such as a wire, rope, chain, or any other member that can be used to set the spacing of adjacent rings 32.

In one arrangement, lead 68 includes a plurality of features 70 that are spaced along the length of lead 68. In the arrangement shown, as one example, features 70 are spherical in shape and are centered on and over-molded on the string or cord of lead 68 in approximate equally spaced relation to one another along the length of lead 68.

However, features 70 may be formed of any other size, shape, configuration, or spacing and may be formed square, rectangular, oval, disc-shaped, O-shaped, or any other shape. Alternatively, features 70 may be formed of a clip, hook, loop, chain link or any other device or feature that can be used to connect lead 68 to rings 32.

In the arrangement shown, as one example, features 70 are configured to be received by and held by connection member 50 of rings 32 thereby setting the maximum spacing of adjacent rings 32 as is described herein.

Egg-Shaped Ring 32:

With reference to FIGS. 19A-19D, and 25A-25J a second embodiment of a ring 32 and attachment member 42 is presented. The teaching of the other embodiments of system 10 presented herein apply equally to the embodiment presented in FIGS. 19A-19D, and 25A-25J unless stated otherwise.

In the arrangement shown, as one example, ring 32 is non-circular in shape, or oblong in shape or is formed of an egg-shape when viewed from the side. That is, in the arrangement shown, as one example, the upper end the interior surface 36 of ring 32 (as well as the upper end of the exterior surface 34 of ring 32) has a narrower diameter of curvature than the lower end of the interior surface 36 of ring 32 (as well as the lower end of the exterior surface 34 of ring 32). Or, said another way, the lower end the interior surface 36 of ring 32 (as well as the lower end of the exterior surface 34 of ring 32) has a larger diameter of curvature than the upper end of the interior surface 36 of ring 32 (as well as the upper end of the exterior surface 34 of ring 32).

In this arrangement, the interior surface 36 of the upper end of ring 32 is sized and shaped to fit around the exterior surface 94 of drapery rod 16 with close and tight tolerances. Sizing and shaping the interior surface 36 of the upper end of ring 32 to correspond with the exterior surface 94 of drapery rod 16 has the effect of ensuring ring 32 remains precisely aligned in a generally perpendicular manner to the length of drapery rod 16. Having the lower end of the interior surface 36 of ring 32 be wider than the exterior surface 94 of drapery rod 16 provides clearance for the lower end of ring 32 thereby allowing ring 32 to tilt when drapery 12, 14 is pulled manually to open or close the drapery 12, 14. This clearance ensures that the rings 32 do not bind or lock on the exterior surface 94 of drapery rod 16 when drapery 12, 14 is opened or closed by pulling drapery 12, 14 which causes rings 32 to tilt along the opening or closing direction.

Tapered and Loop Attachment Member 42:

With reference to FIGS. 19A-27E a second embodiment of an attachment member 42 is presented. The teaching of the other embodiments of system 10 presented herein apply equally to the embodiment presented in FIGS. 19A-27E unless stated otherwise.

In the arrangement shown, as one example, attachment member 42 shown in FIGS. 19A-27E serves the same general purpose and is formed of the same general configuration as the attachment member 42 presented in FIGS. 1-18B with two main differences, tapered left channel 46 and right channel 48 as well as the presence of a loop as center channel 44.

Tapered Left Channel 46 and Right Channel 48: In the arrangement shown, as one example, attachment member 42 presented in FIGS. 1-18B includes a tapered left channel 46 and right channel 48. That is, the width of left channel 46 and right channel 48 narrow as they extend from their upper end to their lower end. Or, said another way, the upper end of left channel 46 and right channel 48 is wider than the lower end of left channel 46 and right channel 48.

The purpose of this tapering of left channel 46 and right channel 48 is to ensure that drapery pin 52 is securely held in place within left channel 46 and right channel 48 so as to ensure maximum accuracy and precision as to the tangle that drapery pin 52 points when in place within left channel 46 and right channel 48. By narrowing slightly as the left channel 46 and right channel 48 extend downward this ensures that drapery pin 52 will be securely and snugly and accurately held within left channel 46 and right channel 48 regardless of the variation in size between the drapery pin 52 that is used. This configuration accommodates almost any form of a drapery pin 52 that is commercially available. As such, the use of tapered left channel 46 and right channel 48 is more versatile and robust and less sensitive to the use of different drapery pins 52.

Any other shape or configuration for left channel 46 and right channel 48 is hereby contemplated for use.

Looped Center Channel 44: As mentioned, while accuracy of alignment is important for left channel 46 and right channel 48 as left channel 46 and right channel 48 are used to attach and precisely align ripplefold drapery 14, such is not the case for center channel 44. That is, center channel 44 is used to attach pinch pleat drapery 14 which does not require precise alignment to ensure the desired aesthetic appearance is achieved.

As such, in the arrangement shown, as one example, attachment member 42 presented in FIGS. 1-18B includes a center channel 44 that is formed of an open loop that extends from side 38/102 to side 38/102 in a downwardly extending generally semi-circular shape that extends in a generally perpendicular manner to the forward to back centerline of ring 32. In the arrangement shown, as one example, this loop that forms center channel 44 extends downward from the lower side 108 of attachment member 42.

This center channel 44 provides ample room for drapery pin 52 to pass there through and provides ample room for drapery pin 52 to tilt to the left and right, as may be desired when attaching pinch pleat drapery 12 thereto. While center channel 44 provides room for angular tilting of drapery pin 52 therein when forces are applied to drapery pin 52, due to the downward arcuate shape of center channel 44 drapery pin 52 is urged to the center of center channel 44 which corresponds to the center of ring 32 and drapery pin 52 is urged to align with the forward to back centerline of ring 32.

Any other shape or configuration for center channel 44 is hereby contemplated for use.

Drapery Track 18:

With reference to FIGS. 15-18B and FIGS. 20A-24D a second embodiment of pinch pleat and ripplefold drapery system 10 is presented. With reference to FIGS. 1-14 and FIGS. 19A-19D and FIGS. 25A-27D in one arrangement, pinch pleat and ripplefold drapery system 10 is configured to be used in association with a drapery rod 16. In contrast with reference to FIGS. 15-18B and FIGS. 20A-24D pinch pleat and ripplefold drapery system 10 is configured to be used in association with a drapery track 18. The teaching of the other embodiments of system 10 presented herein apply equally to the drapery track 18 embodiments presented in FIGS. 15-18B and FIGS. 20A-24D unless stated otherwise.

Drapery track 18 is formed of any suitable size, shape and design and is configured to support the upper end 78 of pinch pleat drapery 12 and/or ripplefold drapery 14 while allowing the drapery 12, 14 to be moved between an opened position and a closed position.

Drapery track 18 may be a manual drapery track 18, in that opening and closing of the drapery 12, 14 is manually performed by a person either moving or pulling the material of drapery 12, 14 or an attached opening or closing mechanism such as a wand or pull cord, beaded cord or chain or the like. Additionally or alternatively, drapery track 18 may be a motorized drapery track 18, in that opening and closing of the drapery 12, 14 is performed by operation of a motor.

In the arrangement shown, as one example, drapery track 18 is a generally elongated member that extends a length between opposing ends 92 and has a generally square or rectangular shape having an upper wall 112, opposing sidewalls 114 and a lower wall 116 having a slot 118 positioned approximately in the middle of lower wall 116 and extending from end 92 to end. In the arrangement shown, as one example, drapery track 18 also forms a hollow interior 120 with a plurality of structural features positioned therein. However, any other size, shape and design is hereby contemplated such as square, rectangular, oval, circular, or any other shape, as well as decorative shapes, curves, or any other shape or configuration.

In one arrangement, drapery track 18 is connected to brackets positioned at or near the outward ends 92 of drapery track 18, and/or at the approximate middle of drapery rod 16, that connect drapery rod 16 to the structure that supports drapery track 18 such as the wall of a building or house.

Attachment Member 42:

In the arrangement shown, as one example, drapery track 18 includes the use of attachment members 42. The teaching of the other embodiments of system 10 presented herein apply equally to the drapery track 18 unless stated otherwise. In the arrangement shown, as one example, attachment members 42 of drapery track 18 are similar to, if not identical to, the attachment members 42 described herein that are used in association with rings 32 and drapery rod 16 with one substantial difference being that attachment members 42 of drapery track 18 connect to slot 118 of drapery track 18 as opposed to ring 32.

In the arrangement shown, as one example, like the attachment members 42 of drapery rod 16, the attachment members 42 of drapery track 18 include center channel 44, left channel 46 and right channel 48 as is described herein, in both configurations; the first configuration with center channel 44 positioned between left channel 46 and right channel 48 as is shown in FIGS. 15-18B, as well as the second configuration with the center channel 44 formed of a loop positioned below the left channel 46 and right channel 48 as is shown in FIGS. 20A-24D.

Figure 20A:
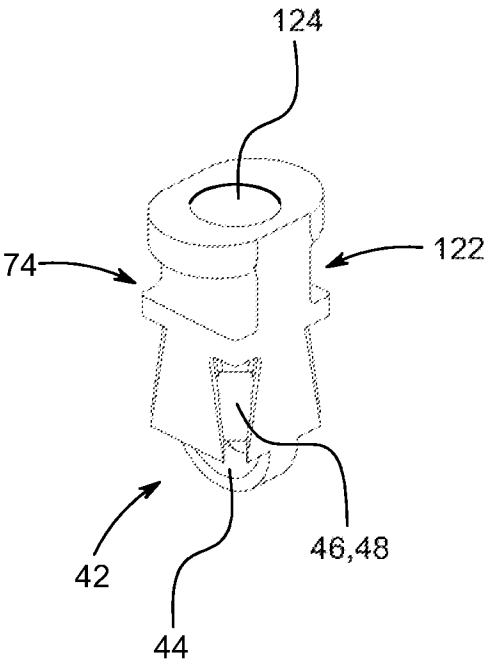
FIG. 20A shows a front right perspective view of carrier for installing drapery on a track of a ring and drapery pin for a pinch pleat and ripplefold drapery system, in accordance with one or more embodiments.
Figure 20B:
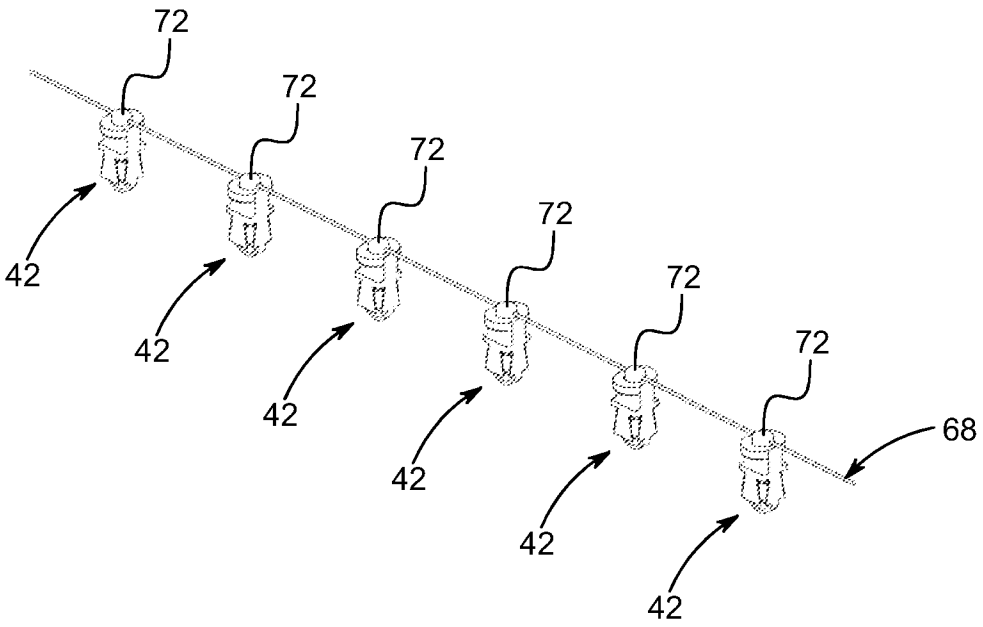
FIG. 20B shows a front right perspective view of a set of carriers and lead for installing drapery on a track of a ring and drapery pin for a pinch pleat and ripplefold drapery system, in accordance with one or more embodiments.
Figure 20C:
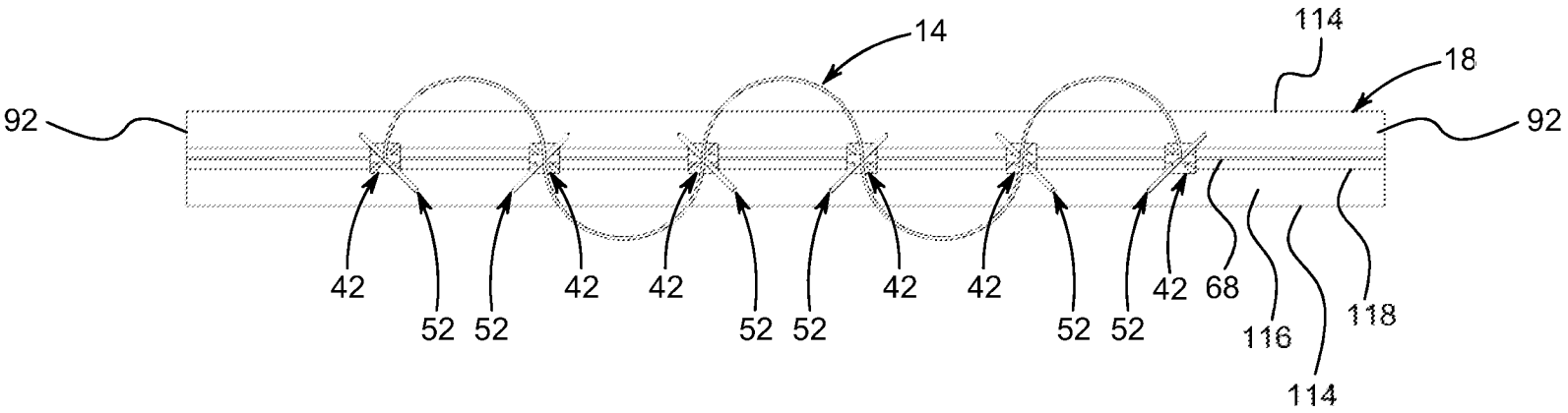
FIG. 20C shows a bottom view of a pinch pleat and ripplefold drapery system, in accordance with one or more embodiments; the view showing rings and ripplefold drapery installed on a drapery track.
Figure 21A:
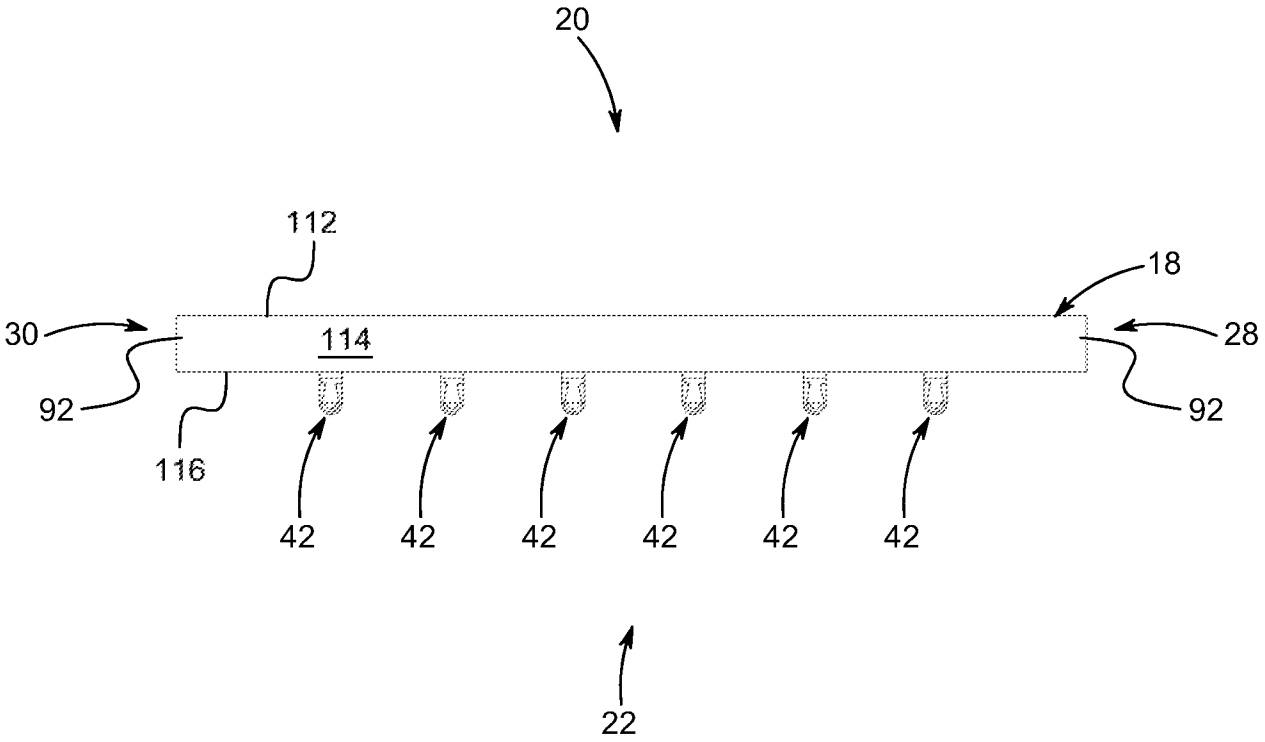
FIG. 21A shows a front view of a pinch pleat and ripplefold drapery system, in accordance with one or more embodiments; the view showing a set of carriers and track with drapery omitted.
Figure 21B:
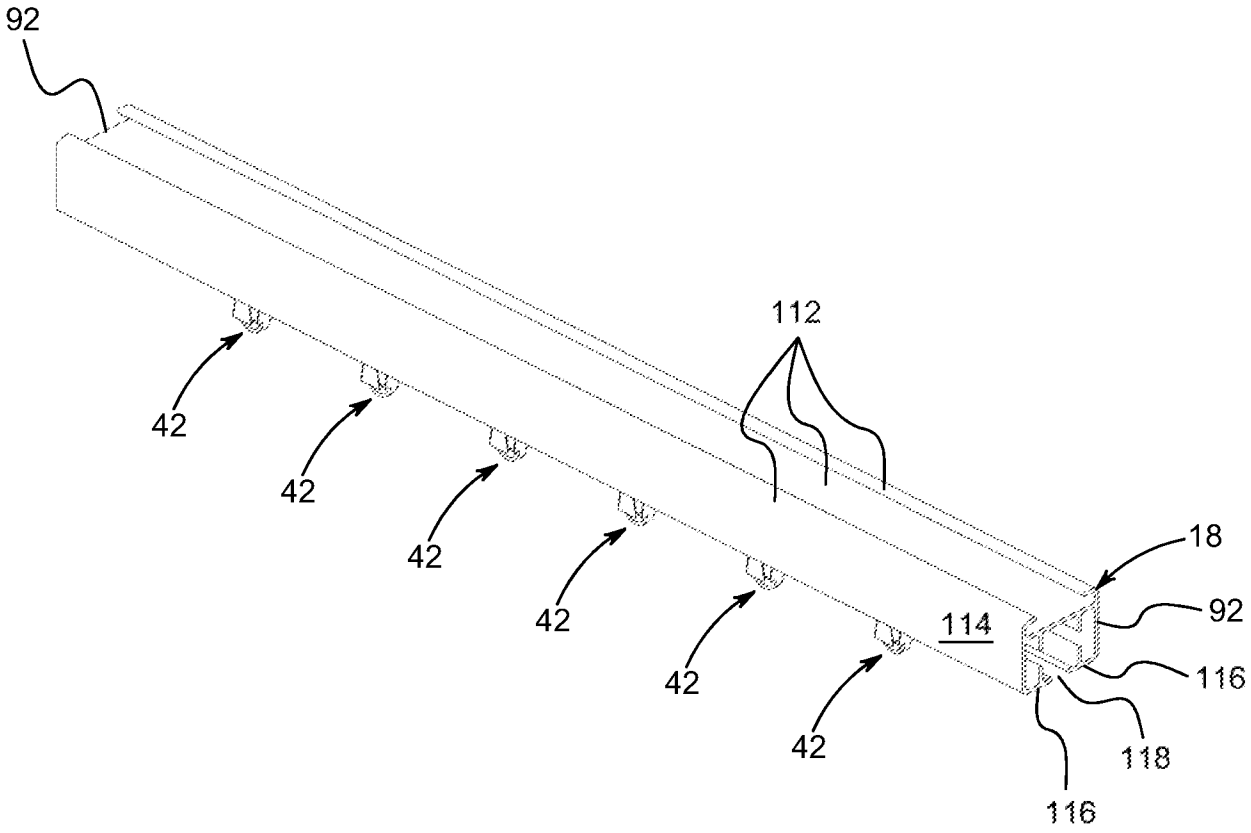
FIG. 21B shows a front right perspective view of a pinch pleat and ripplefold drapery system, in accordance with one or more embodiments; the view showing a set of carriers and track with drapery omitted.
Figure 22A:
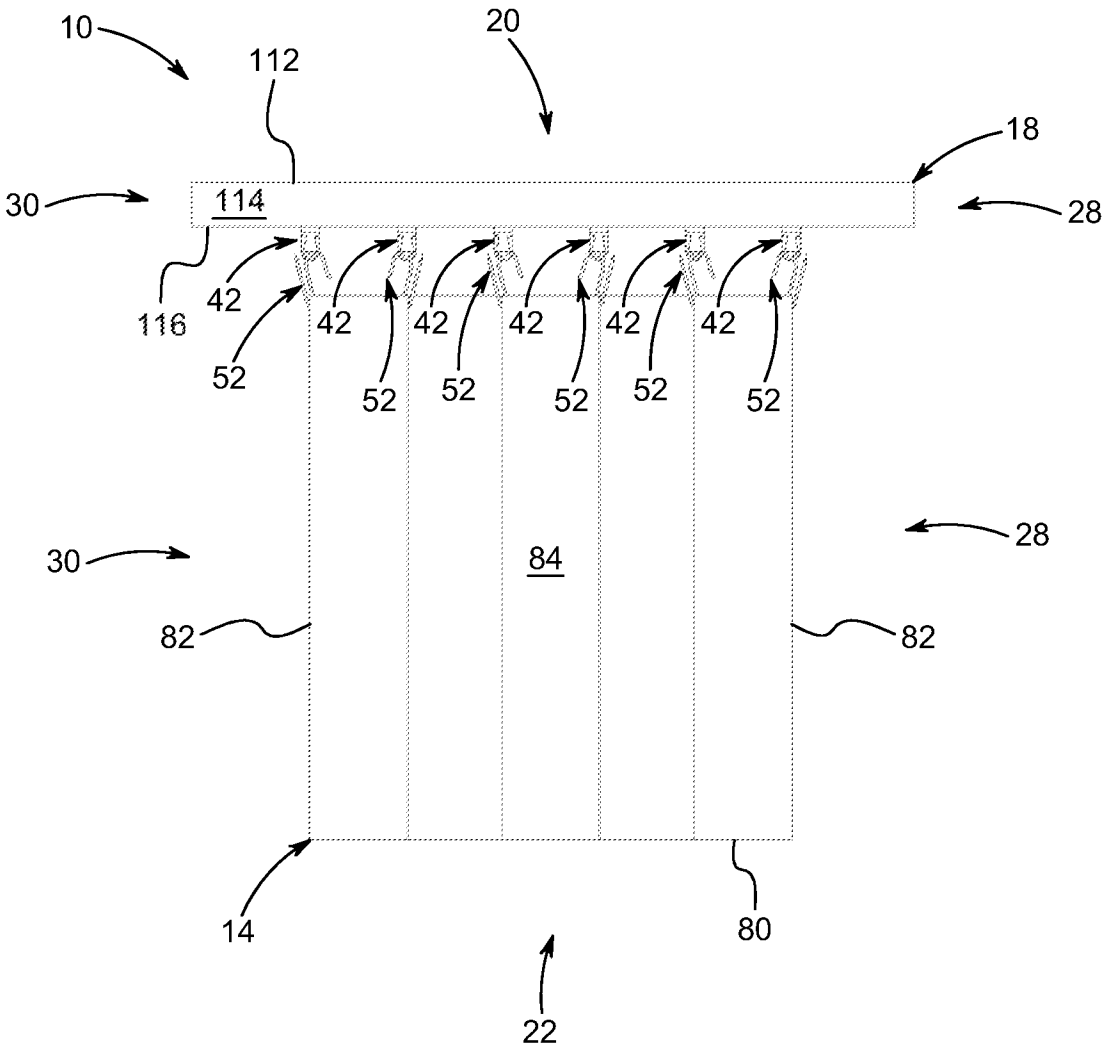
FIG. 22A shows a front view of a pinch pleat and ripplefold drapery system, in accordance with one or more embodiments; the view showing ripple fold drapery and a set of carriers installed in and a track; the view showing the view showing carriers on the track alternating between having drapery pins in a left channel and drapery pins in a right channel.
Figure 22B:
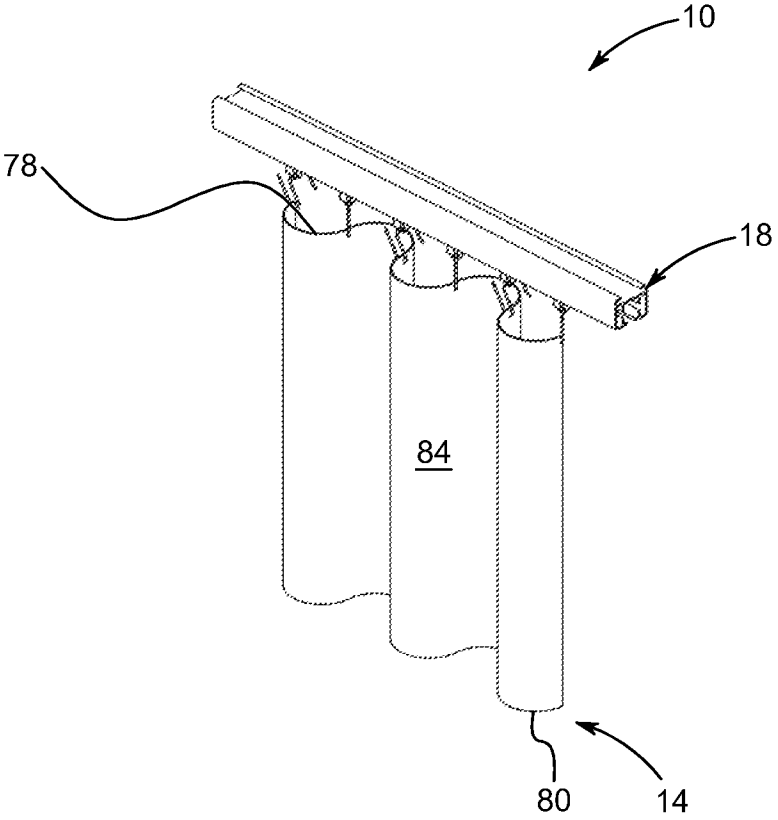
FIG. 22B shows a front right perspective view of a pinch pleat and ripplefold drapery system, in accordance with one or more embodiments; the view showing ripple fold drapery and a set of carriers installed in and a track; the view showing the view showing carriers on the track alternating between having drapery pins in a left channel and drapery pins in a right channel.
Figure 23A:
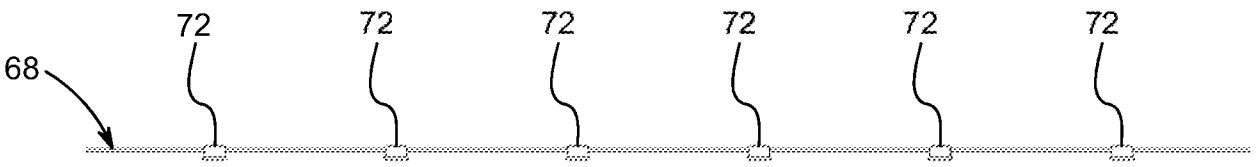
FIG. 23A shows a front view of a lead with a set of connectors for a pinch pleat and ripplefold drapery system, in accordance with one or more embodiments.
Figure 23B:
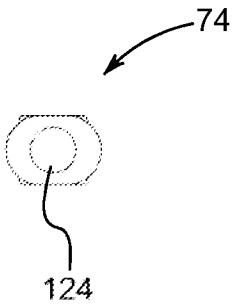
FIG. 23B shows a top view of a carrier for a pinch pleat and ripplefold drapery system, in accordance with one or more embodiments.
Figure 23C:
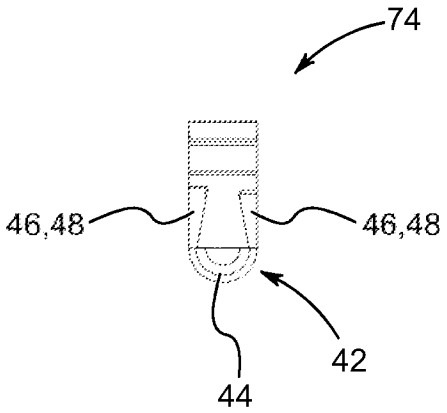
FIG. 23C shows a side view of a carrier for a pinch pleat and ripplefold drapery system, in accordance with one or more embodiments.
Figure 23D:
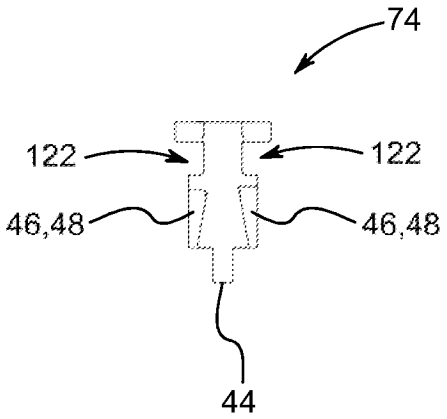
FIG. 23D shows a front view of a carrier for a pinch pleat and ripplefold drapery system, in accordance with one or more embodiments.
Figure 23E:
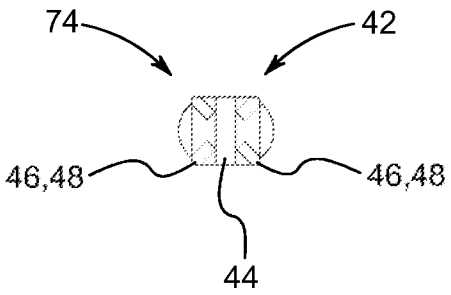
FIG. 23E shows a bottom view of a carrier for a pinch pleat and ripplefold drapery system, in accordance with one or more embodiments.
Figure 23F:
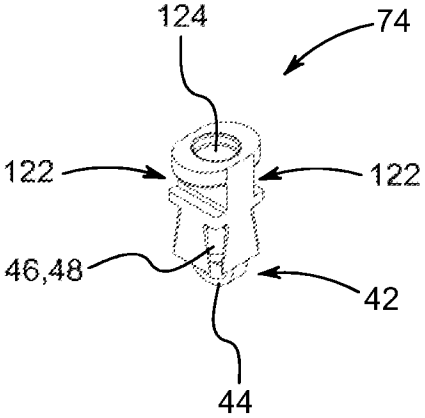
FIG. 23F shows an upper front left perspective view of a carrier for a pinch pleat and ripplefold drapery system, in accordance with one or more embodiments.
Figure 23G:
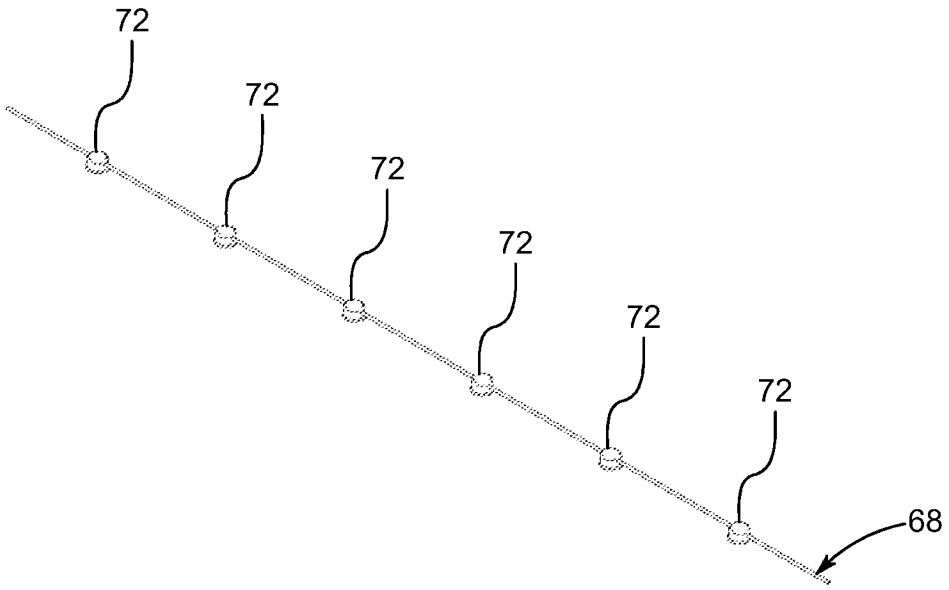
FIG. 23G shows a front right perspective view of a lead with a set of connectors for a pinch pleat and ripplefold drapery system, in accordance with one or more embodiments.
Figure 24A:
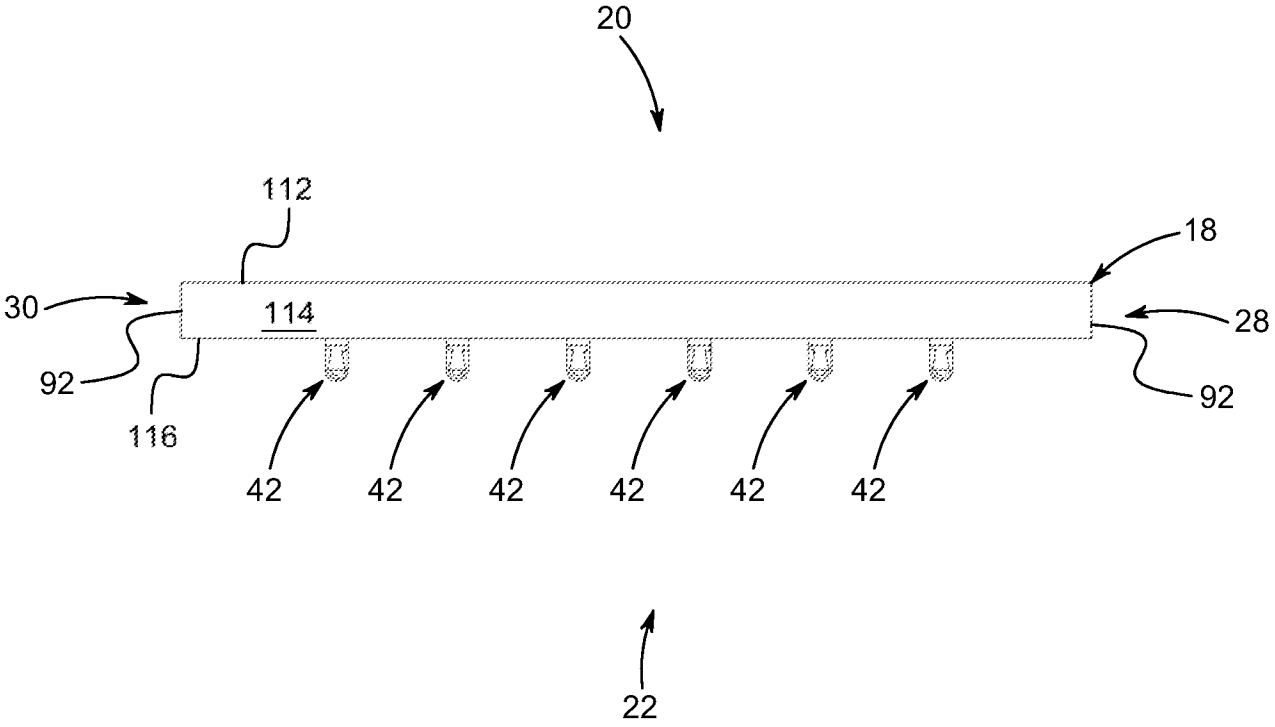
FIG. 24A shows a front view of a pinch pleat and ripplefold drapery system, in accordance with one or more embodiments; the view showing a set of carriers and track with drapery omitted.
Figure 24B:
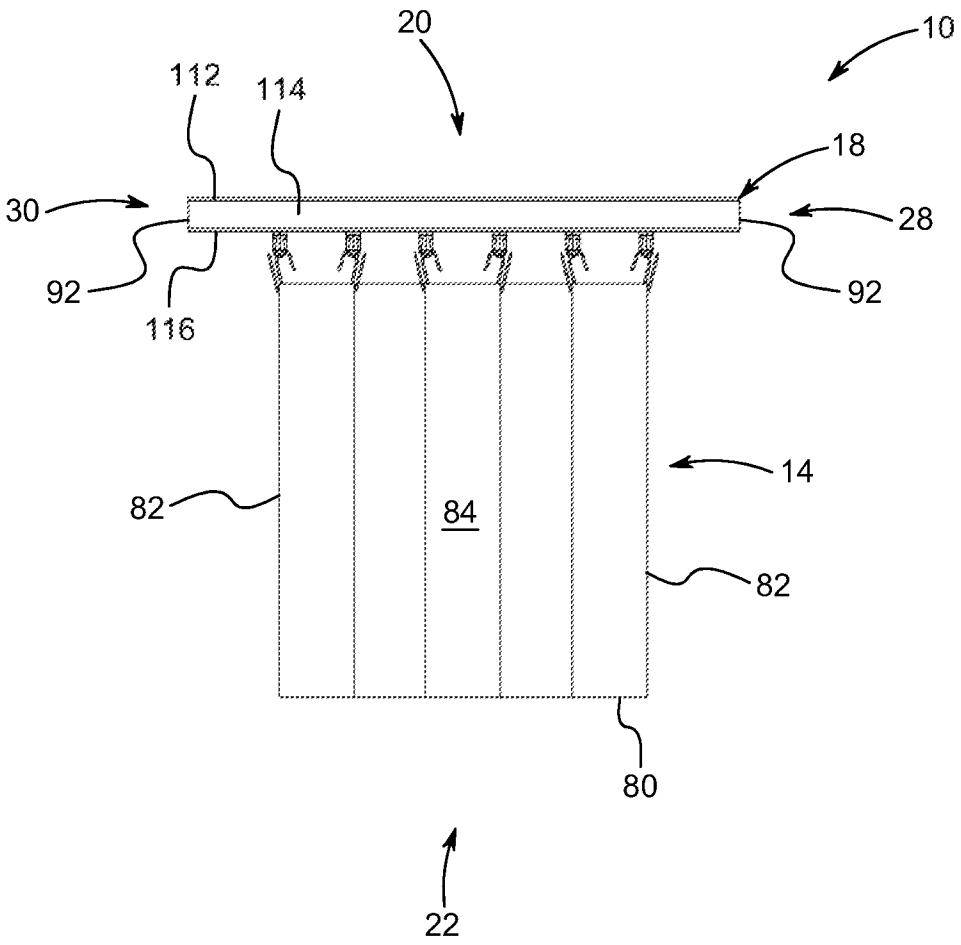
FIG. 24B shows a front view of a pinch pleat and ripplefold drapery system, in accordance with one or more embodiments; the view showing ripple fold drapery and a set of carriers installed in and a track; the view showing the view showing carriers on the track alternating between having drapery pins in a left channel and drapery pins in a right channel.
Figure 24C:
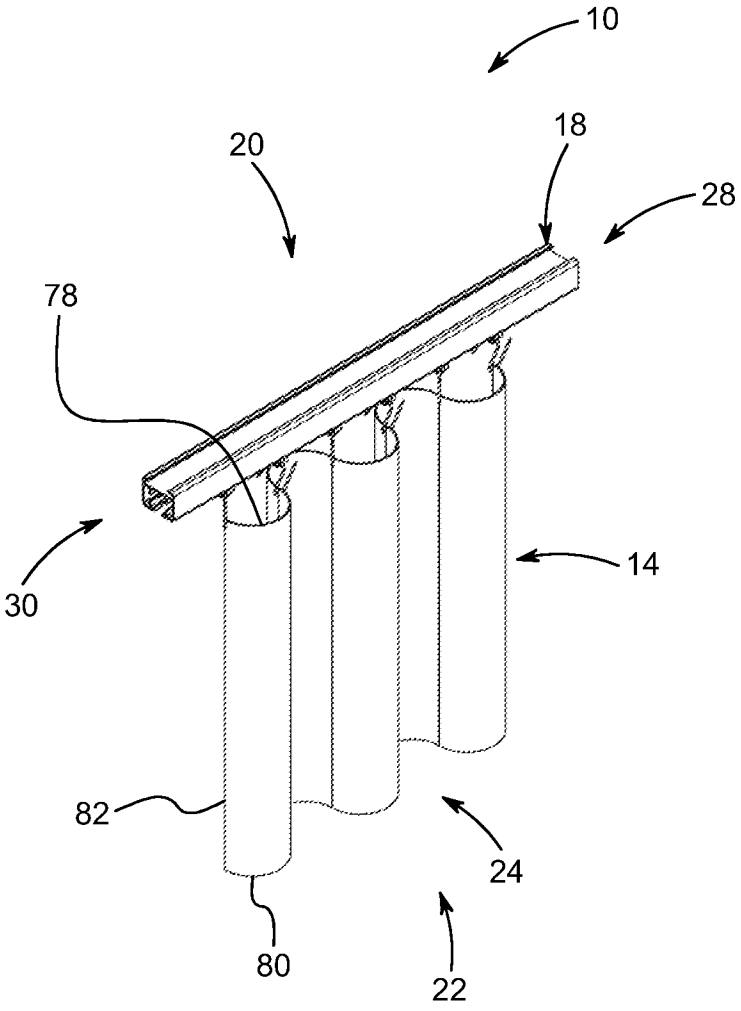
FIG. 24C shows a front left perspective view of a pinch pleat and ripplefold drapery system, in accordance with one or more embodiments; the view showing ripple fold drapery and a set of carriers installed in and a track; the view showing the view showing carriers on the track alternating between having drapery pins in a left channel and drapery pins in a right channel.
Figure 24D:
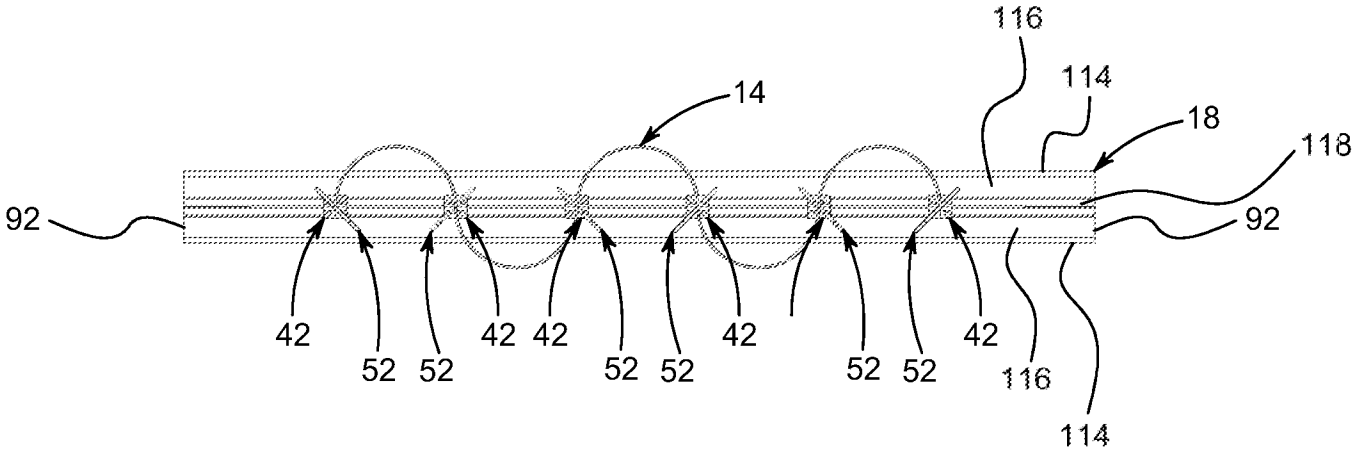
FIG. 24D shows a bottom view of a pinch pleat and ripplefold drapery system, in accordance with one or more embodiments; the view showing ripple fold drapery and a set of carriers installed in and a track; the view showing the view showing carriers on the track alternating between having drapery pins in a left channel and drapery pins in a right channel.
Figure 25A:
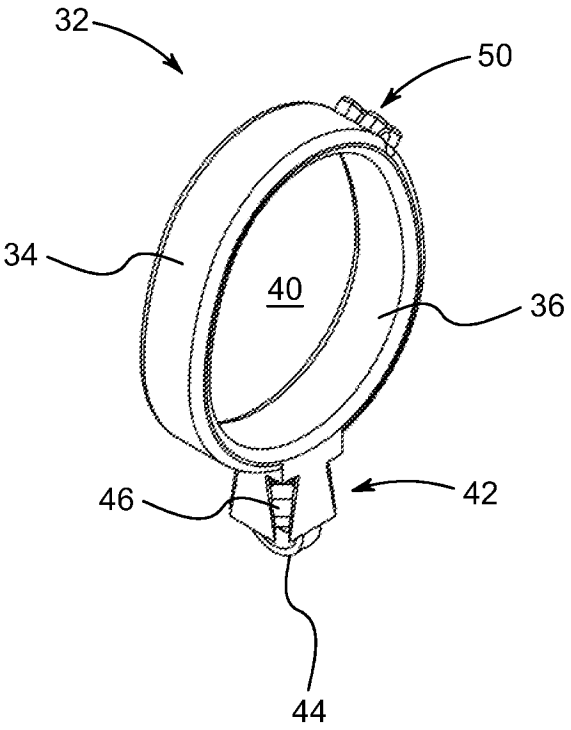
FIG. 25A shows an upper front left perspective view of an egg shaped ring for a pinch pleat and ripplefold drapery system, in accordance with one or more embodiments.
Figure 25B:
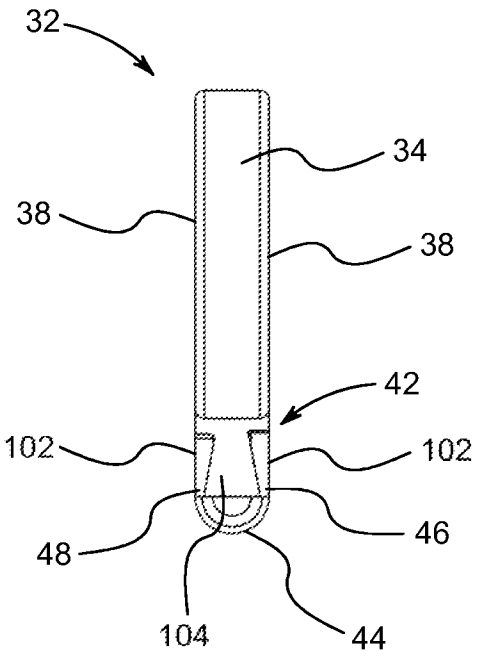
FIG. 25B shows a left side view of an egg shaped ring for a pinch pleat and ripplefold drapery system, in accordance with one or more embodiments.
Figure 25C:
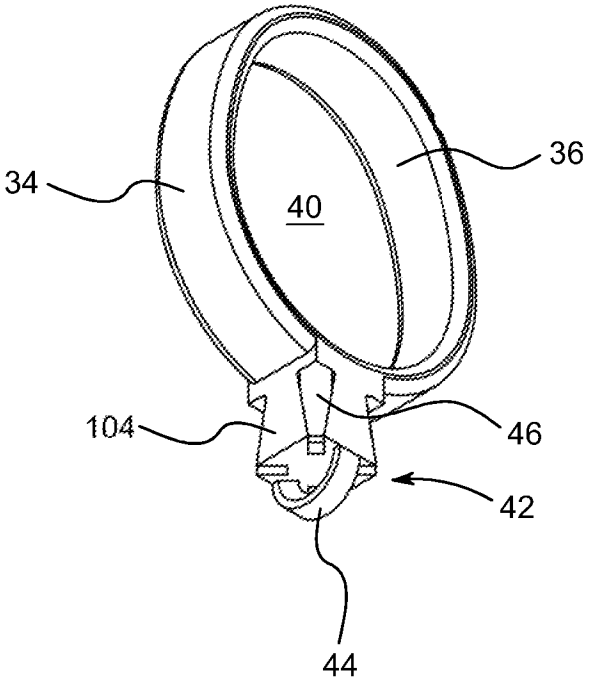
FIG. 25C shows a lower front side perspective view of an egg shaped ring for a pinch pleat and ripplefold drapery system, in accordance with one or more embodiments.
Figure 25D:
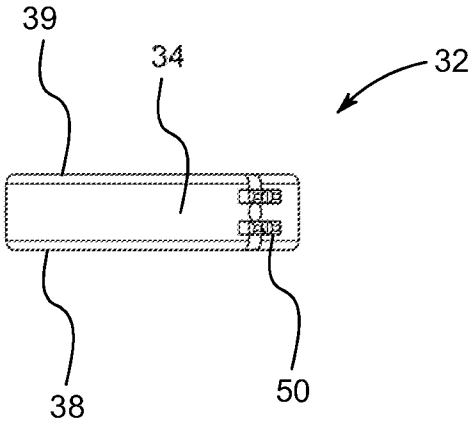
FIG. 25D shows a top view of an egg shaped ring for a pinch pleat and ripplefold drapery system, in accordance with one or more embodiments.
Figure 25E:
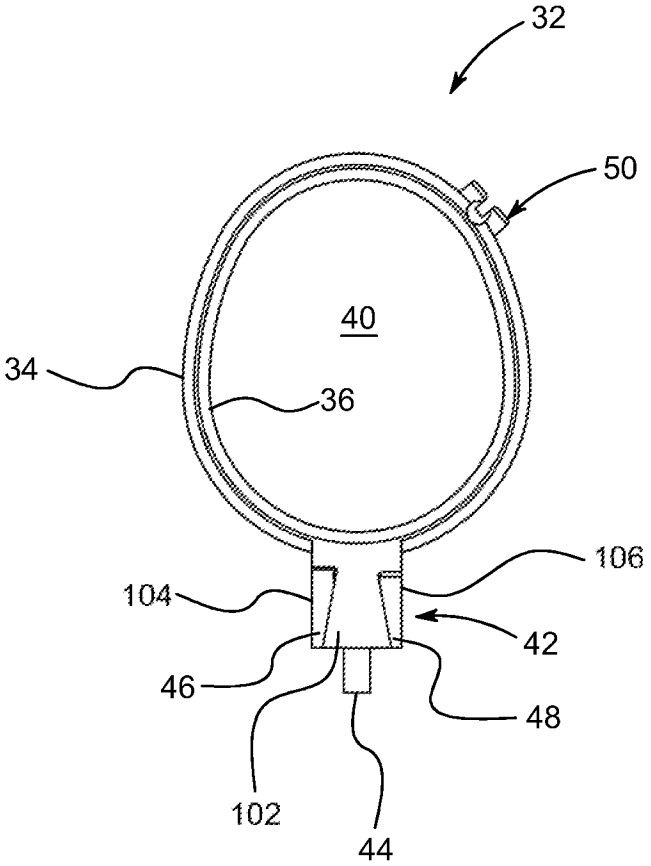
FIG. 25E shows a front view of an egg shaped ring for a pinch pleat and ripplefold drapery system, in accordance with one or more embodiments.
Figure 25F:
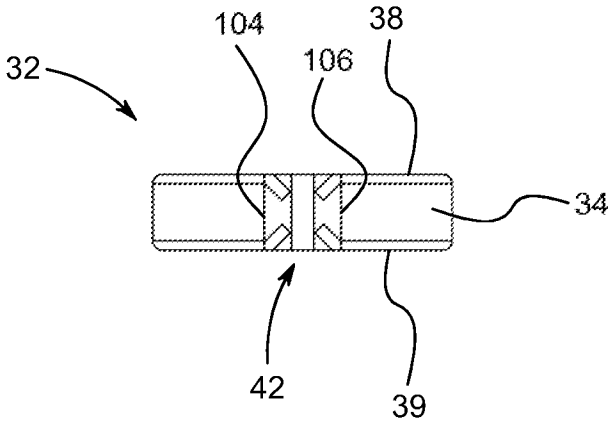
FIG. 25F shows a bottom view of an egg shaped ring for a pinch pleat and ripplefold drapery system, in accordance with one or more embodiments.
Figure 25G:
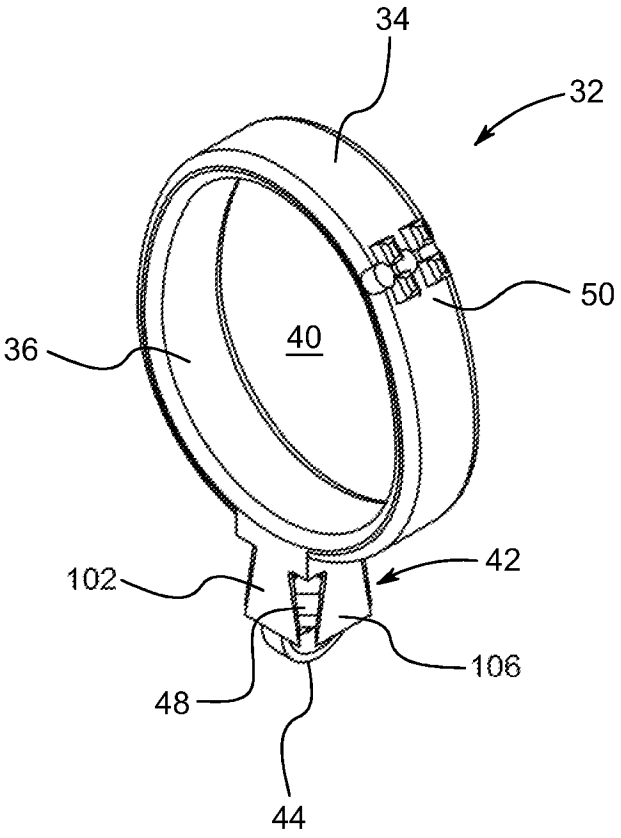
FIG. 25G shows an upper front right perspective view of an egg shaped ring for a pinch pleat and ripplefold drapery system, in accordance with one or more embodiments.
Figure 25H:
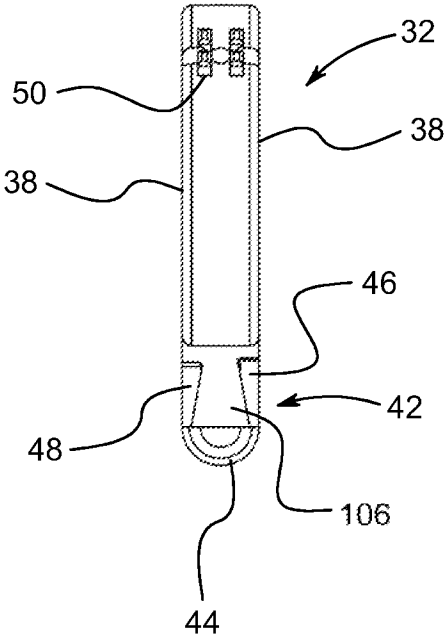
FIG. 25H shows a right side view of an egg shaped ring for a pinch pleat and ripplefold drapery system, in accordance with one or more embodiments.
Figure 25I:
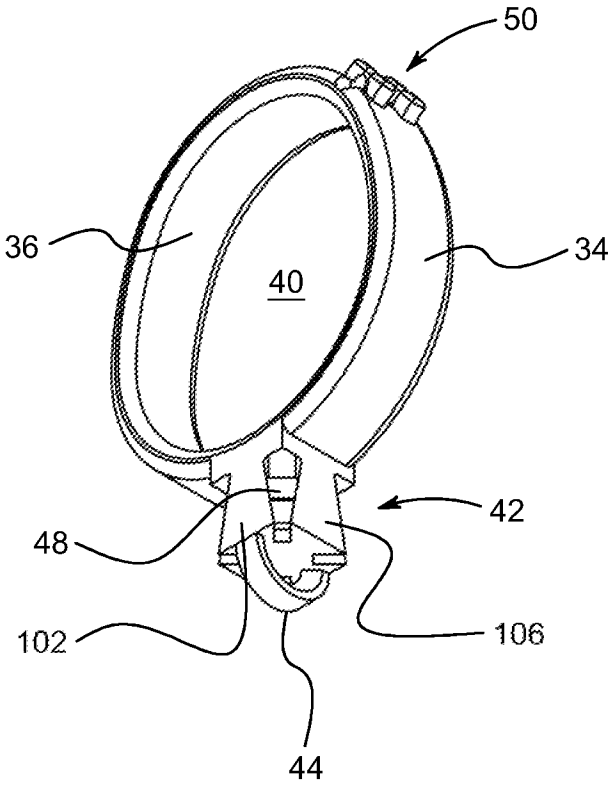
FIG. 25I shows a lower front right perspective view of an egg shaped ring for a pinch pleat and ripplefold drapery system, in accordance with one or more embodiments.
Figure 25J:
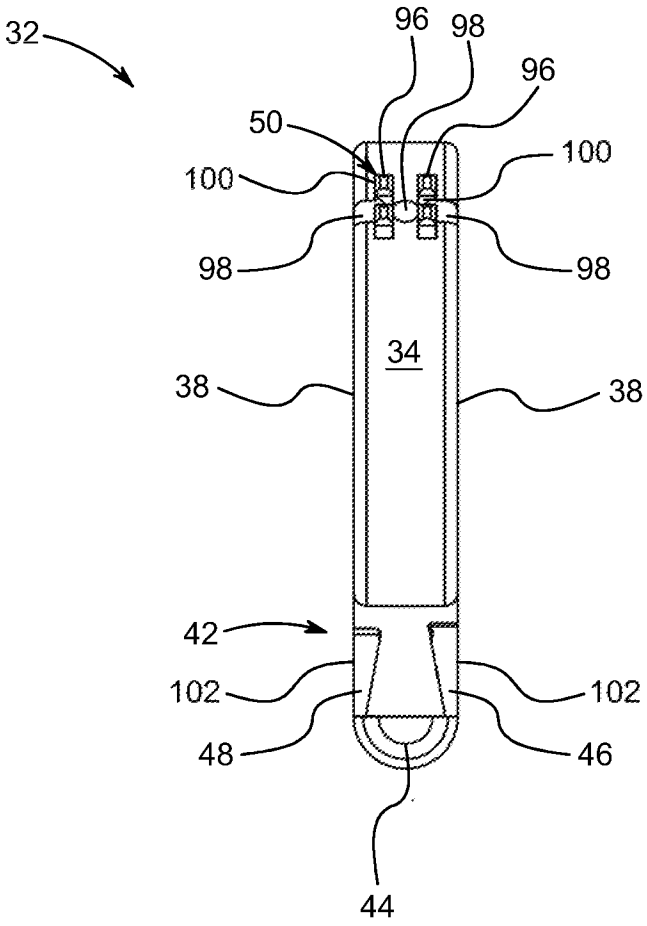
FIG. 25J shows a close up right side view of an egg shaped ring for a pinch pleat and ripplefold drapery system, in accordance with one or more embodiments.
Figure 26A:
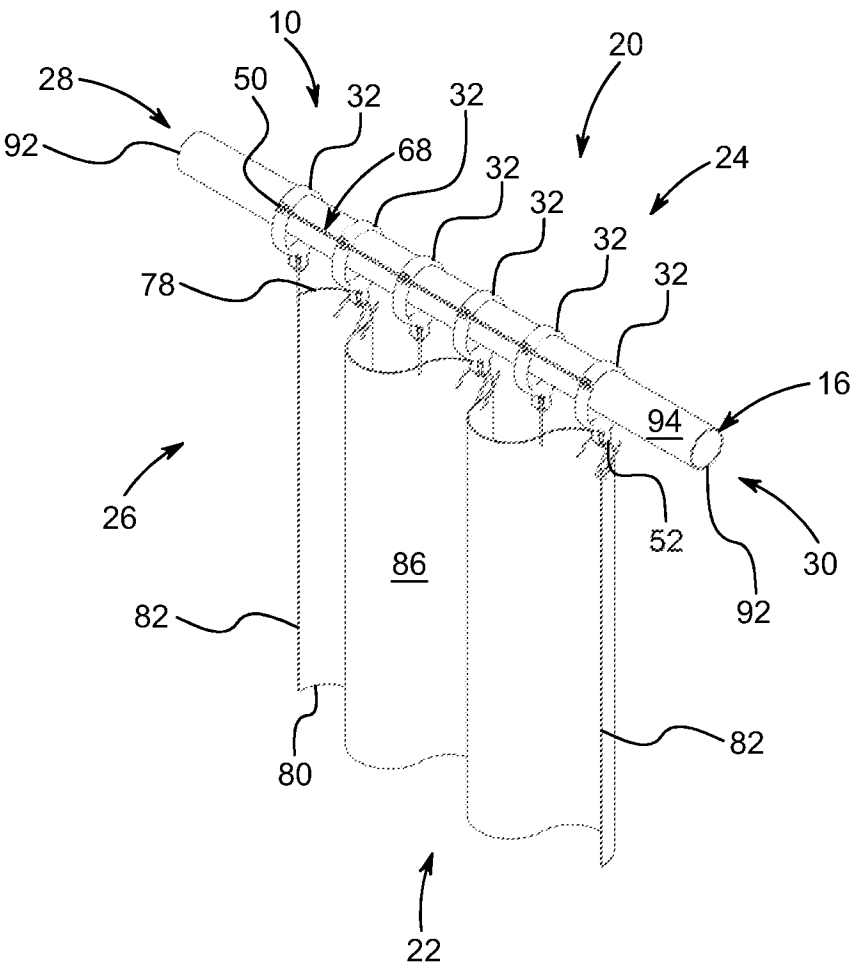
FIG. 26A shows a front left perspective view of a pinch pleat and ripplefold drapery system, in accordance with one or more embodiments; the view showing ripple fold drapery and rings installed on a drapery rod; view showing rings on drapery rod alternating between having drapery pins in the left channel and drapery pins in the right channel.
Figure 26B:
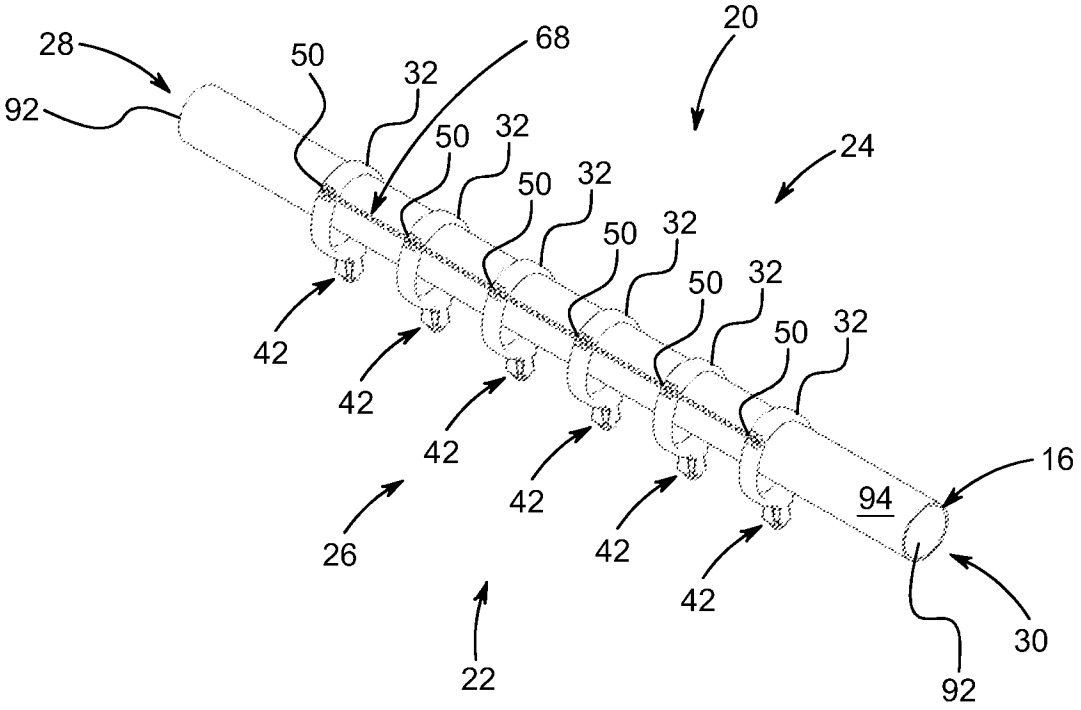
FIG. 26B shows a front left perspective view of a pinch pleat and ripplefold drapery system, in accordance with one or more embodiments; the view showing rings installed on a drapery rod with drapery omitted; view showing rings on drapery rod alternating between having drapery pins in the left channel and drapery pins in the right channel.
Figure 27A:
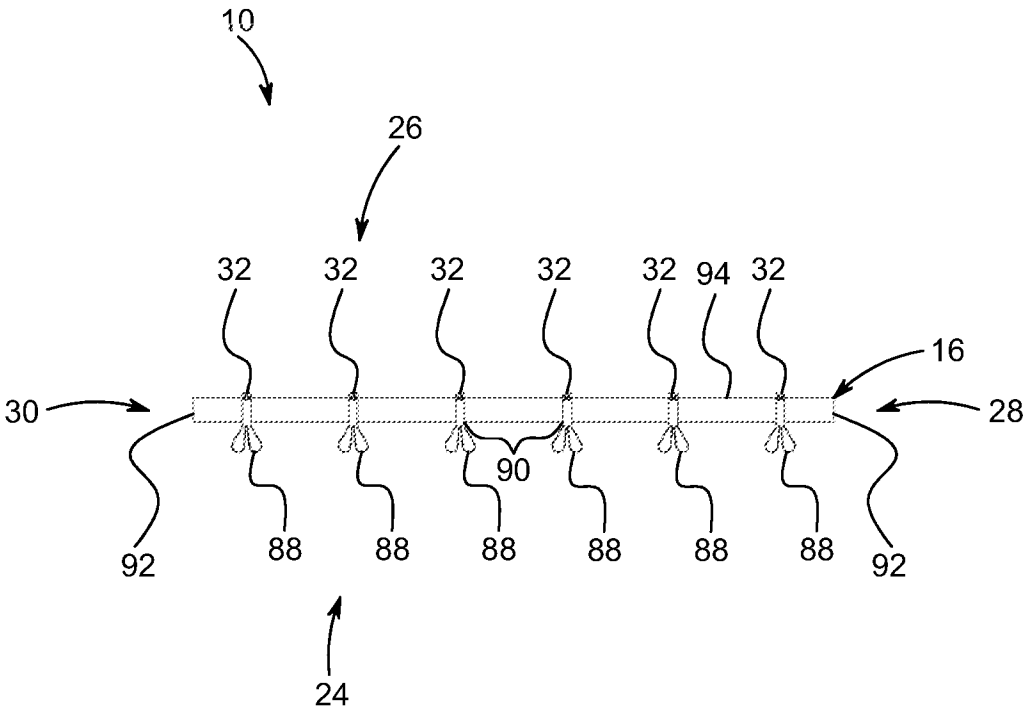
FIG. 27A shows a top view of a pinch pleat and ripplefold drapery system, in accordance with one or more embodiments; the view showing pinch pleat drapery and rings installed on a drapery rod.
Figure 27B:
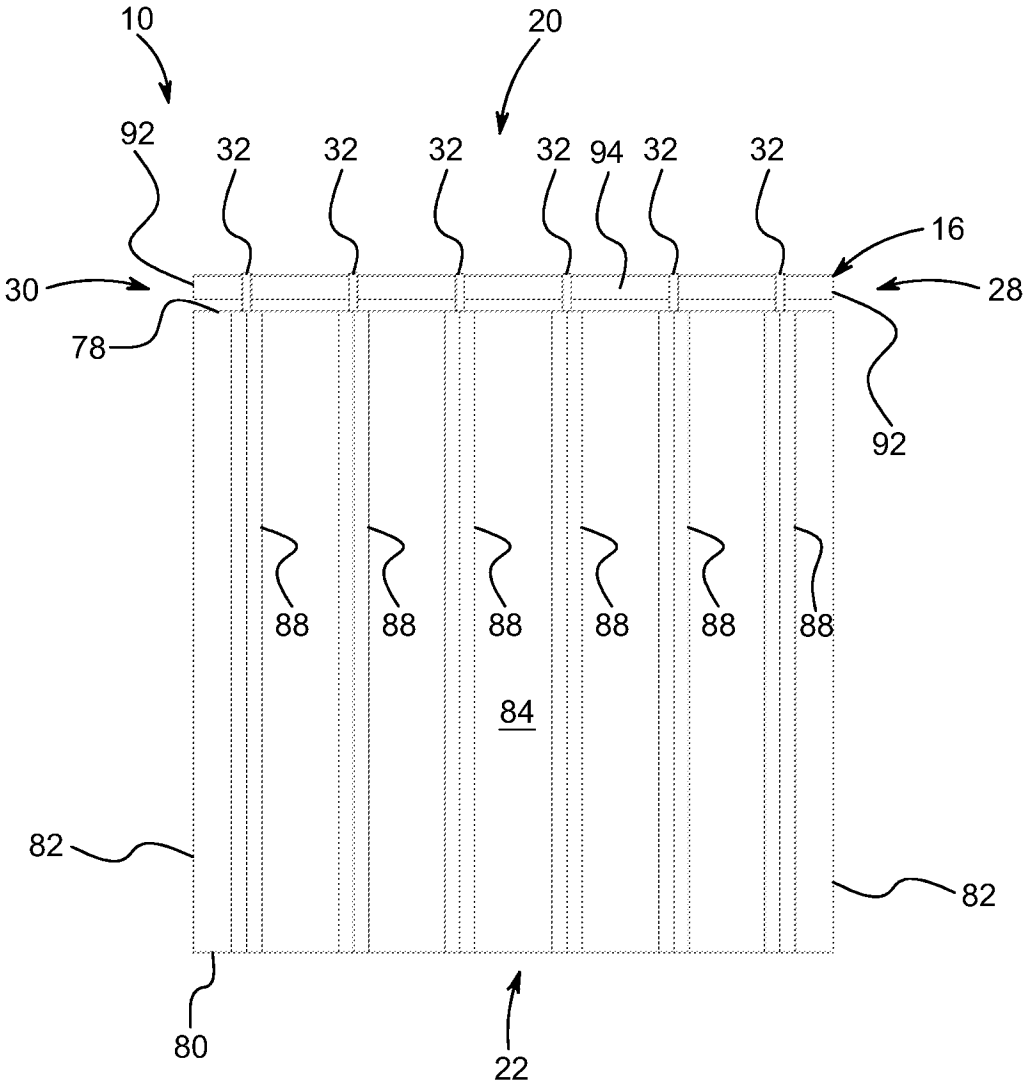
FIG. 27B shows a front view of a pinch pleat and ripplefold drapery system, in accordance with one or more embodiments; the view showing pinch pleat drapery and rings installed on a drapery rod.
Figure 27C:
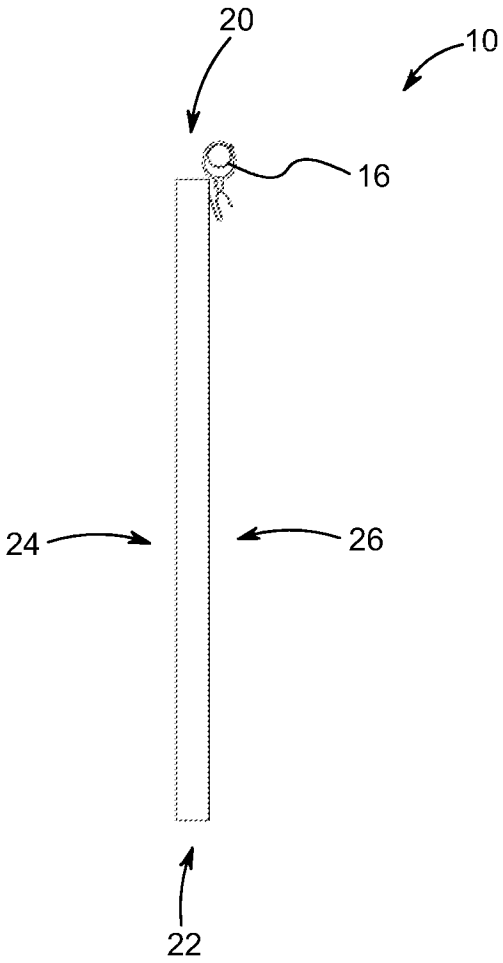
FIG. 27C shows a right side view of a pinch pleat and ripplefold drapery system, in accordance with one or more embodiments; the view showing pinch pleat drapery and rings installed on a drapery rod.
Figure 27D:
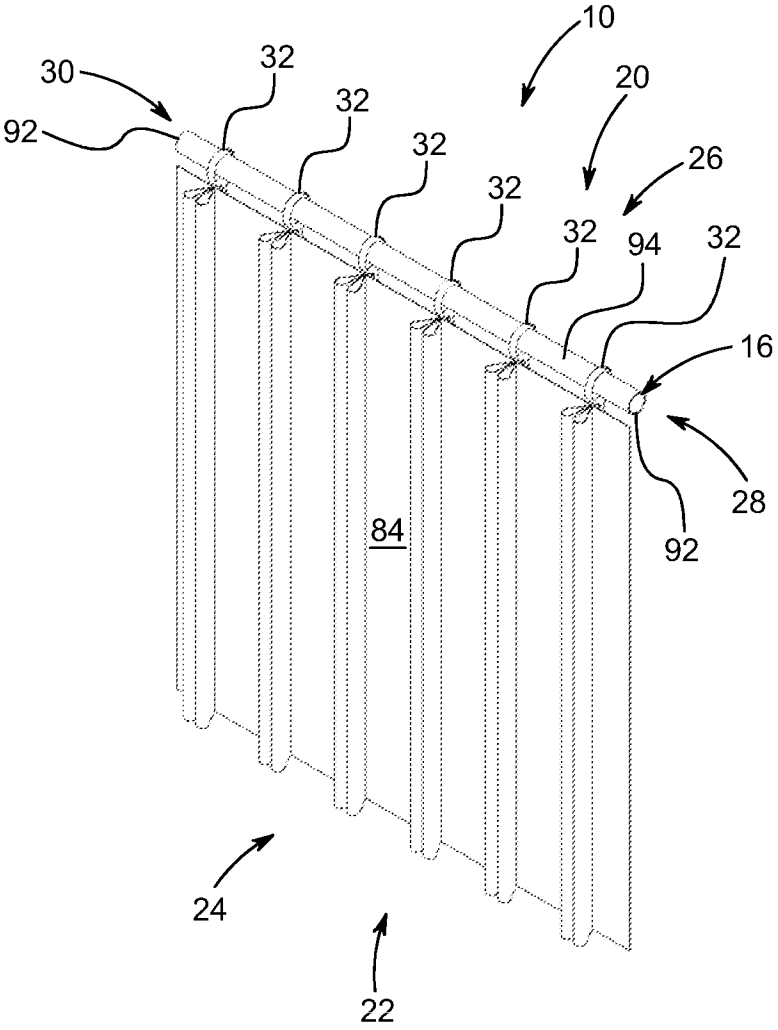
FIG. 27D shows an upper front right perspective view of a pinch pleat and ripplefold drapery system, in accordance with one or more embodiments; the view showing pinch pleat drapery and rings installed on a drapery rod.
Figure 27E:
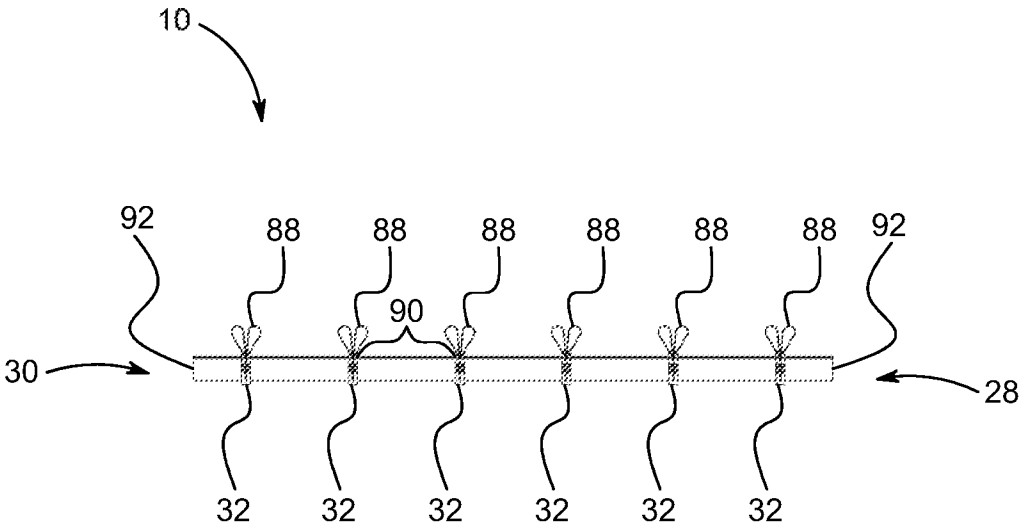
FIG. 27E shows a close up bottom view of a pinch pleat and ripplefold drapery system, in accordance with one or more embodiments; the view showing pinch pleat drapery and rings installed on a drapery rod.
Figure 28A:
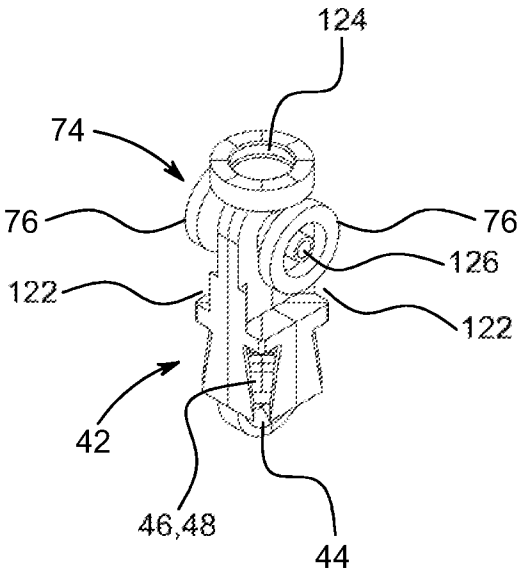
FIG. 28A shows an upper front right perspective view of a carrier for a pinch pleat and ripplefold drapery system, in accordance with one or more embodiments.
Figure 28B:
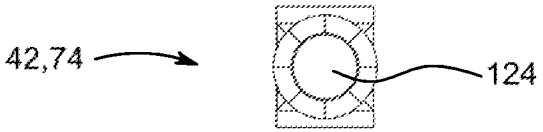
FIG. 28B shows a top view of a carrier for a pinch pleat and ripplefold drapery system, in accordance with one or more embodiments.
Figure 28C:
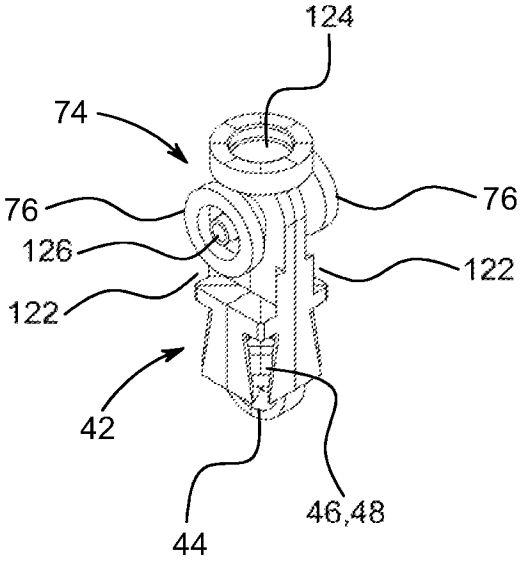
FIG. 28C shows an upper front left perspective view of a carrier for a pinch pleat and ripplefold drapery system, in accordance with one or more embodiments.
Figure 28D:
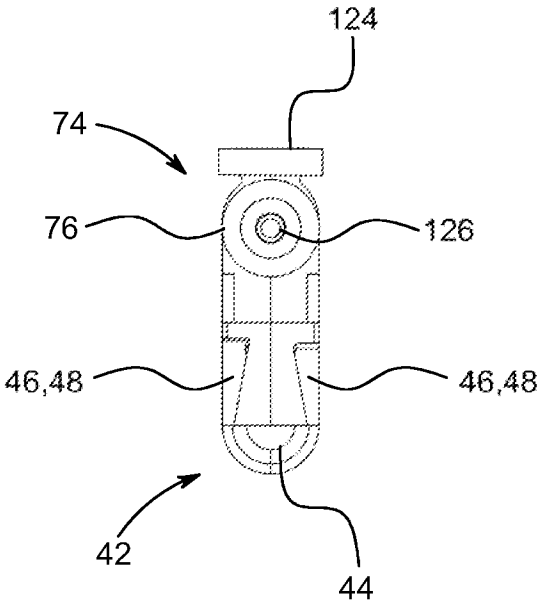
FIG. 28D shows a left side view of a carrier for a pinch pleat and ripplefold drapery system, in accordance with one or more embodiments.
Figure 28E:
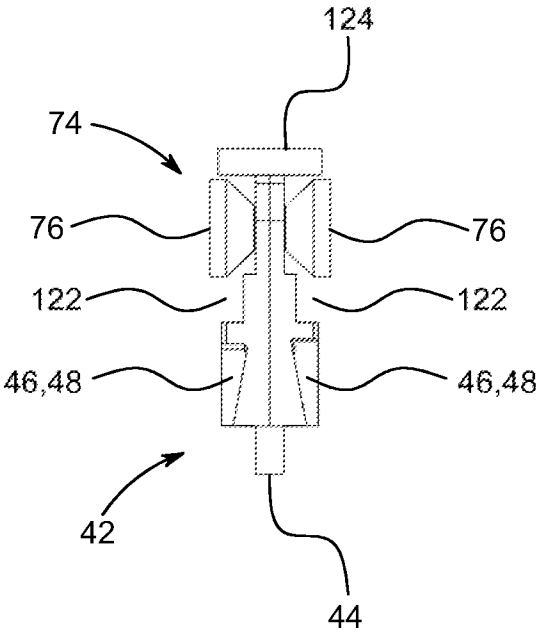
FIG. 28E shows a front view of a carrier for a pinch pleat and ripplefold drapery system, in accordance with one or more embodiments.
Figure 28F:
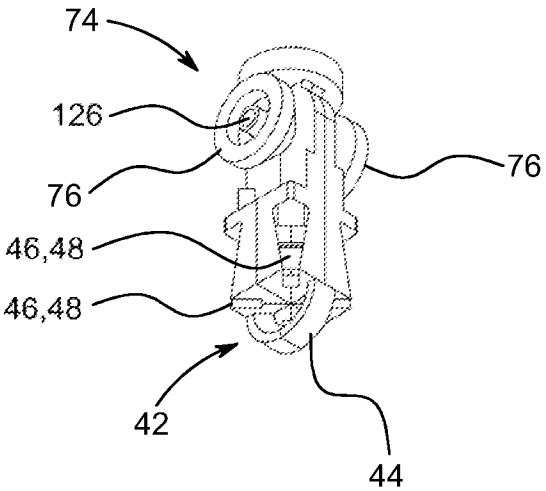
FIG. 28F shows a lower front left perspective view of a carrier for a pinch pleat and ripplefold drapery system, in accordance with one or more embodiments.
Figure 28G:
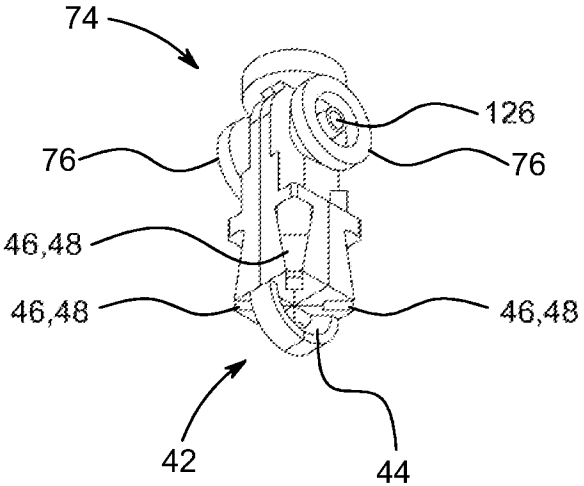
FIG. 28G shows a lower front right perspective view of a carrier for a pinch pleat and ripplefold drapery system, in accordance with one or more embodiments.
Figure 28H:
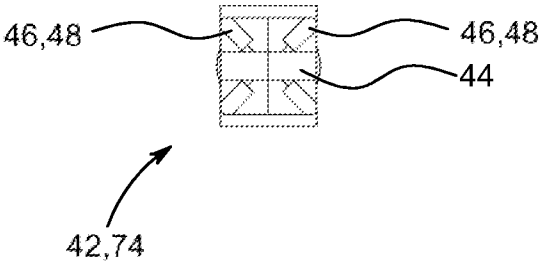
FIG. 28H shows a bottom view of a carrier for a pinch pleat and ripplefold drapery system, in accordance with one or more embodiments.
Figure 29A:
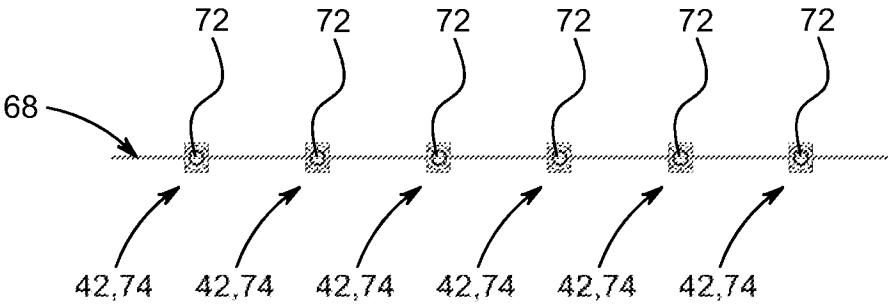
FIG. 29A shows a top view of carriers and lead for a pinch pleat and ripplefold drapery system, in accordance with one or more embodiments.
Figure 29B:
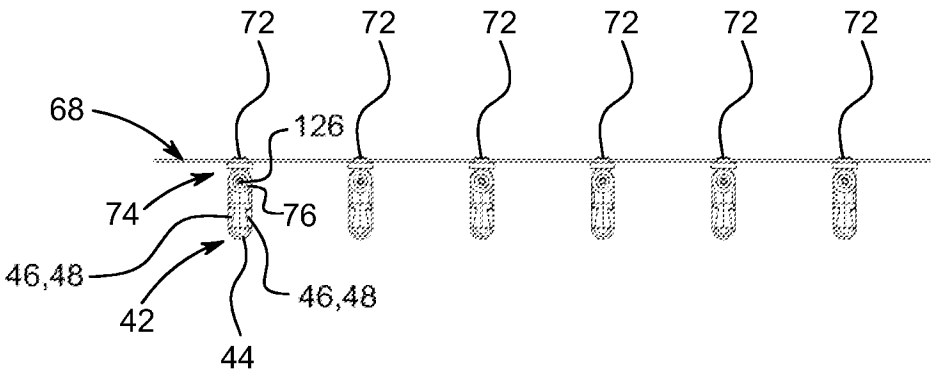
FIG. 29B shows a front view of carriers and lead for a pinch pleat and ripplefold drapery system, in accordance with one or more embodiments.
Figure 29C:
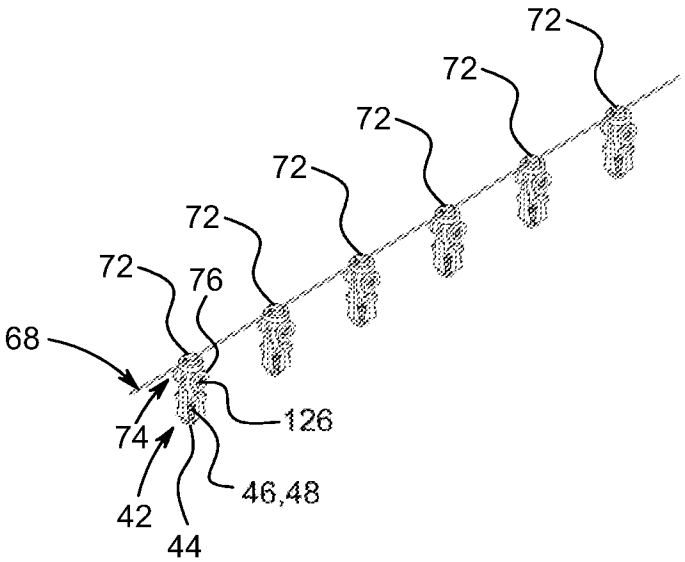
FIG. 29C shows an upper front left perspective view of carriers and lead for a pinch pleat and ripplefold drapery system, in accordance with one or more embodiments.
Figure 30A:
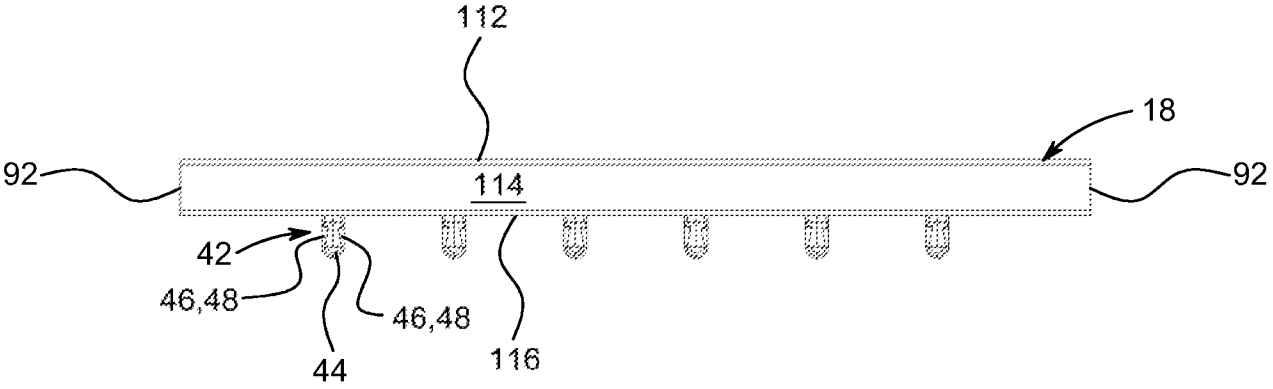
FIG. 30A shows a front view of a pinch pleat and ripplefold drapery system, in accordance with one or more embodiments; the view showing a set of carriers installed on a track with drapery omitted.
Figure 30B:
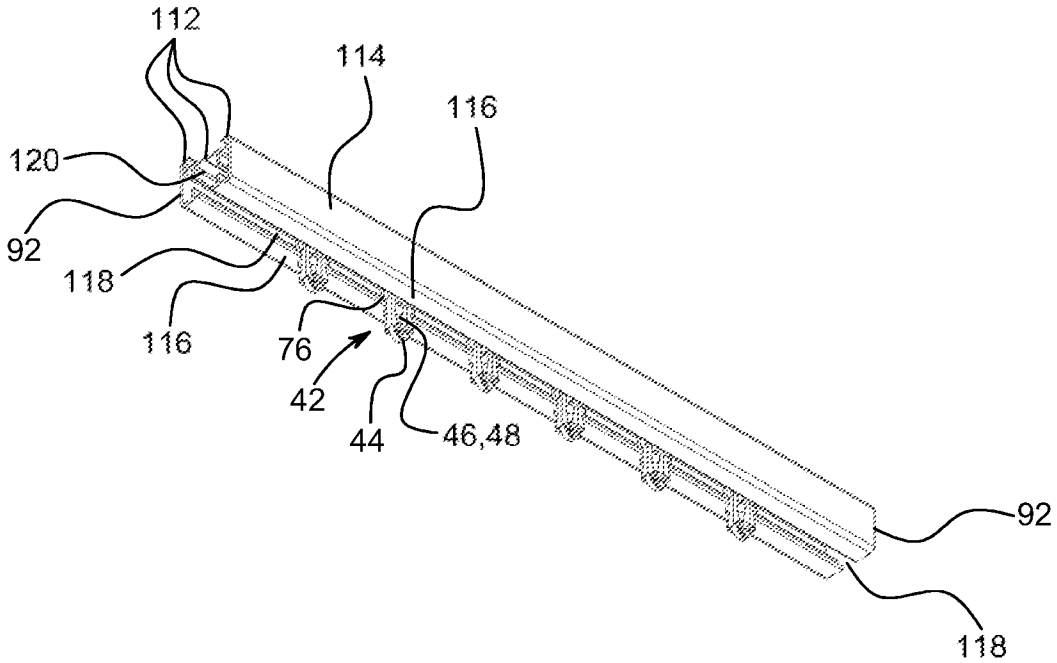
FIG. 30B shows a lower front left perspective view of a pinch pleat and ripplefold drapery system, in accordance with one or more embodiments; the view showing a set of carriers installed on a track with drapery omitted.
Figure 30C:
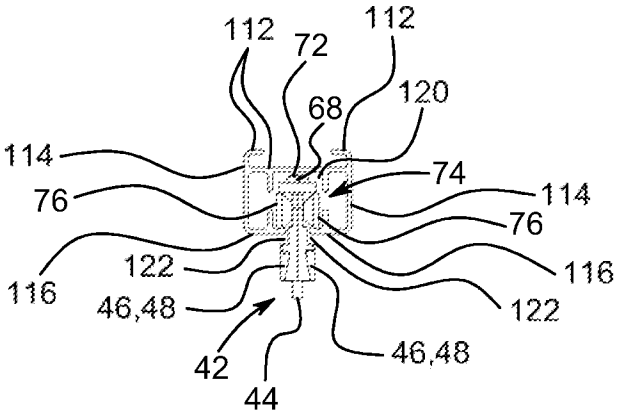
FIG. 30C shows a side view of a pinch pleat and ripplefold drapery system, in accordance with one or more embodiments; the view showing a set of carriers installed on a track with drapery omitted.

In the arrangement shown, as one example, a carrier 74 connects to the upper end of attachment member 42. Carrier 74 is formed of any suitable size, shape and design and is configured to facilitate connection of attachment member 42 to drapery track 18 while allowing attachment member 42 to slide along the length of drapery track 18 while providing angular alignment to attachment member 42. In the arrangement shown, as one example, attachment member 42 and carrier 74 are formed of separate components that are connected to one another by an assembly step such as screwing, bolting, fastening, snap-fitting, gluing, adhering, welding, of by any other assembly step or process or method or means. Alternatively, attachment member 42 and carrier 74 are formed of a single monolithic and continuous member, an example of which is shown in FIGS. 20A and 20B as well as in FIGS. 23B and 23F.

Figure 16:
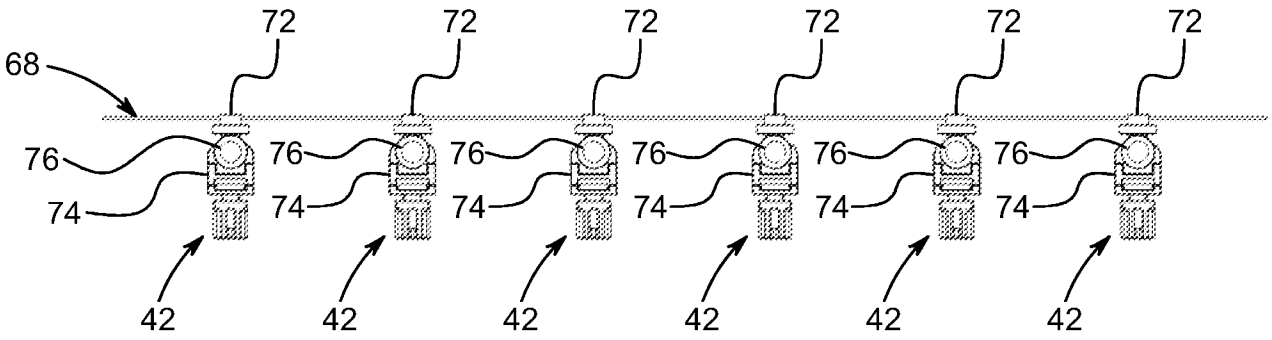
FIG. 16 shows a front view of a pinch pleat and ripplefold drapery system, in accordance with one or more embodiments; the view showing carriers and lead with the drapery track omitted.
Figure 17:
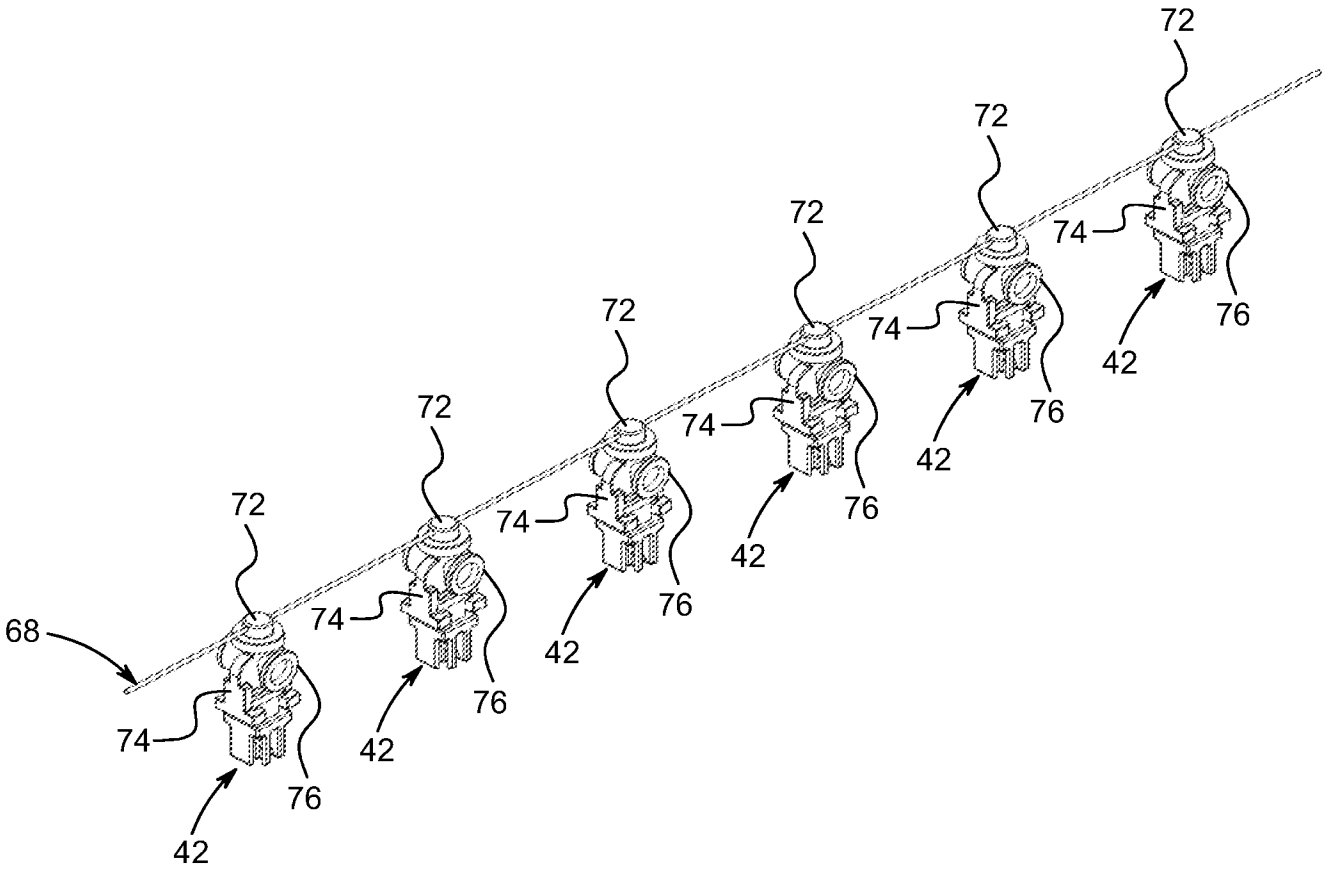
FIG. 17 shows a front left perspective view of a pinch pleat and ripplefold drapery system, in accordance with one or more embodiments; the view showing carriers and lead with the drapery track omitted.
Figure 18A:
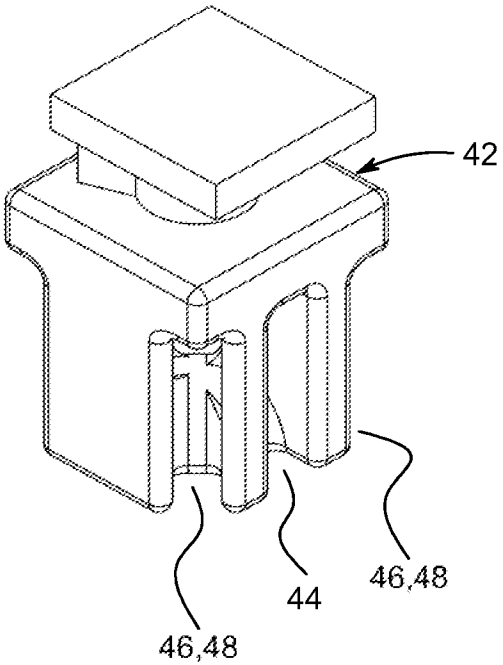
FIG. 18A shows a front left upper perspective view of an attachment member for a set of rings for a pinch pleat and ripplefold drapery system, in accordance with one or more embodiments.
Figure 18B:
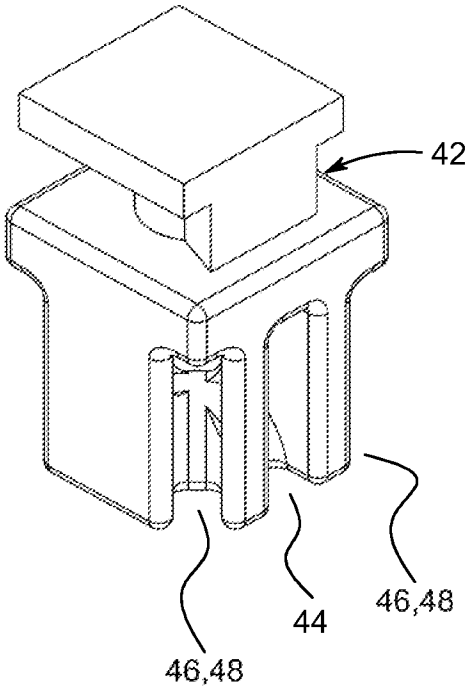
FIG. 18B shows a back right upper perspective view of an attachment member for a set of rings for a pinch pleat and ripplefold drapery system, in accordance with one or more embodiments.
Figure 19A:
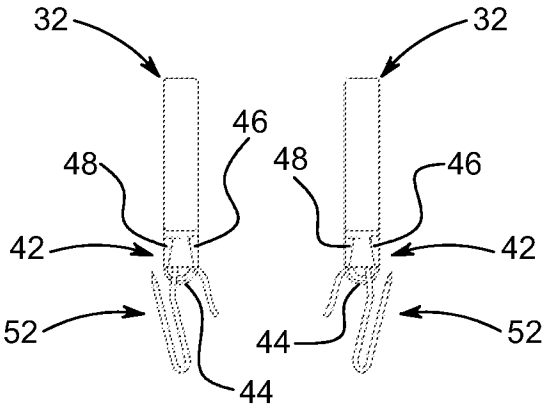
FIG. 19A shows a right and left side views of a ring and drapery pin for a pinch pleat and ripplefold drapery system, in accordance with one or more embodiments.
Figure 19B:
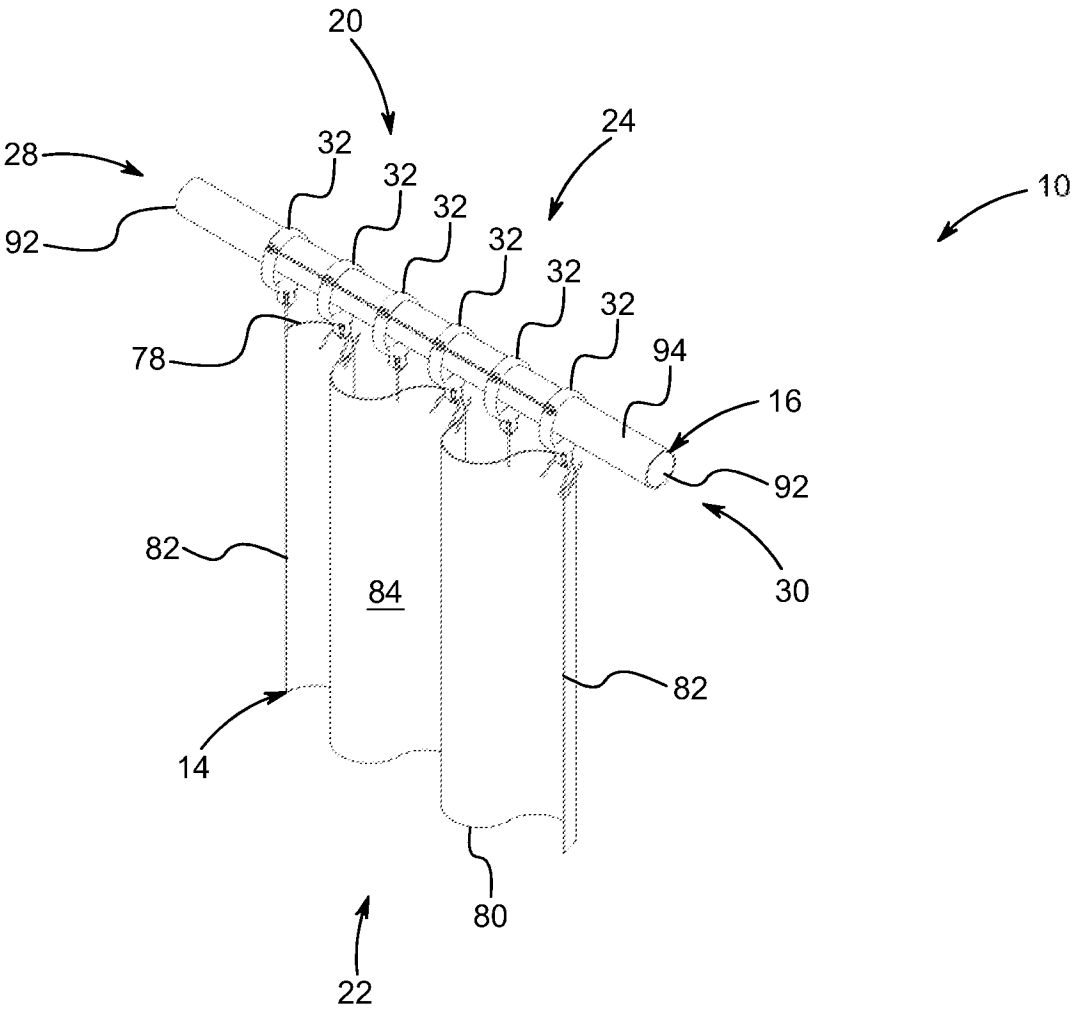
FIG. 19B shows a front right upper perspective view of a pinch pleat and ripplefold drapery system, in accordance with one or more embodiments; the view showing rings and ripplefold drapery installed on a drapery rod.
Figure 19C:
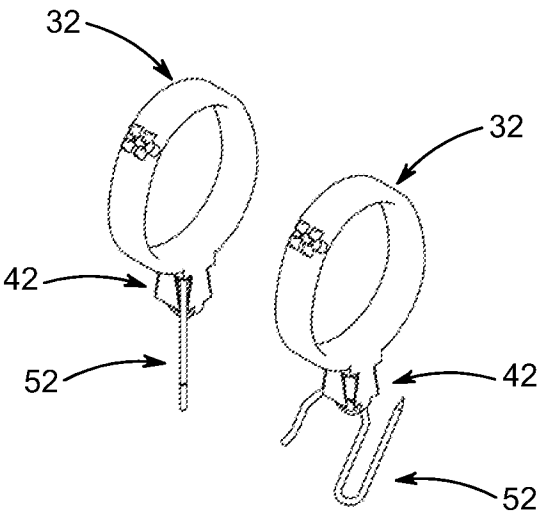
FIG. 19C shows a front left upper perspective view of a ring for a pinch pleat and ripplefold drapery system, in accordance with one or more embodiments; the view showing the ring with drapery pin in a left channel and with a drapery pin in a right channel.
Figure 19D:
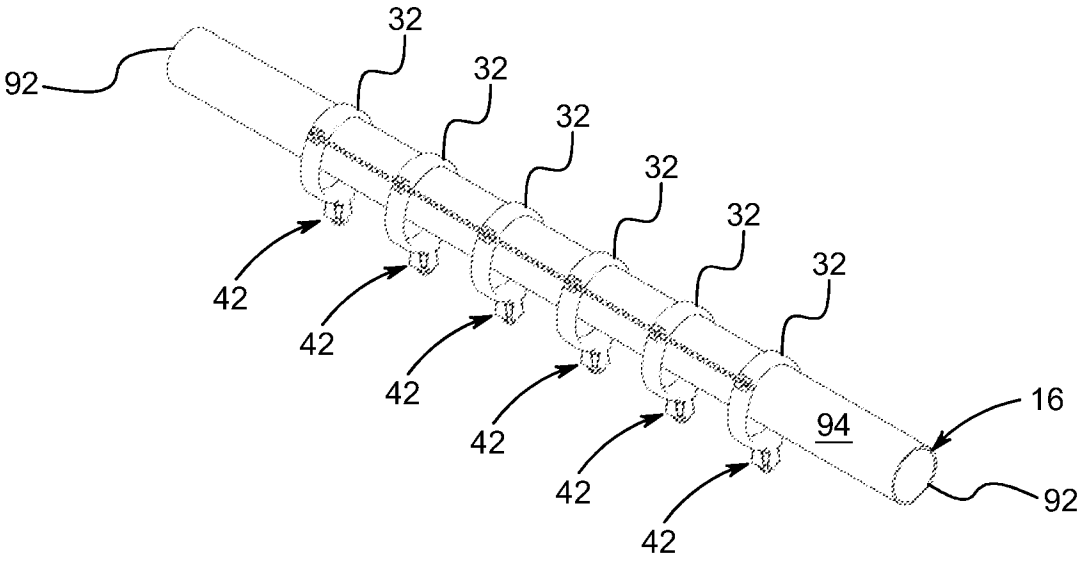
FIG. 19D shows a front right upper perspective view of a pinch pleat and ripplefold drapery system, in accordance with one or more embodiments; the view showing rings installed on a drapery rod with drapery omitted.

In the arrangement shown, as one example, with reference to FIG. 16, carriers 74 include a pair of opposing wheels 76. Wheels 76 are formed of any suitable size shape and design and are configured to fit within the hollow interior 120 of drapery track 18 and roll on the upper surface of lower wall 116 adjacent each side of slot 118 thereby providing alignment to attachment member 42 while providing reduced friction sliding movement of attachment members 42 along the length of drapery track 18.

In the arrangement shown, as one example, carriers 74 have a narrow neck section 122 that fits within slot 118, while other portions of carrier 74 extend upward into the hollow of interior 120 of drapery track 18 while other portions of carrier 74 extend downward below slot 118 of drapery track 18. In the arrangement shown, as one example, neck section 122, when viewed from the side, includes a pair of generally square or rectangular recesses in each side of carrier 74. These recesses of neck section 122 are sized and shaped to receive the inward ends of lower wall 116 of drapery track 18 therein thereby giving carrier 74 clearance to slide within drapery track 18 while also providing alignment to attachment member 42 as it slides along drapery track 18. Or, said another way, the recesses of neck section 122 are configured to fit within slot 118 of drapery track 18. In this way, the reception of neck section 122 within slot 118 with a wider portion of carriers 74 positioned above slot 118 within hollow interior 120 of drapery track 18 and a wider portion of carriers 74 positioned below slot 118 allows for sliding of carriers 74 along slot 118 while also preventing the removal of carriers 74 from slot 118, except for installation or removal from an end of drapery track 18.

In the arrangement shown, as one example, the upper end of carrier 74 includes a receiver 124 that is sized and shaped to receive a connector 72 of lead 68. In the arrangement shown, as one example, with reference to FIGS. 20A, 23B and 23F receiver 124 is a generally circular opening in the upper surface of the combined carrier 74 and attachment member 42. In this arrangement, this generally circular opening in the upper surface of the combined carrier 74 and attachment member 42 is sized and shaped to receive and lock onto connector 72 of lead 68 which sets the maximum distance between adjacent attachment members 42. In one or more arrangements, connector 72 of lead 68 snap fits or friction fits into receiver 124 of carrier 74. However any other assembly step such as screwing, bolting, fastening, snap-fitting, gluing, adhering, welding, of by any other assembly step or process or method or means is hereby contemplated for use. In Operation: In the arrangement shown, as one example, attachment members 42 are connected to drapery track 18 in such a manner that the portion of attachment members 42 having center channel 44, left channel 46 and right channel 48 are positioned below the lower wall 116 of drapery track 18 such that a drapery pin 52 may be inserted in center channel 44, left channel 46 and right channel 48 of attachment members 42. In this position, at least a portion of carriers 74, or combined carriers 74 and attachment members 42 are positioned within the hollow interior 120 of drapery track 18 thereby providing support and alignment to attachment members 42. In this position, carriers 74 may be slid along a length of drapery track 18, or more specifically slot 118, between an open position and a closed position while providing alignment to attachment members 42. As attachment members 42 move along the length of drapery track 18, the maximum distance between adjacent attachment members 42 is set by the distance between connectors 72 of lead 68.

Attachment members 42 may be used to attach a pinch pleat drapery 12 by placing a drapery pin 52 in center channels 44, and attachment members 42 may be used to attach a ripplefold drapery 14 by placing drapery pins 52 in an alternating pattern of left channel 46 and right channel 48, in the same or similar manner described herein with respect to drapery rod 16.

In this way, the pinch pleat and ripplefold drapery system 10 presented herein provides a fast, easy, accurate, effective and aesthetically pleasing system for attaching pinch pleat drapery 12 and ripplefold drapery 14 to both drapery rods 16 as well as drapery tracks 18.

Use Attachment Members to Induce the Direction of Buckling of Panels of Ripplefold Drapery: In the arrangement shown, as one example, attachment members 42 with their left channels 46 and right channels 48 are used in association with drapery pins 52 to induce the direction of buckling of a generally flat panel of ripplefold drapery 14 fabric. This is caused by placing a drapery pin 52 in each adjacent attachment member 42 in an alternating pattern wherein each attachment member 42 that receives a drapery pin 52 in its left channel 46 has an attachment member 42 that receives a drapery pin 52 in its right channel 48 on either side, and vice versa.

In this example arrangement, the drapery pins 52 are relatively tightly constrained in their angular relationship to the drapery rod 16 or drapery track 18. In this example arrangement, the drapery pins 52 are inserted through the material of the ripplefold drapery 14 in a generally perpendicular manner. That is, the drapery pin 52 generally extends through the generally flat plane of the panel of fabric that forms ripplefold drapery 14 in a generally perpendicular front-to-back or back-to-front manner. However, any other angular relationship of insertion of drapery pin 52 is hereby contemplated for use.

In one or more embodiments, the direction of buckling, or ripples, of the ripplefold drapery 14 may be induced by inserting drapery pins 52 through the panel of fabric, which forms ripplefold drapery 14, in a generally perpendicular front-to-back or back-to-front manner, while the angle of the drapery pins 52 are constrained and the drapery pins 52 of the series of attachment members 42 are aligned in an alternating pattern and wherein each attachment member 42 that receives a drapery pin 52 in its left channel 46 has an attachment member 42 that receives a drapery pin 52 in its right channel 48 on either side, and vice versa. That is, the curve and/or shape of the buckles or ripples of the ripplefold drapery 14 are caused by the connection between the drapery pins 52 and the angles at which the drapery pins 52 are held by attachment members 42. This induces a beautiful, natural looking and aesthetically pleasing smooth sinusoidal curve or ripple-effect to ripplefold drapery 14.

In addition, the depth or fullness of the buckles or ripples may be set by the amount of material that is placed between each drapery pin 52. This spacing may be easily adjusted by simply moving the insertion point of drapery pins 52, and as such there is no need to sew in a new snap tape or any other component. In addition, the amount of fullness or flatness of ripplefold drapery 14 is also affected by the spacing between adjacent connectors 72, the wider the spacing between adjacent connectors 72 the flatter the ripplefold drapery 14 in a fully closed position.

In this way, the system 10 presented herein provides a user with unprecedented control of a ripplefold drapery 14 in addition to using the same system to hang a pinch pleat drapery 12. In this way, the system 10 presented herein provides a user with an unprecedented ability to modify and customize the manner in which a ripplefold drapery 14 hangs by simply moving the position of the drapery pins 15, which can easily be done by hand and without any tools of special training.

This ease and flexibility of modifying a ripplefold drapery 14 allows a user to set the buckles or ripples to have equal-length on the front and back side of a drapery rod 16 or drapery track 18. Or alternatively, this ease and flexibility of modifying a ripplefold drapery 14 allows a user to set the buckles or ripples to have more or less length on the front side or back side of a drapery rod 16 or drapery track 18.

This ease and flexibility of modifying a ripplefold drapery 14 allows a user to set the buckles or ripples to have equal-length or equal shape along the left-to-right length of a drapery rod 16 or drapery track 18. Or alternatively, this ease and flexibility of modifying a ripplefold drapery 14 allows a user to set the buckles or ripples to have varying length or varying shape along the left-to-right length of a drapery rod 16 or drapery track 18, such as shallow ripples toward the outward ends and deeper ripples toward the center on a center opening and center closing drapery rod 16 or drapery track 18.

Alternative Arrangement:

With reference to FIGS. 15-18B and FIGS. 28A-30C an alternative embodiment of pinch pleat and ripplefold drapery system 10 is presented. This alternative embodiment of a pinch pleat and ripplefold drapery system 10 is similar to the embodiment shown in FIGS. 15-18 with a difference being that in the arrangement shown in FIGS. 15-18 attachment member 42 is a separate member from carrier 74. In this arrangement, attachment member 42 is connected to the separate carrier 74 thereby forming a combined attachment member 42 and carrier 74 arrangement formed of two separate parts.

In contrast, with reference to FIGS. 28A-30C the attachment member 42 and carrier 74 are formed as a single continuous member. This provides increased strength, rigidity and durability. This also simplifies the configuration of the attachment member 42 and carrier 74 by eliminating the features that allow the attachment member 42 and carrier 74 to connect to one another. This also reduces the number of pieces of the system 10.

In the arrangement shown, wherein the attachment member 42 and carrier 74 are formed as a single continuous member, wheels 76 are connected to carrier 74 just above the lower end of neck section 122 such that the neck section 122 extends through slot 118 and the wheels 76 roll on the upper surface of lower walls 116 adjacent slot 118. In the arrangement shown, as one example, wheels 76 connected to carriers 74 by way of axles 126. In this arrangement, wheels 76 rotate around the axis or rotation formed by axles 126.

This embodiment provides many improvements and benefits as is described herein. This includes a simplified design, increased strength and durability, less sophisticated, and therefore lower cost, parts and components, and a simplified assembly and installation.

Notably, when wheels 76 are not present, attachment member 42 and carrier 74 simply slide along slot 118 of drapery track 18. In contrast, when wheels 76 are present, attachment member 42 and carrier 74 may roll along slot 118 of drapery track 18. The presence of wheels 76 may reduce friction, provides smoother operation, and provide quieter operation, among other benefits.

From the above discussion it will be appreciated that the pinch pleat and ripplefold drapery system 10 and related methods of use, presented herein improves upon the state of the art.

Specifically, the pinch pleat and ripplefold drapery system 10 and related methods of use presented: effectively attaches pinch pleat drapery material to a supporting track; effectively attaches ripplefold drapery material to a supporting track; effectively attaches pinch pleat drapery material to a supporting rod; effectively attaches ripplefold drapery material to a supporting rod; provides aesthetically pleasing results when using pinch pleat drapery material; provides aesthetically pleasing results when using ripplefold drapery material; does not require sewing snap tape to the top of the drapery for use; is easy to use; is simple in design; allows for infinite adjustment of the installation of a ripplefold drapery; allows for installation of equal-spaced ripples in a ripplefold drapery; allows for installation of varying-spaced ripples in a ripplefold drapery; is relatively inexpensive or affordable; facilitates smooth operation; has a minimum number of parts; can be manually operated as well as operated by motorization; facilitates robust operation; makes it easier to use draperies; makes it easier to install draperies; makes it less expensive to install draperies; provides a user with greater installation options; controls the positioning of the drapery material within close tolerances; allows for the adjustment of the fullness of a drapery; allows for custom installations, such as more-full in the front, or varying ripple spacing along the length of the drapery material; allows for the creation of the ripplefold look using a flat panel of drapery material; and/or allows for the creation of the ripplefold look using a flat panel of drapery material hung from a drapery rod; among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A pinch pleat and ripplefold drapery system, comprising:

a plurality of attachment members;

wherein each of the plurality of attachment members have a center channel, a left channel and a right channel;

wherein the center channel, the left channel and the right channel of each of the plurality of attachment members are configured to receive a drapery pin;

wherein when the drapery pin is positioned within the center channel of an attachment member of the plurality of attachment members, the drapery pin is held in a generally perpendicular alignment to the attachment member;

wherein when the drapery pin is positioned within the left channel of the attachment member the drapery pin is held in a left-angled alignment to the attachment member;

wherein when the drapery pin is positioned within the right channel of the attachment member the drapery pin is held in a right-angled alignment to the attachment member;

wherein when a pinch pleat drapery is used the drapery pin is placed in the center channel of each of the plurality of attachment members;

wherein when a ripplefold drapery is used, the drapery pin is positioned in either the left channel or the right channel of the attachment member of the plurality of attachment members in a pattern where each adjacent attachment members to the attachment member have an opposite-facing drapery pin.

2. The system of claim 1, further comprising each of the plurality of attachment members are connected to a ring.

3. The system of claim 1, further comprising each of the plurality of attachment members are connected to a track.

4. The system of claim 1, further comprising each of the plurality of attachment members are connected to a drapery rod.

5. The system of claim 1, wherein each of the plurality of attachment members include a connection member connected to the attachment member, the connection member configured to receive a lead that is configured to space the attachment member from the adjacent attachment members.

6. The system of claim 1, wherein the left-angled alignment is approximately forty-five degrees from the perpendicular alignment.

7. The system of claim 1, wherein the right-angled alignment is approximately forty-five degrees from the perpendicular alignment.

8. The system of claim 1, wherein when a pinch pleat drapery is used, the drapery pin is held by the attachment member in a generally perpendicular alignment.

9. The system of claim 1, wherein when a ripplefold drapery is used, the drapery pin is held by the attachment member in a left-angled alignment or a right-angled alignment.

10. The system of claim 1, wherein the plurality of attachment members are each formed of a plurality of pieces that are connected together.

11. The system of claim 1, wherein the plurality of attachment members are each formed of a single solid and continuous piece.

12. The system of claim 1, wherein each of the plurality of attachment members include at least one wheel that facilitates rolling during operation.

13. A pinch pleat and ripplefold drapery rod system, comprising:

a drapery rod;

the drapery rod extending a length between opposing ends;

a plurality of attachment members;

the plurality of attachment members operably connected to the drapery rod;

wherein each of the plurality of attachment members have a center channel, a left channel and a right channel;

wherein the center channel, the left channel and the right channel are configured to receive a drapery pin;

wherein when a pinch pleat drapery is attached to the drapery rod, the drapery pin is positioned in the center channel of each of the plurality of attachment members which holds the drapery pin in a generally perpendicular alignment to an attachment member of the plurality of attachment members;

wherein when a ripplefold drapery is attached to the drapery rod, the drapery pin is positioned in either the left channel or the right channel of the attachment member of the plurality of attachment members in a pattern where each adjacent attachment member to the attachment member have an opposite-facing drapery pin.

14. The system of claim 13, further comprising a plurality of rings;

wherein each of the plurality of attachment members are connected to a respective one of the plurality of rings wherein the plurality of rings are positioned around the drapery rod.

15. The system of claim 13, wherein each of the plurality of attachment members include a connection member connected to the attachment member, the connection member configured to receive a lead that is configured to space the attachment member from each adjacent attachment member.

16. The system of claim 13, wherein when the drapery pin is positioned within the left channel of the attachment member the drapery pin is held in a left-angled alignment to the attachment member; and wherein the left-angled alignment is approximately forty-five degrees from the perpendicular alignment.

17. The system of claim 13, wherein when the drapery pin is positioned within the right channel of the attachment member the drapery pin is held in a right-angled alignment to the attachment member; and wherein the right-angled alignment is approximately forty-five degrees from the perpendicular alignment.

18. A pinch pleat and ripplefold drapery track system, comprising:

a drapery track;

the drapery track extending a length between opposing ends;

a plurality of attachment members;

the plurality of attachment members operably connected to the drapery track;

wherein each of the plurality of attachment members have a center channel, a left channel and a right channel;

wherein the center channel, the left channel and the right channel are configured to receive a drapery pin;

wherein when a pinch pleat drapery is attached to the drapery track, the drapery pin is positioned in the center channel of each of the plurality of attachment members which holds the drapery pin in a generally perpendicular alignment to an attachment member of the plurality of attachment members;

wherein when a ripplefold drapery is attached to the drapery track, the drapery pin is positioned in either the left channel or the right channel of the attachment member of the plurality of attachment members in a pattern where each adjacent attachment member to the attachment member have an opposite-facing drapery pin.

19. The system of claim 18, further comprising each of the plurality of attachment members connected to a carrier wherein the carrier is positioned within a slot of the drapery track.

20. The system of claim 18, wherein each of the plurality of attachment members protrude through a slot of the drapery track.

21. The system of claim 18, a carrier connected to each of the plurality of attachment members and a lead connected to the plurality of attachment members that is configured to space each attachment member from each adjacent attachment member.

22. The system of claim 18, wherein when the drapery pin is positioned within the left channel of the attachment member the drapery pin is held in a left-angled alignment to the attachment member; and wherein the left-angled alignment is approximately forty-five degrees from the perpendicular alignment.

23. The system of claim 18, wherein when the drapery pin is positioned within the right channel of the attachment member the drapery pin is held in a right-angled alignment to the attachment member; and wherein the right-angled alignment is approximately forty-five degrees from the perpendicular alignment.

24. The system of claim 18, wherein the plurality of attachment members are each formed of a plurality of pieces that are connected together.

25. The system of claim 18, wherein the plurality of attachment members are each formed of a single solid and continuous piece.

26. The system of claim 18, wherein each of the plurality of attachment members include at least one wheel that facilitates rolling during operation.

* * * * *